US007074550B2

(12) United States Patent
Miki

(10) Patent No.: US 7,074,550 B2
(45) Date of Patent: Jul. 11, 2006

(54) SILVER HALIDE COLOR PHOTOSENSITIVE MATERIAL

(75) Inventor: Masaaki Miki, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/947,247

(22) Filed: Sep. 23, 2004

(65) Prior Publication Data

US 2005/0069825 A1 Mar. 31, 2005

(30) Foreign Application Priority Data

Sep. 24, 2003 (JP) ..... 2003-332332

(51) Int. Cl.

| | |
|---|---|
| ***G03C 1/46*** | (2006.01) |
| ***G03C 1/08*** | (2006.01) |
| ***G03C 1/05*** | (2006.01) |
| ***G03C 1/494*** | (2006.01) |
| ***G03C 1/06*** | (2006.01) |

(52) U.S. Cl. ..... 430/506; 430/502; 430/503; 430/509; 430/567; 430/505; 430/600; 430/611; 430/613; 430/615

(58) Field of Classification Search ..... 430/502, 430/503, 506, 567, 509, 505, 600, 611, 613, 430/615

See application file for complete search history.

(56) References Cited

U.S. PATENT DOCUMENTS

| | | | | |
|---|---|---|---|---|
| 5,183,730 | A | 2/1993 | Yagi | |
| 6,537,740 | B1 * | 3/2003 | Omae et al. | 430/506 |
| 6,811,963 | B1 * | 11/2004 | Johnston et al. | 430/506 |

FOREIGN PATENT DOCUMENTS

| | | | |
|---|---|---|---|
| JP | 02-110542 | A | 4/1990 |
| JP | 11-119361 | A | 4/1999 |

* cited by examiner

*Primary Examiner*—Geraldine Letscher
(74) *Attorney, Agent, or Firm*—Sughrue Mion, PLLC

(57) ABSTRACT

A silver halide color photosensitive material comprising a support and, superimposed thereon, at least one blue-sensitive silver halide emulsion layer, green-sensitive silver halide emulsion layer and red-sensitive silver halide emulsion layer, wherein (i) the specified speed of the photosensitive material is 350 or higher, (ii) the coating amount of silver in the photosensitive material is 7 g/m$^2$ or less, and (iii) any of the color-sensitive silver halide emulsion layers is composed of two or more silver halide emulsion layers of different photographic speeds, of which the silver halide emulsion layer with the highest photographic speed contains tabular silver halide grains of 8 or greater aspect ratio in a ratio of 70% or more based on the total projected area and regular-crystal silver halide grains of 0.1 to 0.5 μm equivalent sphere diameter in a ratio of 0.5 to 5% based on the total projected area.

5 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2003-332332, filed Sep. 24, 2003, the entire contents of which are incorporated herein by reference.

BACKGROUND OF THE INVENTION

1. Field of the Invention

The present invention relates to a silver halide color photosensitive material which despites a small coating amount of silver, is highly sensitive and is capable of reducing deterioration of bright acuity.

2. Description of the Related Art

With respect to the silver halide color photo-sensitive material, further sensitivity enhancement is being urged for increasing the user benefit of color negative films. Especially in recent years, the regular use of highly sensitive films is being promoted in accordance with the penetration of compact cameras with zooming capability and lens-equipped films which enable readily and easily coping with various exposure conditions.

This film sensitivity enhancement realizes an expansion of the photographing range of photo-sensitive materials to, for example, photographing in dark rooms, fast-shutter photographing with the use of telephoto lens like sports photography, etc. Thus, the users can have tremendous benefits therefrom. Therefore, the sensitivity enhancement of films is one of everlasting themes to be tackled in this industry.

An effective method for obtaining a highly sensitive film comprises absorbing incident light as much as possible. One means therefor is increasing of a coating amount of silver. This however has disadvantages such as increasing of film cost and inviting of deterioration of desilvering characteristics at the time of development.

Another means for increasing the amount of light absorption comprises increasing the specific surface area of photo-sensitive silver halide grains. For attaining this, wide use is being made of tabular silver halide grains with enhanced aspect ratio. However, when the aspect ratio is extremely high, this causes the thickness of tabular grains to be extremely small, thereby inviting reflection of much of incident light. For example, a structure comprising a green-sensitive silver halide emulsion layer and, disposed thereunder, a red-sensitive silver halide emulsion layer would encounter such a problem that when the aspect ratio of grains of green-sensitive silver halide emulsion layer is extremely high, much of the red component of incident light is completely reflected by the green-sensitive layer and cannot arrive at the red-sensitive layer, resulting in a serious decrease of the amount of light absorption. Therefore, the method of increasing the amount of light absorption through enhancing of the aspect ratio of tabular grains has its limits.

Further other means for increasing the amount of light absorption comprises scattering light in the film. This is a method of increasing the effective light path length in the film. Silver halide grains have a high refractive index to gelatin film and accordingly are effective as a scatterer. Regular-crystal silver halide grains exhibit a high light scattering degree to tabular grains, so that mixing of tabular grains with regular-crystal silver halide grains agrees with the above object. With respect to the silver halide color photosensitive material wherein tabular grains are mixed with regular-crystal silver halide grains, reference can be made to prior art literature: Jpn. Pat. Appln. KOKAI Publication No. (hereinafter referred to as JP-A-) 11-119361 and Japanese Patents 2881315 and 2683625 (hereinafter respectively referred to Patent References 1, 2 and 3). Patent Reference 1 discloses a silver halide color photosensitive material having a photographic constituent layer containing an emulsion of tabular grains of 5 or higher aspect ratio and an emulsion of regular-crystal silver halide grains. Patent Reference 2 discloses a silver halide photosensitive material including an emulsion layer containing an emulsion of tabular grains of 1.2 or higher aspect ratio and core/shell type regular-crystal silver halide grains. Patent Reference 3 discloses a silver halide photosensitive material including an emulsion layer containing tabular grains of 5 or higher aspect ratio and 0.01 to 0.08 μm thickness and core/shell type regular-crystal silver halide grains. Although these can exert the above effects, as described later, deterioration of bright acuity and unfavorable side effects on image quality are inevitably invited thereby.

BRIEF SUMMARY OF THE INVENTION

The present invention has been developed with a view toward solving the above problems. It is an object of the present invention to provide a silver halide color photosensitive material which realizes a small coating amount of silver and a high sensitivity and retards the deterioration of bright acuity.

The object of the present invention has been attained by the following means.

(1) A silver halide color photosensitive material comprising a support and, superimposed thereon, at least one blue-sensitive silver halide emulsion layer, at least one green-sensitive silver halide emulsion layer and at least one red-sensitive silver halide emulsion layer, wherein (i) the specified speed of the photosensitive material is 350 or higher, (ii) the coating amount of silver in the photosensitive material is 7 g/m$^2$ or less, and (iii) any of the color-sensitive silver halide emulsion layers is composed of two or more silver halide emulsion layers of different photographic speeds, of which the silver halide emulsion layer with the highest photographic speed contains tabular silver halide grains of 8 or greater aspect ratio in a ratio of 70% or more based on the total projected area and regular-crystal silver halide grains of 0.1 to 0.5 μm equivalent sphere diameter in a ratio of 0.5 to 5% based on the total projected area.

(2) The silver halide color photosensitive material according to item (1) above, wherein the regular-crystal silver halide grains are those spectrally sensitized.

(3) The silver halide color photosensitive material according to item (1) above, wherein the regular-crystal silver halide grains are those spectrally sensitized by a dye contained in the color-sensitive silver halide emulsion layer.

(4) The silver halide color photosensitive material according to any one of items (1) to (3) above, wherein the photosensitive material contains compound (A) which is a heterocyclic compound having one or more heteroatoms, the compound capable of substantially increasing the sensitivity of the silver halide color photosensitive material by addition thereof as compared with that exhibited when the compound is not added.

(5) The silver halide color photosensitive material according to any one of items (1) to (4), wherein the coating amount of silver is 5 g/m$^2$ or less.

(6) The silver halide color photosensitive material according to item (4), wherein the compound (A) is represented by the following general formula (I):

General formula (I)

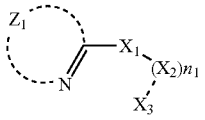

Where $Z_1$ represents a group for forming a heterocycle having one or two heteroatoms including the nitrogen atom of the formula; each of $X_1$ and $X_2$ independently represents a sulfur atom, an oxygen atom, a nitrogen atom (N(Va)) or a carbon atom (C(Vb)(Vc)), each of Va, Vb and Vc independently represents a hydrogen atom or a substituent; $n_1$ is 0, 1, 2 or 3, a plurality of $X_2$ may be the same or different when $n_1$ is 2 or greater; $X_3$ represents a sulfur atom, an oxygen atom or a nitrogen atom; and the bond between $X_2$ and $X_3$ is single or double, wherein $X_3$ may further have a substituent or a charge.

DETAILED DESCRIPTION OF THE INVENTION

The present invention will be described in greater detail below.

The silver halide color photosensitive material according to the present invention comprises a support and, superimposed thereon, at least one blue-sensitive silver halide emulsion layer, green-sensitive silver halide emulsion layer and red-sensitive silver halide emulsion layer. Any of the color-sensitive silver halide emulsion layers is composed of two or more silver halide emulsion layers of different photographic speeds.

It is preferred that the color photosensitive material be provided with not only the photo-sensitive emulsion layers but also various nonsensitive layers, such as a protective layer, a color mixing prevention layer, a yellow filter layer (simultaneously functioning as a color mixing prevention layer) and an antihalation layer.

Although the order of layer arrangement is not particularly limited, as a typical example, there can be mentioned a color photosensitive material comprising, arranged in the following sequence from the position most remote from a support toward the support, a protective layer, two or more blue-sensitive emulsion layers, a yellow filter layer (simultaneously functioning as a color mixing prevention layer), two or more green-sensitive emulsion layers, a color mixing prevention layer, two or more red-sensitive emulsion layers, a color mixing prevention layer and an antihalation layer. With respect to two or more layers with the same color sensitivity, it is common practice to dispose an emulsion layer of higher speed at a position remoter from the support.

For the purpose of sensitivity enhancement, as different from the above typical arrangement, layers of highest speed among the emulsion layers with different color sensitivities, namely, blue-, green- and red-sensitive emulsion layers can be arranged on positions most remote from the support. That is, for example, there can be employed a layer arrangement comprising, disposed in the following sequence from the position most remote from a support, a protective layer, a blue-sensitive emulsion layer of highest speed, a color mixing prevention layer, a green-sensitive emulsion layer of highest speed, a color mixing prevention layer, a red-sensitive emulsion layer of highest speed, a color mixing prevention layer, two or more blue-sensitive emulsion layers, a yellow filter layer (simultaneously functioning as a color mixing prevention layer), two or more green-sensitive emulsion layers, a color mixing prevention layer, two or more red-sensitive emulsion layers, a color mixing prevention layer and an antihalation layer.

The specified photographic speed referred to in the present invention is determined by the method described in JP-A-63-236035. The determining method is substantially in accordance with JIS K 7614-1981 except that the development processing is completed within 30 min to 6 hr after exposure for sensitometry and that the development processing is performed in the manner described in Example 1 of the present application.

The specified speed of the silver halide color photosensitive material of the present invention is 350 or higher, preferably 400 or higher. There is no particular upper limit with respect to the specified speed.

The coating amount of silver refers to the mass of silver which is equimolar to that of the photo-sensitive silver halides used in the coating. There are some methods known for analysis of the coating amount of silver of photosensitive materials, any of which can be employed. For example, the fluorescent X-ray method is simple. With respect to the silver halide color photosensitive material of the present invention, the coating amount of silver is 7 g/m$^2$ or less, preferably 6 g/m$^2$ or less, and more preferably 5 g/m$^2$ or less.

There is no particular lower limit with respect to the coating amount of silver. However, from the viewpoint that extreme reduction would cause film detection at processing to be difficult, it is preferred that the coating amount of silver be at least 2 g/m$^2$.

The silver halide grains for use in the present invention will be described in detail below.

The silver halide grains for use in the present invention preferably consist of silver halides containing silver iodide, especially silver iodobromide or silver iodochlorobromide.

The regular-crystal silver halide grains have an equivalent sphere diameter of 0.1 to 0.5 μm and are contained in an amount of 0.5 to 5% based on the total projected area. When the equivalent sphere diameter is extremely small, scattering of green light and especially red light is less to result in poor effects. On the other hand, when the equivalent sphere diameter is extremely large, light scattering is so intense as to result in marked deterioration of bright acuity. When the ratio to the total projected area is less than 0.5%, effects are slight. On the other hand, when the ratio exceeds 5%, deterioration of bright acuity is conspicuous. The equivalent sphere diameter is preferably in the range of 0.1 to 0.4 μm, more preferably 0.1 to 0.3 μm. The ratio to the total projected area is preferably in the range of 1 to 4%.

The differences between the aforementioned Patent References 1 to 3 and the present invention will be described below. In Patent Reference 1, there is no description relating to the size of regular-crystal silver halide grains. In Examples thereof, the size of regular-crystal silver halide grains used in mixture with tabular grains is 0.7 μm or greater. These regular-crystal silver halide grains would unfavorably suffer deterioration of bright acuity because of extremely large size, as different from the present invention. In Patent Reference 3 as well, the size of regular-crystal silver halide grains is not specified. Although there is a description to the effect that preferred range is 0.1 to 20 μm, the size of grains for use as photo-sensitive silver halide grains is generally in the range of 0.1 to 2 μm and hence the above description does not suggest preferred range of the present invention. Moreover, the grain size described in Examples is as large as 0.65 μm, being different from the range of the present invention. In Patent Reference 2, it is specified that the ratio of projected area occupied by regular-crystal silver halide grains to that by tabular grains is 40% or less. It is further described that especially preferred range is from 5 to 15%. In Working Examples thereof, the regular-crystal silver halide grains occupy 7 to 16% of the projected area. That is, the range indicated as being preferred in Patent Reference 2 is different from that of the present invention. The cause of this difference would be that while in Patent Reference 2 only tabular grains of aspect ratio as low as about 2 to 4 are practically employed, grains of high aspect ratio are employed in the present invention, resulting in difference in light scattering characteristics of tabular grains. In the system containing grains of high aspect ratio as in the present invention, the use of the amount indicated as being preferred in Patent Reference 2 would unfavorably invite marked deterioration of bright acuity. The effect regarding sensitivity and bright acuity has been for the first time attained by the present invention.

It is preferred that the regular-crystal silver halide grains be monodisperse and that the variation coefficient of equivalent sphere diameter be 20% or below. The terminology "variation coefficient of equivalent sphere diameter" used herein means the value obtained by dividing a standard deviation of equivalent sphere diameters of individual grains by an average equivalent sphere diameter and by multiplying the quotient by 100.

The crystal habit of regular-crystal silver halide grains according to the present invention may be any of cube, octahedron and tetradecahedron. The crystal habit can be controlled by regulating the pAg value at grain growth.

With respect to the regular-crystal silver halide grains according to the present invention, the intragranular halogen composition may be uniform, or the grains may have a core/shell structure. Further, the grains in the interior thereof may have dislocation lines. The average silver iodide content is preferably in the range of 0.1 to 10%, more preferably 1 to 5%.

The regular-crystal silver halide grains according to the present invention, although may be unsensitized, may be subjected to spectral sensitization or chemical sensitization. Spectral sensitization is preferred from the viewpoint that the aging stability upon mixing with tabular grains can be improved. When any spectral sensitization is not conducted, portion of the dye having been adsorbed on tabular grains after mixing with tabular grains is likely to move into regular-crystal silver halide grains, so that a change of aging performance is likely to occur. From the viewpoint of suppressing the aging change, it is preferred that the type of spectral sensitizing dye added to regular-crystal silver halide grains be identical with that of spectral sensitizing dye added to tabular grains to be mixed therewith. For the process for preparing regular-crystal silver halide grains, reference can be made to, for example, JP-A's-5-165132, 6-317861 and 2001-133921.

With respect to the method of spectral sensitization and chemical sensitization for regular-crystal grains, reference can be made to the following description on tabular silver halide grains. Although the method of mixing regular-crystal grains with tabular grains is not particularly limited, it is preferred from the viewpoint of minimizing the aging change after mixing that emulsion mixing be immediately followed by addition of compounds to be incorporated in individual layers and further followed by coating operation.

In the present invention, the tabular silver halide grains refer to silver halide grains each having two opposed parallel (111) main surfaces. The tabular silver halide grains of the present invention each have one twin plane, or two or more mutually parallel twin planes. The twin plane refers to a (111) face on both sides of which the ions of all the lattice points are in the relationship of reflected images. The tabular silver halide grains, when viewed in the direction perpendicular to main surfaces, have the shape of a triangle, a hexagon or an intermediate truncated triangle. Each thereof has mutually parallel external surfaces.

The equivalent circle diameter and thickness of tabular silver halide grains can be determined by taking of a transmission electron micrograph according to the replica method. The equivalent circle diameter refers to the diameter of a circle having an area equal to the projected area of the parallel external surfaces of each individual grain. The grain thickness is calculated from the length of the shadow of the replica photograph. The aspect ratio of tabular silver halide grains refers to the ratio of equivalent circle diameter to grain thickness.

In the silver halide color photosensitive material of the present invention, any one of color-sensitive layers consisting of blue-sensitive silver halide emulsion layer, green-sensitive silver halide emulsion layer and red-sensitive silver halide emulsion layer has two or more silver halide emulsion layers, of which the layer with the highest photographic speed contains tabular silver halide grains of 8 or greater aspect ratio in a ratio of 70% or more based on the total projected area. For enhancing the photographic sensitivity of silver halide grains, it is preferred to increase the aspect ratio so as to effect adsorption of an increased amount of sensitizing dyes on the grain surface. The aspect ratio is preferably in the range of 8 to 40, more preferably 12 to 30. The equivalent circle diameter is preferably in the range of 0.6 to 5 μm. The grain thickness is preferably in the range of 0.05 to 0.3 μm, more preferably 0.05 to 0.2 μm.

In the present invention, It is preferable that tabular silver halide grains have dislocation lines. Dislocation lines in tabular silver halide grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

70% or more of the total projected area of all the silver halide grains contained in the silver halide emulsion of the present invention are occupied by tabular silver halide grains having dislocation lines of preferably 10 or more, more preferably 20 or more, and most preferably 30 or more. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular silver halide grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular silver halide grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular silver halide grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

The introduction of dislocation lines in tabular silver halide grains can be accomplished by creating a specified high silver iodide phase in the grain interior. The internal high silver iodide phase can be formed by addition of an aqueous solution of halide salts containing iodide salts, or by addition of fine-grain silver iodide or fine-grain silver iodobromide or fine-grain silver chloroiodide or fine-grain silver chloroiodobromide. Further, there can be mentioned the method of adding an iodide ion release agent as described in JP-A-6-11782, which can preferably be used.

In the chemical sensitization of silver halide grains, intergranular nonuniformity with respect to size, etc. would cause optimum sensitization of grains to be difficult and consequently would result in drop of photographic sensitivity. From this viewpoint, it is preferred that the equivalent circle diameter and thickness of tabular silver halide grains according to the present invention be monodisperse. With respect to the silver halide grains of the present invention, the variation coefficient of equivalent circle diameters of all the grains is preferably 40% or below, more preferably 30% or below, and still more preferably 20% or below. The variation coefficient of thicknesses of all the grains is preferably 20% or below. The terminology "variation coefficient of equivalent circle diameter" used herein means the value obtained by dividing a standard deviation of equivalent circle diameters of individual grains by an average equivalent circle diameter and by multiplying the quotient by 100. The variation coefficient of thickness refers to the value obtained by dividing a standard deviation of thicknesses of individual grains by an average thickness and by multiplying the quotient by 100.

The twin plane spacing of tabular silver halide grains is preferably 0.14 μm or less, more preferably 0.012 μm or less. The variation coefficient of twin plane spacing is preferably 40% or below, more preferably 30% or below.

The tabular silver halide grains used in the present invention are formed through the steps of nucleation, Ostwald ripening and growth. Although all of these steps are important for suppressing the spread of grain size distribution, attention should be paid so as to avoid the spread of size distribution at the first nucleation step because the spread of size distribution brought about in the above steps cannot be narrowed by an ensuing step. What is important in the nucleation step is the relationship between the temperature of reaction mixture and the period of time of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60 or below.

Supplemental addition of gelatin may be effected during the grain formation in order to obtain monodisperse tabular silver halide grains of thin grain thickness. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably immediately after the nucleation. The addition amount thereof is preferably 60% or greater, more preferably 80% or greater, and most preferably 90% or greater, based on the total mass of dispersion medium used in grain formation.

The variation coefficient of intergranular silver iodide content distribution with respect to the silver halide grains for use in the present invention is preferably 20% or below, more preferably 15% or below and most preferably 10% or below. When the variation coefficient of intergranular silver iodide content distribution of silver halide grains is higher than 20%, the photographic performance of photo-sensitive material containing such silver halide grains cannot be hard gradation, and the sensitivity drop upon pressure application becomes unfavorably intense.

In the production of silver halide grains with narrow intergranular silver iodide content distribution for use in the present invention, use can be made of any of known processes, for example, the process of adding fine grains as described in JP-A-1-183417, or the process of adding an iodide ion release agent as described in JP-A-2-68538, or a combination thereof.

The silver iodide content of each grain can be measured by analyzing the composition of the grain by using an X-ray microanalyzer. The variation coefficient of an inter-grain silver iodide distribution is a value defined by (standard deviation/average silver iodide content)×100=variation coefficient (%)

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The silver halogen composition structure of a grain used in the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

Silver halide emulsions of the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

A metal complex may be mixed into the silver halide emulsions of the present invention during grain formation, or after grain formation but prior to or during chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

Silver halide emulsions of the present invention are preferably subjected to selenium sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., Jpn. Pat. Appln. KOKOKU Publication No. (hereinafter referred to as JP-B-) 44-15748 and JP-B-43-13489, and JP-A's-4-25832 and 4-109240, the disclosures of which are incorporated herein by reference. The non-labile selenium sensitizer refers to the sensitizer which causes the amount of silver selenide formed upon the addition of non-labile selenium sensitizer only without the use of any nucleophilic agent to be 30% or less based on the amount of added non-labile selenium sensitizer. As the non-labile selenium sensitizer, there can be mentioned compounds described in, for example, JP-B's-46-4553, 52-34492 and 52-34491. When the non-labile selenium sensitizer is used, it is preferred to simultaneously use a nucleophilic agent. As the nucleophilic agent, there can be mentioned compounds described in, for example, JP-A-9-15776.

Selenium sensitization can be achieved more effectively in the presence of a silver halide solvent.

Examples of a silver halide solvent usable in the present invention are (a) organic thioethers described in U.S. Pat. Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization.

This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization described above. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

The addition of sensitizing dye to emulsions may be performed at any stage of emulsion preparation which is known as being useful. Although the addition of spectral sensitizing dye is most usually conducted at a stage after the completion of the chemical sensitization but prior to the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, as described in JP-A-58-113928, the spectral sensitization can be conducted prior to the chemical sensitization and, also, the spectral sensitizing dye can be added prior to the completion of silver halide grain precipitation formation to thereby initiate the spectral sensitization. Further, the above sensitizing dye compound can be divided prior to addition, that is, part of the sensitizing dye compound can be added prior to the chemical sensitization with the rest of the sensitizing dye compound added after the chemical sensitization as taught in U.S. Pat. No. 4,225,666. The addition of spectral sensitizing dye can be effected at any stage during the formation of silver halide grains according to the method disclosed in U.S. Pat. No. 4,183,756 and other methods.

The sensitizing dye can be used in an amount of $4\times10^{-6}$ to $8\times10^{-3}$ mol per mol of silver halides. When the average grain size in the silver halide emulsion is in the range of 0.2 to 1.2 μm in terms of equivalent sphere diameter, the effective amount is in the range of about $5\times10^{-5}$ to $2\times10^{-3}$ mol per mol of silver halides.

The present invention is preferably combined with a technique of increasing a light absorption factor by the addition of a spectral sensitizing dye. For example, there can be mentioned adsorption of a sensitizing dye amounting to more than monolayer saturated coating amount onto the surface of silver halide grains by means of intermolecular force, or adsorption on silver halide grains of a so-called linked dye comprising two or more separate nonconjugated dye chromophores linked with each other by covalent bonds. These are described in, for example, the following patent publications.

JP-A's-10-239789, 11-133531, 2000-267216, 2000-275772, 2001-75222, 2001-75247, 2001-75221, 2001-75226, 2001-75223, 2001-255615, 2002-23294, 2002-148767, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-350442, and EP's 985965A, 985964A, 985966A, 985967A, 1085372A, 1085373A, 1172688A, 1199595A and 887700A1.

Moreover, the present invention is preferably used in combination with techniques described in JP-A's-10-239789, 2001-75222 and 10-171058.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure silver bromide emulsion. The size of this silver iodobromide emulsion is not limited as long as the emulsion can be completely dissolved. However, the equivalent-sphere diameter is preferably 0.1 μm or less, and more preferably, 0.05 μm or less. Although the addition amount of the silver iodobromide emulsion changes in accordance with a host grain used, the amount is basically preferably 0.005 to 5 mol %, and more preferably, 0.1 to 1 mol % per mol of silver.

In order to upgrade the color reproduction, a donor layer (CL) of interlayer effect having a spectral sensitivity distribution different from those of main photo-sensitive layers BL, GL and RL as described in U.S. Pat. Nos. 4,663,271, 4,705,744 and 4,707,436 and JP-A's-62-160448 and 63-89850 is preferably arranged adjacent to or close to the main photosensitive layers.

The compound (A) is a compound capable of increasing the photographic sensitivity. However, it has been found that a striking sensitivity increase can be exerted in the color photosensitive material of the present invention, namely, when regular-crystal silver halide grains and tabular grains of 8 or higher aspect ratio are contained. This is an unexpected finding. Although the cause has not been elucidated, the compound (A) can really favorably be used in the silver halide color photosensitive material of the present invention.

Compound (A): A heterocyclic compound having one or more heteroatoms, which heterocyclic compound is capable of substantially increasing the sensitivity of silver halide color photosensitive material by addition thereof as compared with that exhibited when the compound is not added.

The compound (A) will be described in detail below.

With respect to the compound (A), when any specified moiety is referred to as "group", it is meant that the moiety per se may be unsubstituted or have one or more (up to possible largest number) substituents. For example, the "alkyl group" refers to a substituted or unsubstituted alkyl group. The substituents which can be employed in the compound (A) are not limited irrespective of the existence of substitution.

When these substituents are referred to as W, the substituents represented by W are not particularly limited. As such, there can be mentioned, for example, halogen atoms, alkyl groups (including a cycloalkyl group, a bicycloalkyl group and a tricycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including alkylamino groups, arylamino groups and heterocyclic amino groups), an ammonio group, acylamino groups, an aminocarbonylamino group, alkoxycarbonylamino groups, aryloxycarbonylamino groups, a sulfamoylamino group, alkyl- or arylsulfonylamino group, a mercapto group, alkylthio groups, arylthio groups, heterocyclic thio groups, a sulfamoyl group, a sulfo group, alkyl- or arylsulfinyl groups, alkyl- or arylsulfonyl groups, acyl groups, aryloxycarbonyl groups, alkoxycarbonyl groups, a carbamoyl group, aryl- or heterocyclic azo groups, an imido group, a phosphino group, a phosphinyl group, a phosphinyloxy group, a phosphinylamino group, a phosphono group, a silyl group, a hydrazino group, a ureido group, a borate group ($—B(OH)_2$), a phosphate group ($—OPO(OH)_2$), a sulfato group ($—OSO_3H$) and other common substituents.

More specifically, W can represent any of halogen atoms (e.g., a fluorine atom, a chlorine atom, a bromine atom and an iodine atom); alkyl groups [each being a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) means the alkyl group of this concept, which however further includes an alkenyl group and an alkynyl group]; alkenyl groups [each being a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; alkynyl groups (preferably a substituted or unsubstituted alkynyl group having 2 to 30 carbon atoms, such as ethynyl, propargyl or trimethylsilylethynyl); aryl groups (preferably a substituted or unsubstituted aryl group having 6 to 30 carbon atoms, such as phenyl, p-tolyl, naphthyl, m-chlorophenyl or o-hexadecanoylaminophenyl); heterocyclic groups (preferably a monovalent group corresponding to a 5- or 6-membered substituted or unsubstituted aromatic or nonaromatic heterocyclic compound from which one hydrogen atom is removed (the monovalent group may be condensed with a benzene ring, etc.), more preferably a 5- or 6-membered aromatic heterocyclic group having 3 to 30 carbon atoms, such as 2-furyl, 2-thienyl, 2-pyrimidinyl or 2-benzothiazolyl (the heterocyclic group may be a cationic heterocyclic group such as 1-methyl-2-pyridinio or 1-methyl-2-quinolinio)); a cyano group; a hydroxyl group; a nitro group; a carboxyl group; alkoxy groups (preferably a substituted or unsubstituted alkoxy group having 1 to 30 carbon atoms, such as methoxy, ethoxy, isopropoxy, t-butoxy, n-octyloxy or 2-methoxyethoxy); aryloxy groups (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); silyloxy groups (preferably a silyloxy group having 3 to 20 carbon atoms, such as trimethylsilyloxy or t-butyldimethylsilyloxy); heterocyclic oxy groups (preferably a substituted or unsubstituted heterocyclic oxy group having 2 to 30 carbon atoms, such as 1-phenyltetrazol-5-oxy or 2-tetrahydropyranyloxy); acyloxy groups (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); carbamoyloxy groups (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); alkoxycarbonyloxy groups (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); aryloxycarbonyloxy groups (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); amino groups (preferably an amino group, a substituted or unsubstituted alkylamino group having 1 to 30 carbon atoms or a substituted or unsubstituted arylamino group having 6 to 30 carbon atoms, such as amino, methylamino, dimethylamino, anilino, N-methylanilino or diphenylamino); ammonio groups (preferably an ammonio group or an ammonio group substituted with a substituted or unsubstituted alkyl, aryl or heterocycle having 1 to 30 carbon atoms, such as trimethylammonio, triethylammonio or diphenylmethylammonio), acylamino groups (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); aminocarbonylamino groups (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); alkoxycarbonylamino groups (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); aryloxycarbonylamino groups (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); sulfamoylamino groups (preferably a substituted or unsubstituted sulfamoylamino group having 0 to 30 carbon atoms, such as sulfamoylamino, N,N-dimethylaminosulfonylamino or N-n-octylaminosulfonylamino); alkyl- or arylsulfonylamino groups (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; alkylthio groups (preferably a substituted or unsubstituted alkylthio group having 1 to 30 carbon atoms, such as methylthio, ethylthio or n-hexadecylthio); arylthio groups (preferably a substituted or unsubstituted arylthio group having 6 to 30 carbon atoms, such as phenylthio, p-chlorophenylthio or m-methoxyphenylthio); heterocyclic thio groups (preferably a substituted or unsubstituted heterocyclic thio group having 2 to 30 carbon atoms, such as 2-benzothiazolylthio or 1-phenyltetrazol-5-ylthio); sulfamoyl groups (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; alkyl- or arylsulfinyl groups (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); alkyl- or arylsulfonyl groups (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); acyl groups (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein carbonyl is bonded with carbon atom thereof, such as acetyl, pivaloyl, 2-chloroacetyl, stearoyl, benzoyl, p-n-octyloxyphenylcarbonyl, 2-pyridylcarbonyl or 2-furylcarbonyl); aryloxycarbonyl groups (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); alkoxycarbonyl groups (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); carbamoyl groups (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); aryl- or heterocyclic azo groups (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); imido groups (preferably N-succinimido or N-phthalimido); phosphino groups (preferably a substituted or unsubstituted phosphino group having 2 to 30 carbon atoms, such as dimethylphosphino, diphenylphosphino or methylphenoxyphosphino); phosphinyl groups (preferably a substituted or unsubstituted phosphinyl group having 2 to 30 carbon atoms, such as phosphinyl, dioctyloxyphosphinyl or diethoxyphosphinyl); phosphinyloxy groups (preferably a substituted or unsubstituted phosphinyloxy group having 2 to 30 carbon atoms, such as diphenoxyphosphinyloxy or dioctyloxyphosphinyloxy); phosphinylamino groups (preferably a substituted or unsubstituted phosphinylamino group having 2 to 30 carbon atoms, such as dimethoxyphosphinylamino or dimethylaminophosphinylamino); a phospho group; silyl groups (preferably a substituted or unsubstituted silyl group having 3 to 30 carbon atoms, such as trimethylsilyl, t-butyldimethylsilyl or phenyldimethylsilyl); hydrazino groups (preferably a substituted or unsubstituted hydrazino group having 0 to 30 carbon atoms, such as trimethylhydrazino); and ureido groups (preferably a substituted or unsubstituted ureido group having 0 to 30 carbon atoms, such as N,N-dimethylureido).

Two W's can cooperate with each other to thereby form a ring (any of aromatic or nonaromatic hydrocarbon rings and heterocycles (these can be combined into polycyclic condensed rings), for example, a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathine ring, a phenothiazine ring or a phenazine ring).

With respect to those having hydrogen atoms among the above substituents W, the hydrogen atoms may be replaced with the above substituents. Examples of such hydrogen having substituents include a —$CONHSO_2$— group (sulfonylcarbamoyl or carbonylsulfamoyl), a —CONHCO— group (carbonylcarbamoyl) and a —$SO_2NHSO_2$— group (sulfonylsulfamoyl).

More specifically, examples of such hydrogen having substituents include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

Heterocyclic compounds having at least one heteroatom for use in the present invention will be described below. Compounds which can preferably be employed in the present invention are those not reactive with developing agent oxidation products with respect to heterocyclic compounds having one or two heteroatoms, and are those reactive with developing agent oxidation products with respect to heterocyclic compounds having three or more heteroatoms. These will be described below.

First, the heterocyclic compounds having one or two heteroatoms for use in the present invention will be described. Heteroatom refers to atoms other than carbon and hydrogen atoms. Heterocycle refers to a cyclic compound having at least one heteroatom. The heteroatom of the "heterocycle having one or two heteroatoms" refers to only atoms as constituents of a heterocyclic ring system, and does not mean atoms positioned outside the ring system and atoms as parts of further substituents of the ring system.

With respect to polynuclear heterocycles, only those wherein the number of heteroatoms in all the ring systems is 1 or 2 are included. For example, 1,3,4,6-tetrazaindene is not included therein because the number of heteroatoms is 4.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom, an oxygen atom or a selenium atom. Further more preferably, the heteroatom is a nitrogen atom, a sulfur atom or an oxygen atom. Most preferably, the heteroatom is a nitrogen atom or a sulfur atom.

Although the number of members of heterocycles is not limited, a 3- to 8-membered ring is preferred. A 5- to 7-membered ring is more preferred. A 5- or 6-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and nonaromatic heterocycles, aromatic and pseudo-aromatic heterocycles are preferred.

Examples of these heterocycles include a pyrrole ring, a thiophene ring, a furan ring, an imidazole ring, a pyrazole ring, a thiazole ring, an isothiazole ring, an oxazole ring, an isooxazole ring, a pyridine ring, a pyrazine ring, a pyrimidine ring, a pyridazine ring and an indolizine ring; resulting from benzo ring condensation thereof, an indole ring, a benzofuran ring, a benzothiophene ring, an isobenzofuran ring, a quinolizine ring, a quinoline ring, a phthalazine ring, a quinoxaline ring, an isoquinoline ring, a carbazole ring, a phenanthridine ring, a phenanthroline ring and an acridine ring; and resulting from partial or complete saturation thereof, a pyrrolidine ring, a pyrroline ring and an imidazoline ring.

Representative examples of heterocycles will be shown below.
(aa-1)
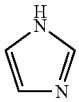
(aa-2)
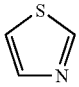
(aa-3)
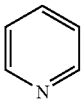
(aa-4)
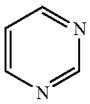
(aa-5)
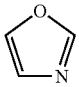
(aa-6)
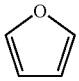
(aa-7)
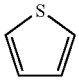
(aa-8)
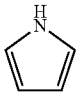
(aa-9)
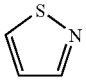
(aa-10)
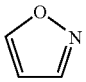
(aa-11)
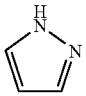
(aa-12)
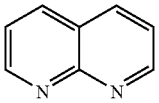
(aa-13)
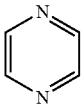
(aa-14)
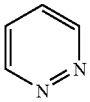
-continued
(aa-15)
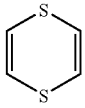
(aa-16)
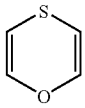
(aa-17)
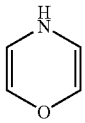
(aa-18)
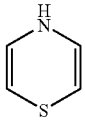
As the heterocycles resulting from benzene ring condensation, for example, the following can be shown.
(b-1)
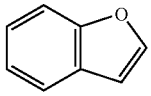
(ab-2)
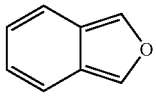
(ab-3)
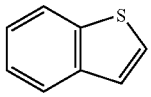
(ab-4)
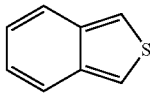
(ab-5)
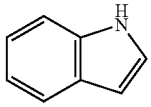
(ab-6)
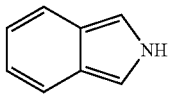
(ab-7)
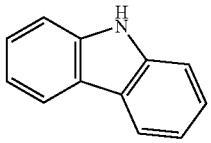
(ab-8)
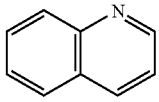

-continued
(ab-9)
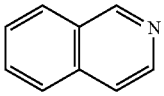
(ab-10)
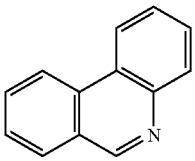
(ab-11)
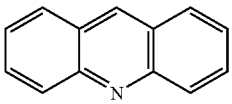
(ab-12)
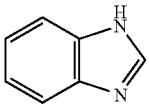
(ab-13)
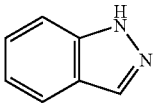
As the heterocycles resulting from partial or complete saturation, for example, the following can be shown.
(ac-1)
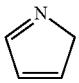
(ac-2)
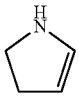
(ac-3)
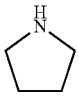
(ac-4)
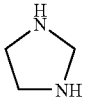
(ac-5)
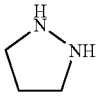
(ac-6)
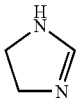
(ac-7)
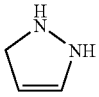
(ac-8)
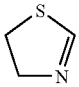
-continued
(ac-9)
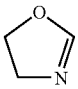
(ac-10)
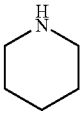
(ac-11)
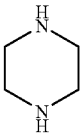
(ac-12)
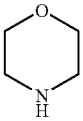
(ac-13)
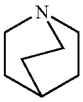
(ac-14)
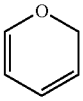
(ac-15)
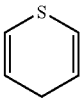
(ac-16)
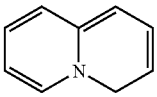
(ac-17)
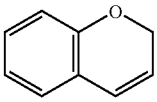
(ac-18)
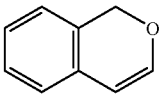
(ac-19)
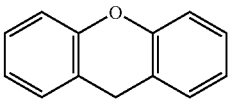
Furthermore, the following heterocycles can be used.
(ad-1)
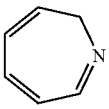
(ad-2)
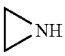

-continued (ad-3)

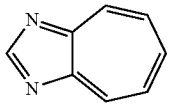

(ad-4)

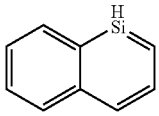

(ad-5)

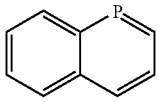

(ad-6)

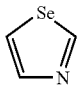

(ad-7)

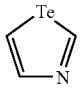

(ad-8)

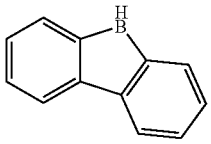

These heterocycles, unless contrary to the definition of "heterocycle having one or two heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles having one or two heteroatoms, it is preferred that free thiol (—SH) and thiocarbonyl (>C═S) be in unsubstituted form.

Among the heterocycles, heterocycles (aa-1) to (aa-4) are preferred. With respect to heterocycles (aa-2), heterocycle with benzene ring condensed thereto (ab-25) is more preferred.

Although the heterocyclic compounds having one or two heteroatoms may react or may not react with oxidizing developing agents, preferred use can be made of heterocyclic compounds which do not react with oxidizing developing agents.

That is, heterocyclic compounds which induce no marked (less than 5 to 10%) direct chemical reaction or redox reaction with oxidizing developing agents are preferred. Further, those which are not couplers, being incapable of reacting with oxidizing developing agents to form dyes or other products are preferred.

The reactivity (CRV) of compounds of the present invention with oxidizing developing agents is determined in the following manner.

Test sensitive material (A) was exposed to white light and processed in the same manner as described in Example 1 except that the processing time in color development step was changed to 1 min 30 sec. The magenta density and cyan density of the sensitive material were measured, and the respective differences from the magenta density and cyan density of sensitive material containing none of compounds of the present invention were calculated.

Test Sensitive Material (A)

(Support) Cellulose Triacetate

| (Emulsion layer) | | |
|---|---|---|
| Em-A | in terms of Ag | 1.07 g/m$^2$ |
| Gelatin | | 2.33 g/m$^2$ |
| ExC-1 | | 0.76 g/m$^2$ |
| ExC-4 | | 0.42 g/m$^2$ |
| Tricresyl phosphate | | 0.62 g/m$^2$ |
| Compound of invention | | $3.9 \times 10^{-4}$ mol/m$^2$ |

| (Protective layer) | |
|---|---|
| Gelatin | 2.00 g/m$^2$ |
| H-1 | 0.33 g/m$^2$ |
| B-1 (diam. 1.7 μm) | 0.10 g/m$^2$ |
| B-2 (diam. 1.7 μm) | 0.30 g/m$^2$ |
| B-3 | 0.10 g/m$^2$ |

The characteristics of emulsion Em-A and structural formulae of compounds employed in the above test sensitive material (A) were specified in Example 1 described later.

Among the heterocyclic compounds having one or two heteroatoms, those of the following general formula (I) are more preferred.

General formula (I)

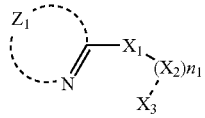

In the general formula (I), $Z_1$ represents a group for forming a heterocycle having one or two heteroatoms including the nitrogen atom of the formula. $X_1$ represents a sulfur atom, an oxygen atom, a nitrogen atom (N(Va)) or a carbon atom (C(Vb)(Vc)). Each of Va, Vb and Vc represents a hydrogen atom or a substituent. $X_2$ has the same meaning as that of $X_1$. $n_1$ is 0, 1, 2 or 3. When $n_1$ is 2 or greater, $X_2$ becomes multiple. It is not necessary for the multiple groups to be identical with each other. $X_3$ represents a sulfur atom, an oxygen atom or a nitrogen atom. The bond between $X_2$ and $X_3$ is single or double. Accordingly, $X_3$ may further have a substituent or a charge.

Among the heterocyclic compounds having one or two heteroatoms, those of the following general formula (II) are most preferred.

General formula (II)

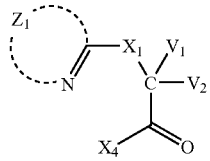

In the general formula (II), $Z_1$ and $X_1$ are as defined in the general formula (I). $X_4$ represents a sulfur atom (S(Vd)), an oxygen atom (O(Ve)) or a nitrogen atom (N(Vf)(Vg)). Each of Vd, Ve, Vf and Vg represents a hydrogen atom, a substituent or a negative charge. Each of $V_1$ and $V_2$ represents a hydrogen atom or a substituent.

The general formula (I) and general formula (II) will be described in detail below.

As the heterocycles formed by $Z_1$, there can preferably be mentioned those set forth above with respect to (aa-1) to (aa-18), (ab-1) to (ab-29), (ac-1) to (ac-19) and (ad-1) to (ad-8), and preferred examples thereof are also the same. These heterocycles, unless contrary to the definition of "heterocycle having one or two heteroatoms", may further have any substituents (for example, aforementioned W) or may be in the form of any condensed ring.

$X_1$ preferably represents a sulfur atom, an oxygen atom or a nitrogen atom, more preferably a sulfur atom or a nitrogen atom, and most preferably a sulfur atom.

As the substituent represented by Va, Vb and Vc, there can be mentioned the aforementioned W, and preferred substituents are an alkyl group, an aryl group and a heterocyclic group. $X_2$ preferably represents a carbon atom. $n_1$ is preferably 0, 1 or 2, more preferably 2. $X_3$ preferably represents an oxygen atom. The valence of $X_3$ changes depending on whether the bond between $X_2$ and $X_3$ is single or double. For example, when the bond between $X_2$ and $X_3$ is double and $X_3$ is an oxygen atom, $X_3$ represents a carbonyl group. On the other hand, when the bond between $X_2$ and $X_3$ is single and $X_3$ is an oxygen atom, $X_3$ represents, for example, a hydroxyl group, an alkoxy group, an oxygen atom having a negative charge or the like.

$X_4$ preferably represents an oxygen atom. As the substituents represented by Vd, Ve, Vf and Vg, there can be mentioned those aforementioned as being represented by W. Vd, Ve and at least one of Vf and Vg preferably represent hydrogen atoms and negative charges. As the substituent represented by $V_1$ and $V_2$, there can be mentioned the aforementioned W. At least one of $V_1$ and $V_2$ is preferably not a hydrogen atom, representing a substituent.

As the substituents, there can preferably be mentioned, for example, a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed above as being represented by W); and an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The sum of carbon atoms of each of these substituents, although not particularly limited, is preferably in the range of 8 to 60, more preferably 10 to 57, still more preferably 12 to 55, and most preferably 16 to 53.

The compounds represented by the general formula (I) and general formula (II) are preferably those suitable for the following immobilization methods (1) to (7), more preferably immobilization method (1), (2) or (3), still more preferably immobilization method (1) or (2), and most preferably immobilization methods (1) and (2) simultaneously employed. That is, compounds simultaneously having specified pKa and ballasting group can most preferably be employed.

The compounds of the present invention can contain, when required for neutralizing the charge thereof, a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions-such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

In the present invention, it is preferred to use combinations of individual preferred compounds (especially combinations of individual most preferred compounds) mentioned above.

Among the heterocyclic compounds each having one or two heteroatoms according to the present invention, specified in the description of Best Mode for Carrying Out the Invention, especially preferred specific examples will be shown below, which however in no way limit the scope of the invention.

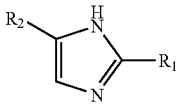

(a-1):$R_1$, $R_2$ = H
(a-2):$R_1$ = $CH_3$, $R_2$ = H
(a-3):$R_1$ = n-$C_3H_7$, $R_2$ = H
(a-4):$R_1$ = $SCH_3$, $R_2$ = H
(a-5):$R_1$ = H, $R_2$ = $CH_3$
(a-6):$R_1$ = H, $R_2$ = $CH_2CH_2NH_2$
(a-7):$R_1$ = H, $R_2$ = $CH_2CH(NH_2)(CO_2H)$ (a-8)

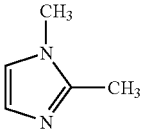

(a-9)

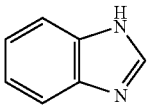

(a-10)

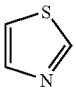

(a-11)

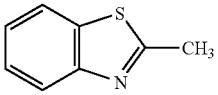

(a-12)

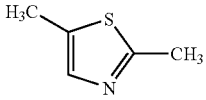

(a-13)

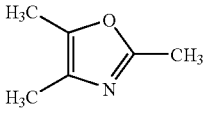

(a-14)

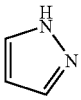

(a-15)

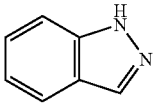

(a-16)

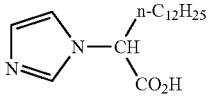

-continued (a-17)

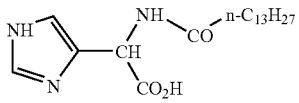

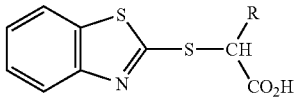

(a-18):R = n-$C_{12}H_{25}$
(a-19):R = n-$C_{16}H_{33}$ (a-20)

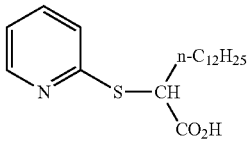

(a-21)

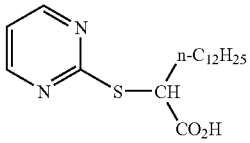

With respect to the heterocyclic compounds each having one or two heteroatoms according to the present invention, although as aforementioned those not reactive with developing agent oxidation products are preferred, those reactive with developing agent oxidation products include compounds of the following general formulae.

(III-1)

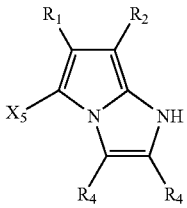

(III-2)

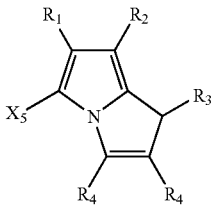

(III-3)

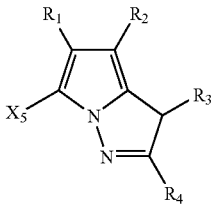

-continued (III-4)

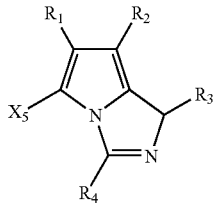

In the general formulae (III-1) to (III-4), each of $R_1$, $R_2$ and $R_3$ independently represents electron withdrawing groups whose Hammett substituent constant σp value is in the range of 0.2 to 1.0. $R_4$ represents a hydrogen atom or a substituent, provided that when there are two $R_4$'s in the formula, they may be identical with or different from each other. $X_5$ represents a hydrogen atom or a substituent. The groups represented by $R_1$, $R_2$, $R_3$, $R_4$ and $X_5$ are the same as those represented by $R_{11}$, $R_{12}$, $R_{13}$, $R_{14}$ and $X_{11}$ described later, respectively, and those preferred are also the same.

Among the heterocyclic compounds each having one or two heteroatoms which react with developing agent oxidation products, especially preferred specific examples will be shown below, which however naturally in no way limit the scope of the invention.

(a-22)

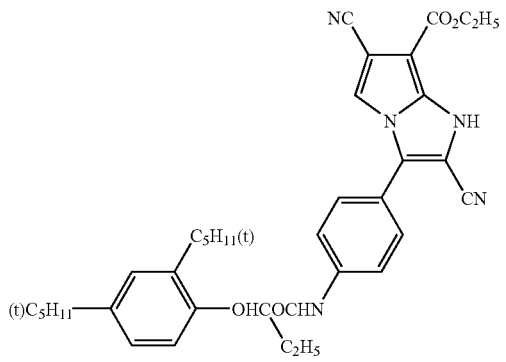

(a-23)

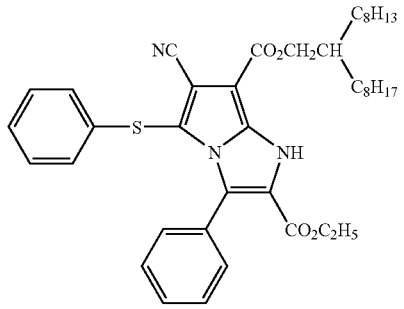

-continued (a-24)

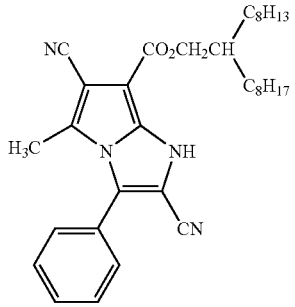

(a-25)

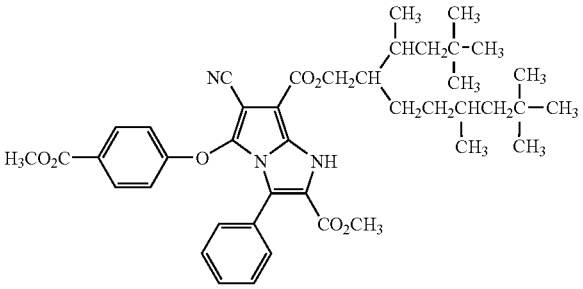

(a-26)

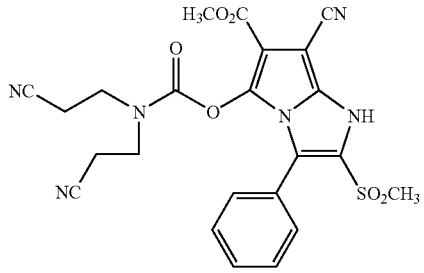

(a-27)

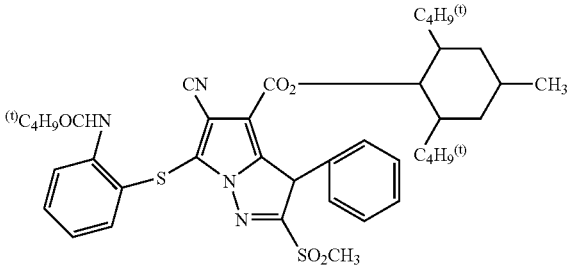

(a-28)

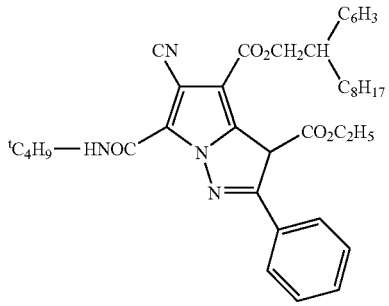

As the heterocyclic compounds each having one or two heteroatoms, use can be made of those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The heterocyclic compounds each having one or two heteroatoms can be synthesized by the processes described therein.

Synthetic Example: Synthesis of Compound (a-18)

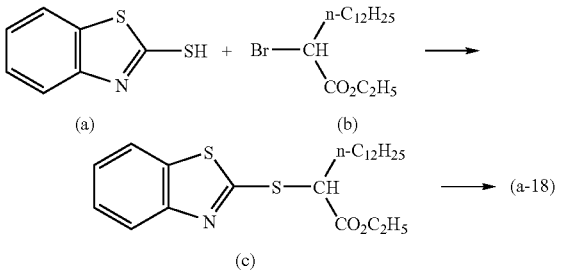

A mixture of 7.4 g of compound (a), 13.4 g of compound (b), 100 milliliters (hereinafter, milliliter also referred to as "mL") and 10 mL of dimethylacetamide was agitated at an internal temperature of 10 or below while cooling with ice, and then 6.1 mL of triethylamine was dropped into the mixture.

Further, the resulting mixture was agitated at room temperature for 2 hr. Thereafter, 200 mL of ethyl acetate was added to the reaction solution. Washing with a dilute aqueous NaOH solution and fractionation, washing with a dilute hydrochloric acid and fractionation and washing with a saturated saline solution and fractionation were sequentially performed, and the obtained ethyl acetate layer was dried over magnesium sulfate. Solvent was evaporated in vacuum, and the concentrate was purified through silica gel column chromatography (eluant: 19:1 hexane and ethyl acetate), thereby obtaining 16.2 g of compound (c) (yield 96%). A mixture of 14.8 g of compound (c), 2.8 g of NaOH, 50 mL of ethanol and 5 mL of water was agitated at room temperature for 2 hr, and 200 mL of water was added thereto. The mixture was washed with hexane and fractionated, and the hexane layer was removed. 200 mL of ethyl acetate together with dilute hydrochloric acid was added to the water layer and fractionated, and the water layer was removed. Further, the mixture was washed with a saturated saline solution and fractionated. The ethyl acetate layer was dried over magnesium sulfate and concentrated in vacuum until the amount of solvent became 30 mL. Hexane was added to the concentrate, and agitated. Precipitated crystal was collected by suction filtration and dried. Thus, 13.2 g of colorless crystal (a-18) (melting point 75 to 77° C.) was obtained (yield 96%).

The heterocyclic compounds each having three or more heteroatoms for use in the present invention will now be described. The heteroatom refers to an atom other than carbon and hydrogen atoms. The heterocycle refers to a cyclic compound having at least one heteroatom. In this aspect of the present invention, the heterocycle is a heterocyclic compound having three or more heteroatoms. The heteroatoms of the "heterocycle having three or more heteroatoms" refer to only atoms as constituents of a heterocyclic ring system, and do not mean atoms positioned outside the ring system, atoms separated through at least one nonconjugated single bond from the ring system and atoms as parts of further substituents of the ring system.

With respect to polynuclear heterocycles, only those wherein the number of heteroatoms in all the ring systems is 3 or more are included in the present invention. For example, with respect to 1H-pyrazolo[1,5-h][1,2,4]triazole, the number of heteroatoms is 4 and hence the compound is included in the heterocycles each having three or more heteroatoms according to the present invention. The number of heteroatoms, although there is no particular upper limit, is preferably 10 or less, more preferably 8 or less, still more preferably 6 or less, and most preferably 4 or less.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom or an oxygen atom. Still more preferably, the heteroatom is a nitrogen atom or a sulfur atom. Most preferably, the heteroatom is a nitrogen atom.

Although the number of members of heterocycles is not limited, a 3- to 8-membered ring is preferred. A 5- to 7-membered ring is more preferred. A 5- or 6-membered ring is still more preferred. A 5-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and non-aromatic heterocycles, aromatic and pseudo-aromatic heterocycles are preferred.

The heterocycle is preferably a polynuclear heterocycle resulting from ring condensation, most preferably a heterocycle of two rings.

Although the heterocyclic compounds having three or more heteroatoms may react or may not react with oxidizing developing agents, preferred use can be made of heterocyclic compounds which react with oxidizing developing agents.

Compounds represented by the following general formula (M) or general formula (C) can most preferably be used as the heterocycle having three or more heteroatoms according to the present invention.

(M)

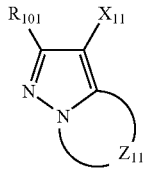

(C)

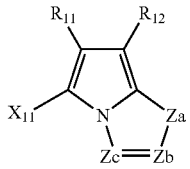

In the general formula (M), $R_{101}$ represents a hydrogen atom or a substituent. $Z_{11}$ represents a nonmetallic atom group required for forming a 5-membered azole ring containing 2 to 4 nitrogen atoms, which azole ring may have substituents (including a condensed ring). $X_{11}$ represents a hydrogen atom or a substituent.

In the general formula (C), Za represents —NH— or —CH($R_3$)—. Each of Zb and Zc independently represents —C($R_{14}$)═ or —N═, provided that when Za is —NH—, at least one of Zb and Zc is —N═ and that when Za is —CH($R_3$)—, both of Zb and Zc are —N═. Each of $R_{11}$, $R_{12}$ and $R_{13}$ independently represents electron withdrawing groups whose Hammett substituent constant up value is in the range of 0.2 to 1.0. $R_{14}$ represents a hydrogen atom or a substituent, provided that when there are two $R_{14}$'s in the formula, they may be identical with or different from each other. $X_{11}$ represents a hydrogen atom or a substituent.

These compounds will be described in detail below. Among the skeletons represented by the formula (M), those preferred are 1H-pyrazolo[1,5-b][1,2,4]triazole and 1H-pyrazolo[5,1-c][1,2,4]triazole, respectively represented by the formulae (M-1) and (M-2).

(M-1)

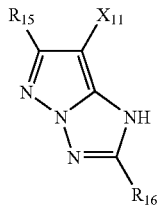

(M-2)

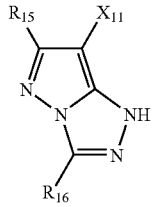

In the formulae, $R_{15}$ and $R_{16}$ represent substituents, and $X_{11}$ represents a hydrogen atom or a substituent.

The substituents $R_{15}$, $R_{16}$ and $X_{11}$ of the formulae (M-1) and (M-2) will be described in detail below.

As the substituent $R_{15}$, there can preferably be mentioned a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed below as being represented by $X_{11}$); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred as $R_{15}$. An alkyl group, an alkoxy group and an aryloxy group are more preferred. The most preferred substituent is a branched alkyl group.

It is preferred that $R_{16}$ represent substituents mentioned as being represented by $R_{12}$. More preferred substituents are an alkyl group, an aryl group, a heterocyclic group, an alkoxy group and an aryloxy group.

Still more preferred groups are an alkyl group and a substituted aryl group. The most preferred group is a substituted aryl group. The compounds of the general formulae (M-3) and (M-4) are preferred.

With respect to the substituents on the azole ring containing $R_{101}$, $X_{11}$ and $Z_{11}$ of the general formula (M), the sum of carbon atoms thereof, although not particularly limited, is preferably in the range of 13 to 60, more preferably 20 to 50 from the viewpoint that not only can the adsorption on emulsion grains be increased but also the sensitivity/graininess improving effect can be enhanced.

(M-3)

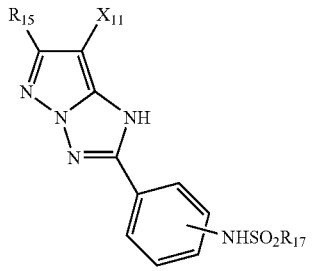

(M-4)

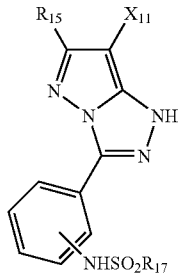

In the formulae, $R_{15}$ and $X_{11}$ are as defined in the general formulae (M-1) and (M-2). $R_{17}$ represents a substituent. As the substituents represented by $R_{17}$, there can preferably be mentioned those set forth above as examples of the $R_{15}$ substituents. As the $R_{17}$ substituents, there can more preferably be mentioned a substituted aryl group and a substituted or unsubstituted alkyl group. The substitution thereof is preferably accomplished by substituents mentioned above as examples of the $R_{15}$ substituents.

$X_{11}$ represents a hydrogen atom or a substituent. As the substituent, there can preferably be mentioned those set forth above as examples of the $R_{15}$ substituents. The substituent represented by $X_{11}$ is preferably an alkyl group, an alkoxycarbonyl group, a carbamoyl group or a group split off at the reaction with developing agent oxidation products. As this group, there can be mentioned, for example, a halogen atom (e.g., a fluorine atom, a chlorine atom or a bromine atom); an alkoxy group (e.g., ethoxy, methoxycarbonylmethoxy, carboxypropyloxy, methanesulfonylethoxy or perfluoropropoxy); an aryloxy group (e.g., 4-carboxyphenoxy, 4-(4-hydroxyphenylsulfonyl)phenoxy, 4-methanesulfonyl-3-carboxyphenoxy or 2-methanesulfonyl-4-acetylsulfamoylphenoxy); an acyloxy group (e.g., acetoxy or benzoyloxy); a sulfonyloxy group (e.g., methanesulfonyloxy or benzenesulfonyloxy); an acylamino group (e.g., heptafluorobutyrylamino); a sulfonamido group (e.g., methanesulfonamido); an alkoxycarbonyloxy group (e.g., ethoxycarbonyloxy); a carbamoyloxy group (e.g., diethylcarbamoyloxy, piperidinocarbonyloxy or morpholinocarbonyloxy); an alkylthio group (e.g., 2-carboxyethylthio); an arylthio group (e.g., 2-octyloxy-5-t-octylphenylthio or 2-(2,4-di-t-amylphenoxy)butyrylaminophenylthio); a heterocyclic thio group (e.g., 1-phenyltetrazolylthio or 2-benzimidazolylthio); a heterocyclic oxy group (e.g., 2-pyridyloxy or 5-nitro-2-pyridyloxy); a 5- or 6-membered nitrogenous heterocyclic group (e.g., 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dion-3-yl or purine); or an azo group (e.g., 4-methoxyphenylazo or 4-pivaloylaminophenylazo).

The substituent represented by $X_{11}$ is preferably an alkyl group, an alkoxycarbonyl group, a carbamoyl group, a halogen atom, an alkoxy group, an aryloxy group, an alkyl- or arylthio group or a 5- or 6-membered nitrogenous heterocyclic group capable of bonding at a nitrogen atom with coupling activity. The substituent is more preferably an alkyl group, a carbamoyl group, a halogen atom, a substituted aryloxy group, a substituted arylthio group, an alkylthio group or a 1-pyrazolyl group.

The compounds of the above general formulae (M-1) and (M-2) preferably employed in the present invention may form a dimer or further polymer through $R_{11}$ or $R_{12}$, and may be bonded with a polymer chain. In the present invention, the general formula (M–1) is preferred, and the general formula (M-3) is more preferred.

Now, the general formula (C) will be described. The general formula (C) of the present invention can more specifically be any of the following general formulae (bc-3) to (bc-6).

(bc-3)

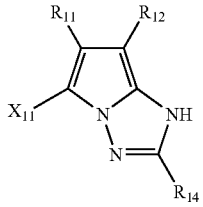

(bc-4)

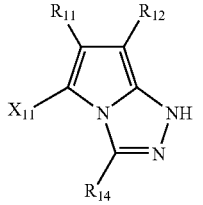

(bc-5)

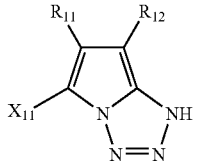

(bc-6)

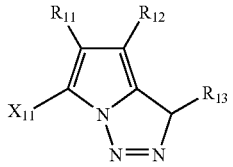

In the formulae, $R_{11}$ to $R_{14}$ and $X_{11}$ are as defined in the general formula (C).

In the present invention, the compounds of the general formulae (bc-3) and (bc-4) are preferred.

The compounds of the general formula (bc-3) are more preferred.

In the general formula (C), the substituent represented by $R_{11}$, $R_{12}$ or $R_{13}$ is an electron withdrawing group whose Hammett substituent constant σp value is in the range of 0.20 to 1.0. Preferably, the up value is in the range of 0.2 to 0.8. Hammett's rule is a rule of thumb advocated by L. P.

Hammett in 1935 for quantitatively considering the effect of substituents on the reaction or equilibrium of benzene derivatives, and the appropriateness thereof is now widely recognized. The substituent constant determined in the Hammett's rule involves σp value and σm value. These values can be found in a multiplicity of general publications, and are detailed in, for example, "Lange's Handbook of Chemistry" 12th edition by J. A. Dean, 1979 (Mc Graw-Hill), "Kagaku no Ryoiki" special issue, no. 122, p.p. 96 to 103, 1979 (Nankodo), and Chemical Review, vol. 91, pp. 165–195, 1991.

Although in the present invention, the substituents $R_{11}$, $R_{12}$ and $R_{13}$ are limited by the Hammett substituent constant values, this should not be construed as limitation to only substituents whose values are known from literature and can be found in the above publications, and should naturally be construed as including substituents whose values, even if unknown from literature, would be included in stated ranges when measured according to the Hammett's rule.

Examples of the electron withdrawing groups whose σp values are in the range of 0.2 to 1.0 include an acyl group, an alkoxycarbonyl group, an aryloxycarbonyl group, a carbamoyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group and the like. Groups capable of having further substituents among these substituents may have further substituents as mentioned later with respect to $R_{14}$.

Each of $R_{11}$, $R_{12}$ and $R_{13}$ preferably represents an acyl group, an alkoxycarbonyl group, an aryloxycarbonyl group, a carbamoyl group, a cyano group or a sulfonyl group; and more preferably represents a cyano group, an acyl group, an alkoxycarbonyl group, an aryloxycarbonyl group or a carbamoyl group.

In a preferred combination of $R_{11}$ and $R_{12}$, $R_{11}$ represents a cyano group while $R_{12}$ represents an alkoxycarbonyl group.

$R_{14}$ represents a hydrogen atom or a substituent. This substituent can be any of the substituents mentioned above as being represented as $R_{15}$.

Preferred examples of the substituents represented by $R_{14}$ include an alkyl group, an aryl group, a heterocyclic group, an alkoxy group, an aryloxy group and an acylamino group. The substituent represented by $R_{14}$ is more preferably an alkyl group or a substituted aryl group, and most preferably a substituted aryl group. The substitution can be accomplished by any of those mentioned above.

$X_{11}$ has the same meaning as in the general formula (M).

Specific examples of those which react with oxidizing developing agents among the heterocyclic compounds having three or more heteroatoms preferably employed in the present invention will be shown below, which however in no way limit the scope of the present invention.

(b-1)

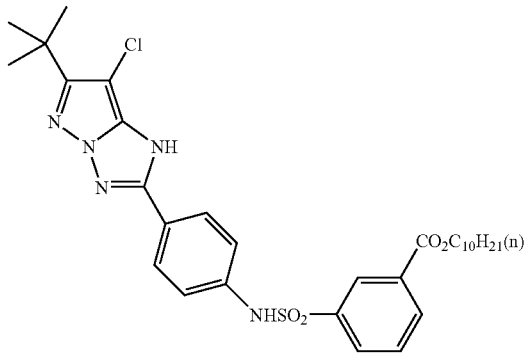

(b-2)

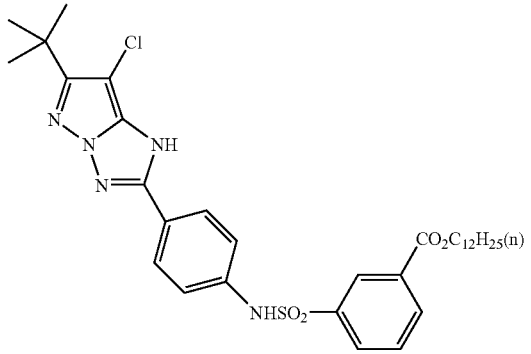

(b-3)

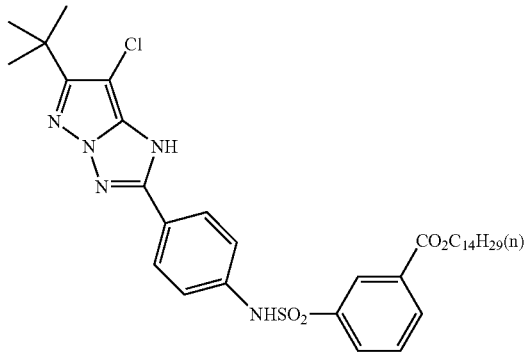

(b-4)

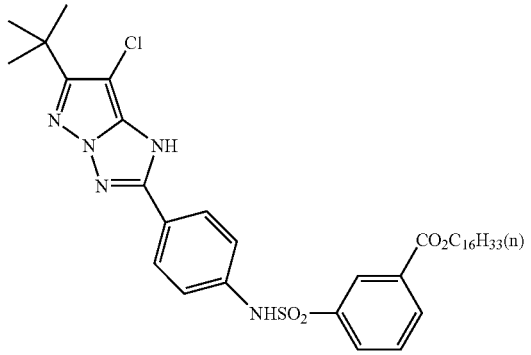

-continued
(b-5)
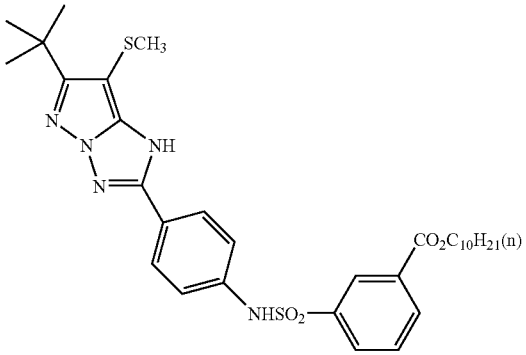
(b-6)
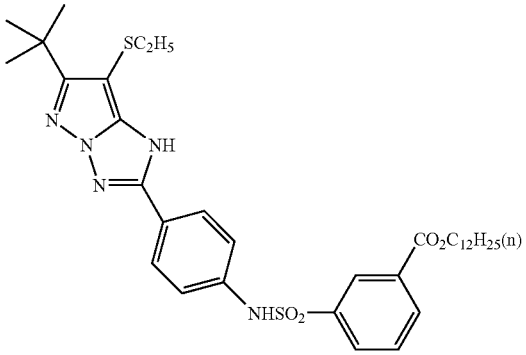
(b-7)
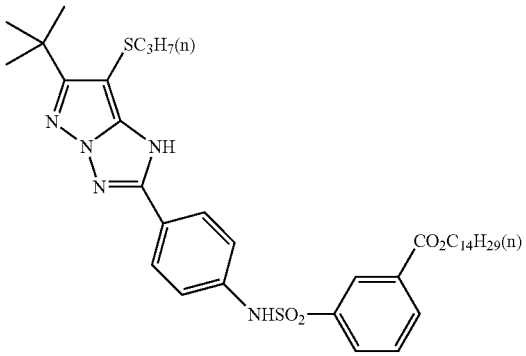
(b-8)
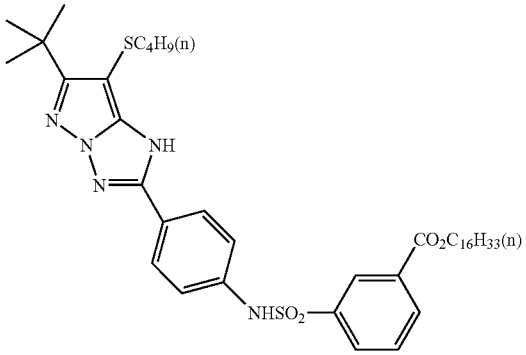
-continued
(b-9)
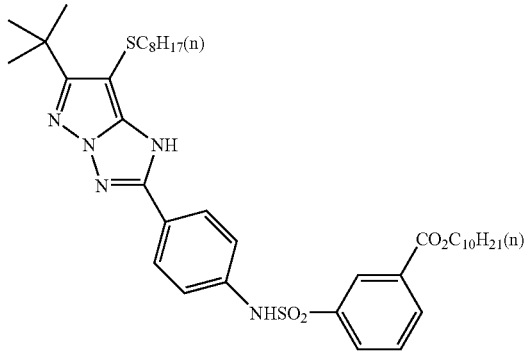
(b-10)
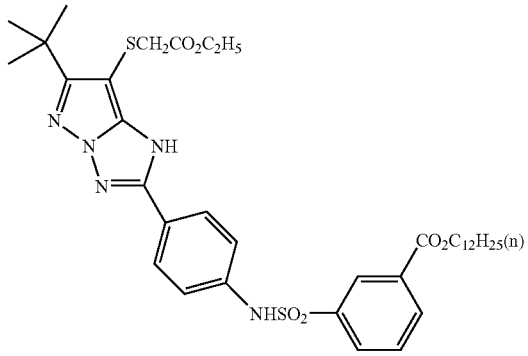
(b-11)
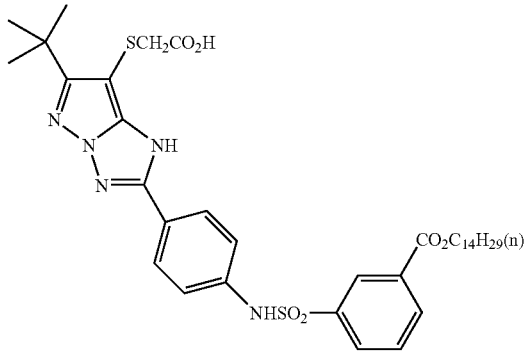
(b-12)
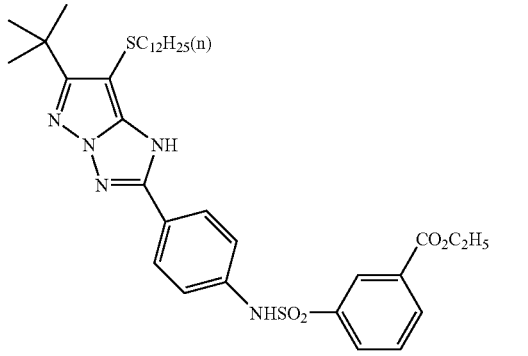

-continued
(b-13)
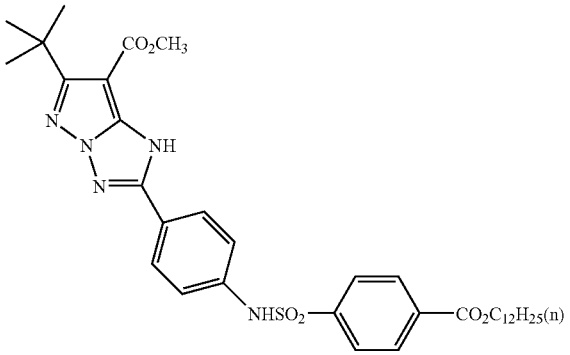
(b-14)
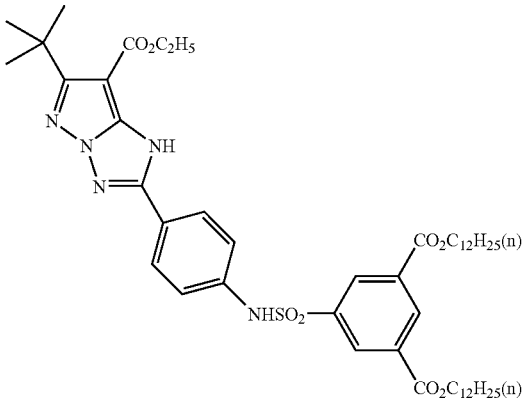
(b-15)
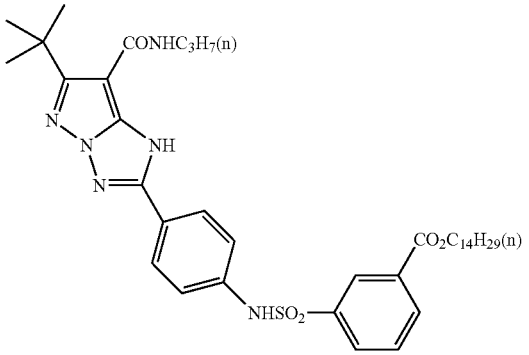
(b-16)
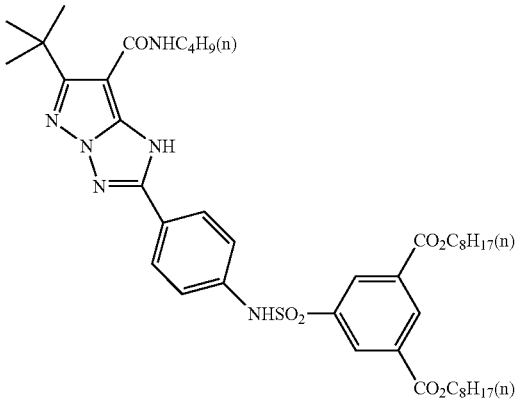
-continued
(b-17)
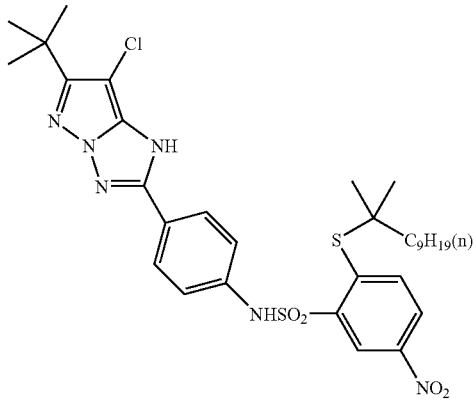
(b-18)
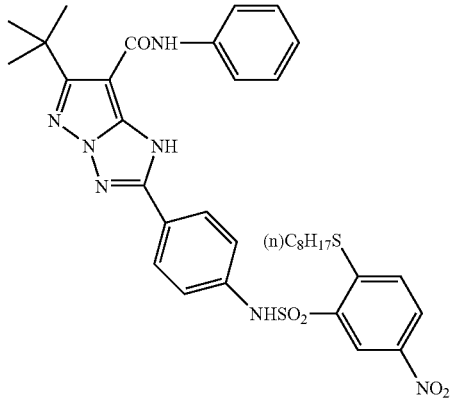
(b-19)
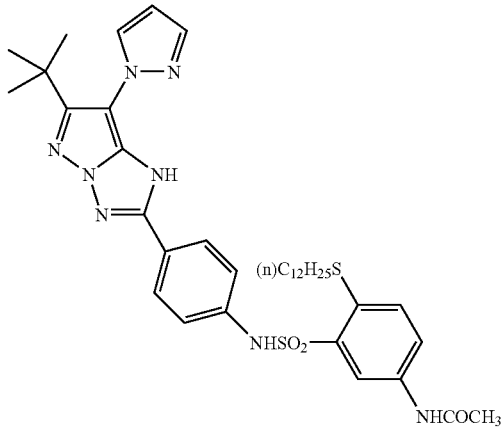

-continued
(b-20)
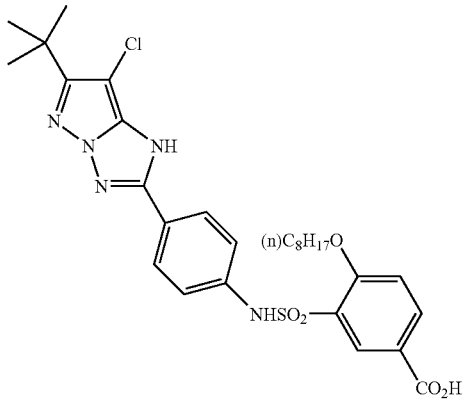
(b-21)
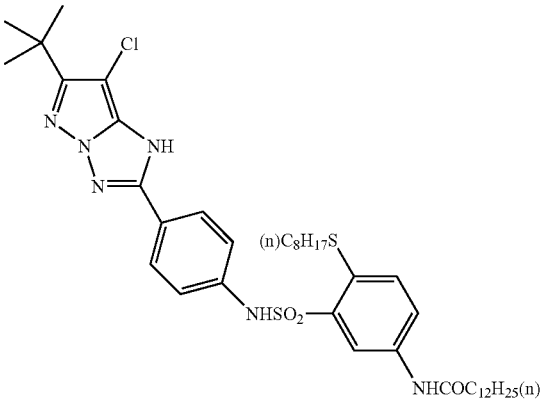
(b-22)
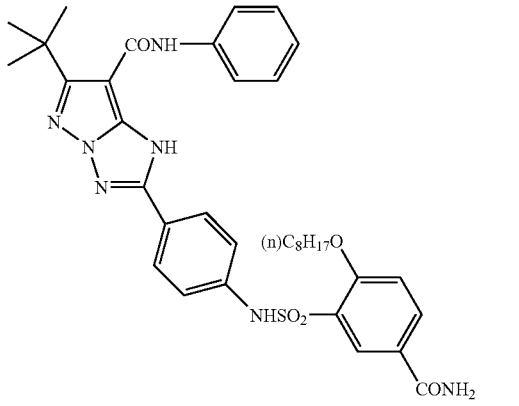
-continued
(b-23)
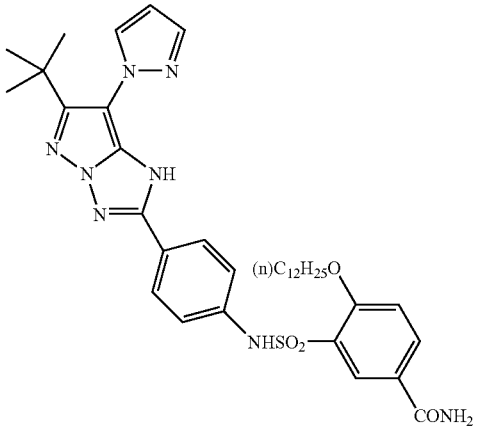
(b-24)
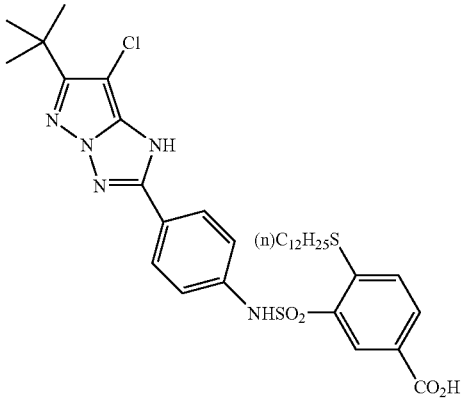
(b-25)
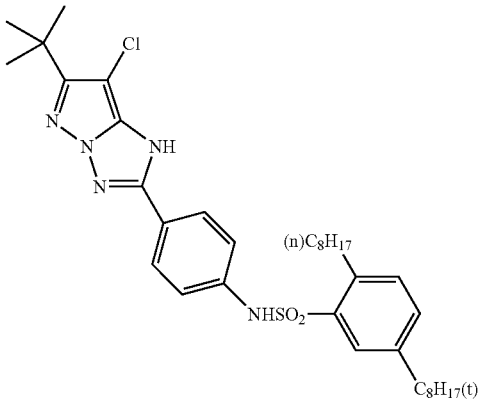

-continued
(b-26)
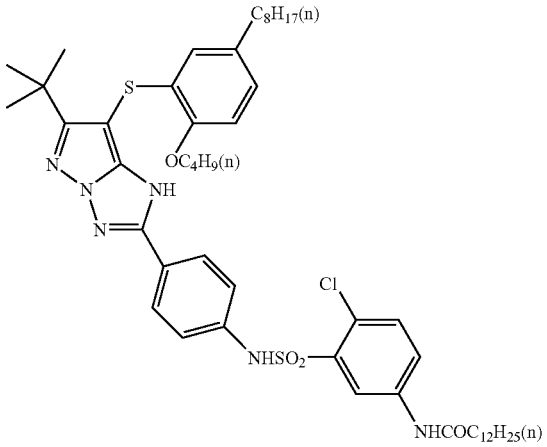
(b-27)
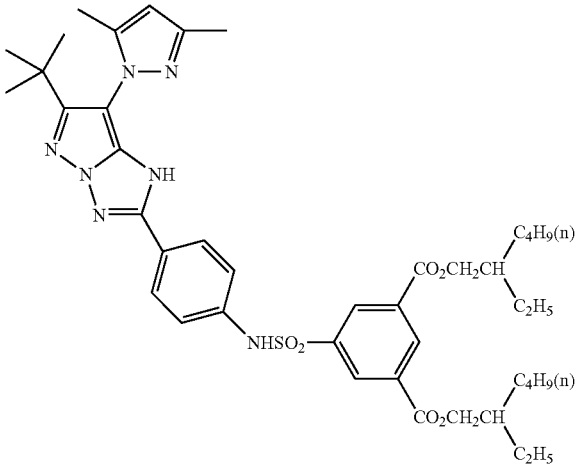
(b-28)
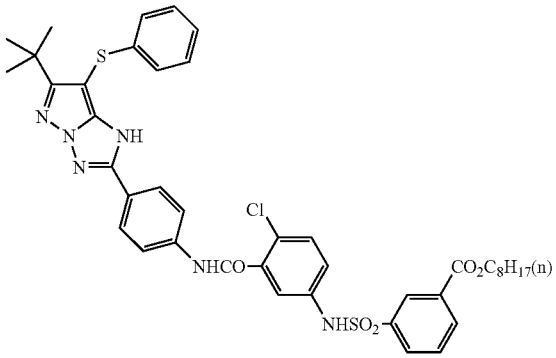
-continued
(b-29)
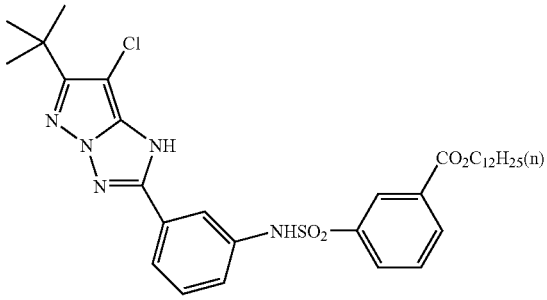
(b-30)
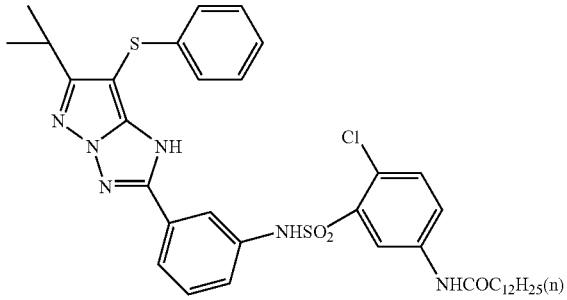
(b-31)
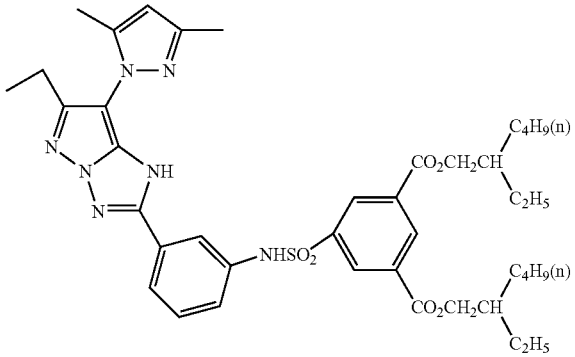
(b-32)
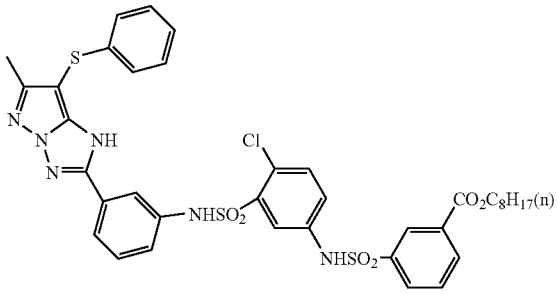

-continued
(b-33)
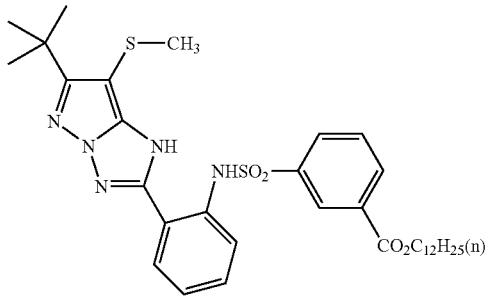
(b-34)
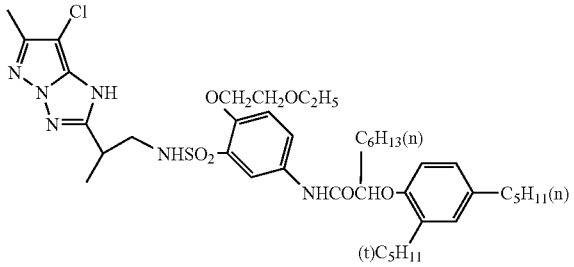
(b-35)
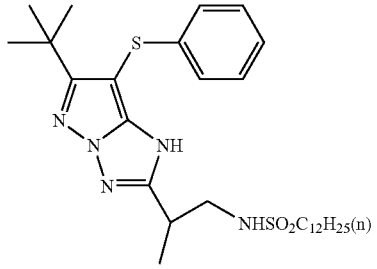
(b-36)
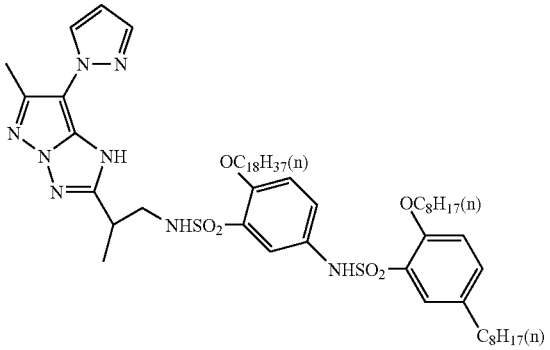
(b-37)
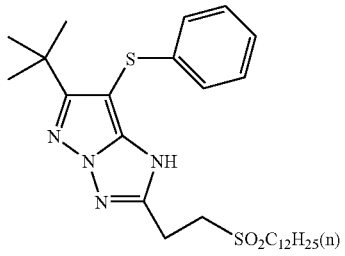
-continued
(b-38)
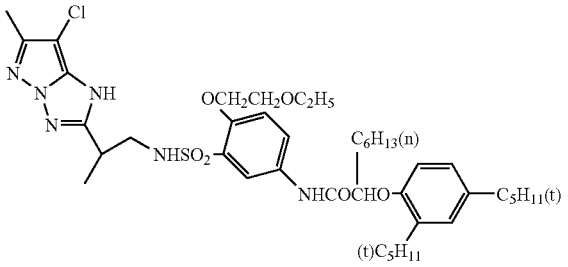
(b-39)
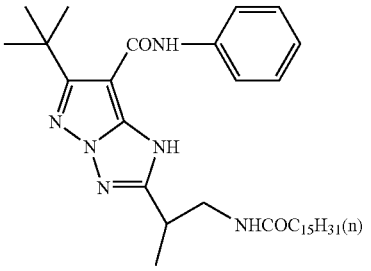
(b-40)
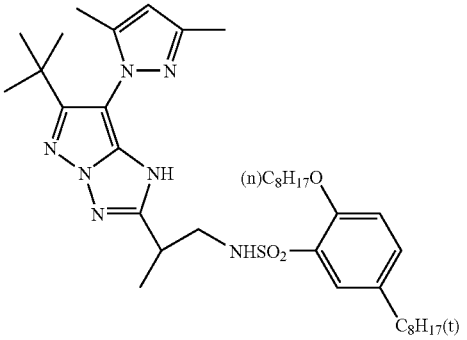
(b-41)
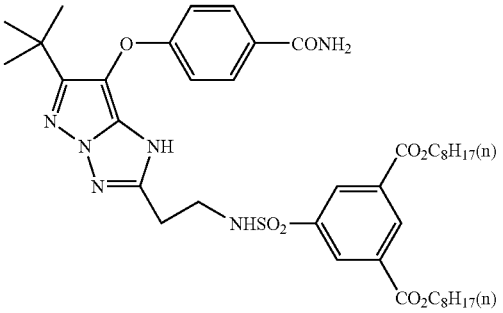
(b-42)
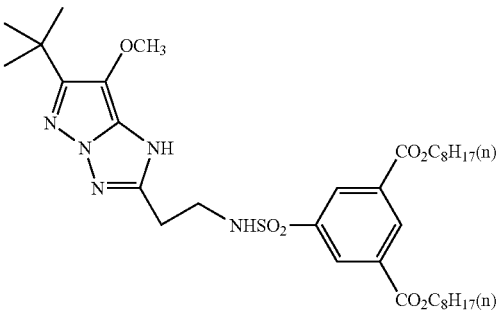

-continued
(b-43)
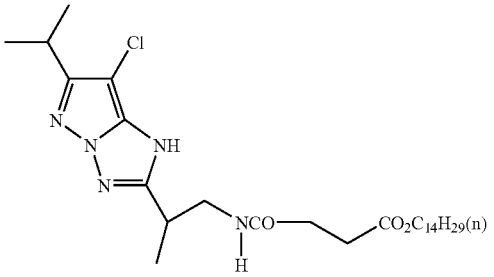
(b-44)
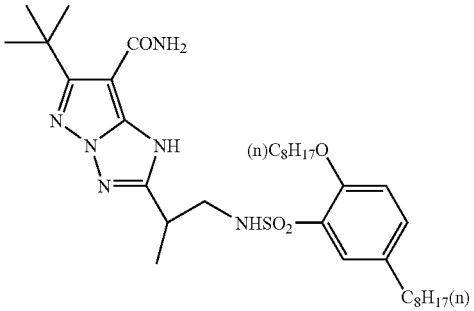
(b-45)
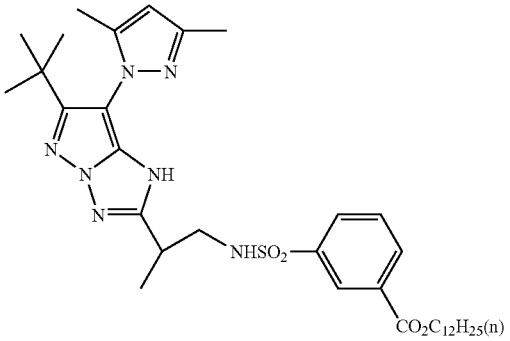
(b-46)
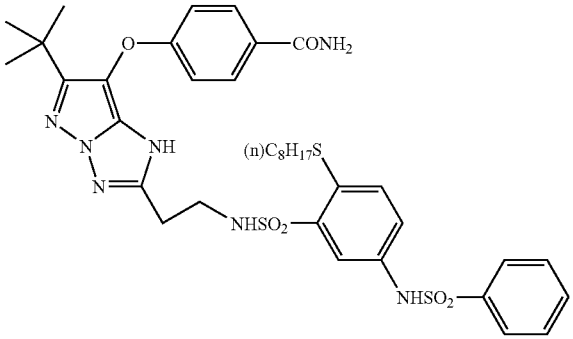
-continued
(b-51)
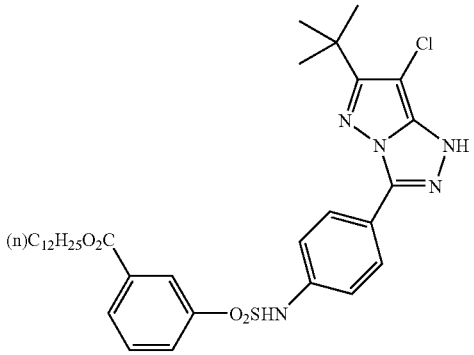
(b-52)
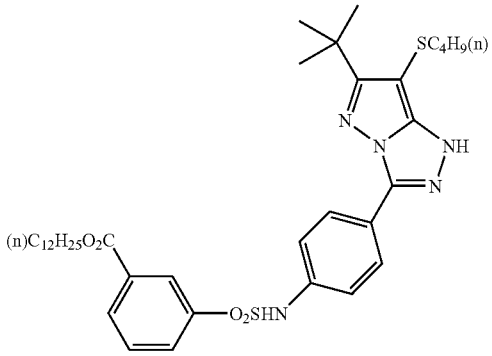
(b-53)
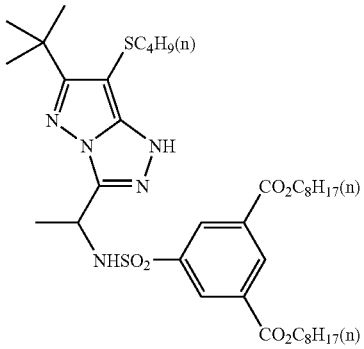
(b-54)
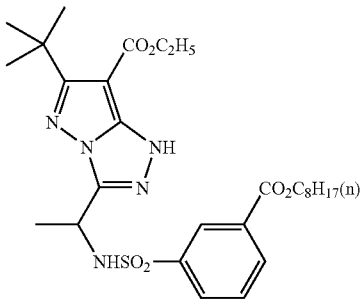

-continued
(b-55)
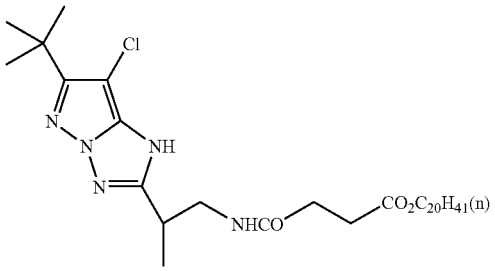
(b-56)
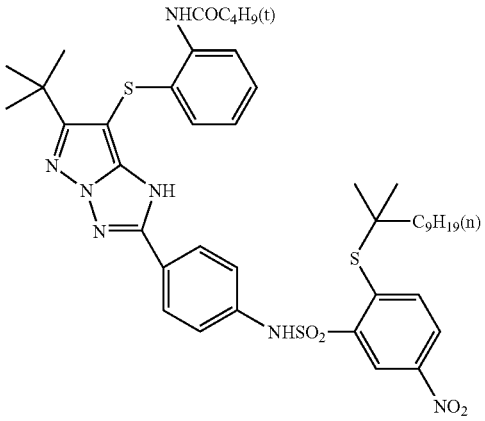
(b-57)
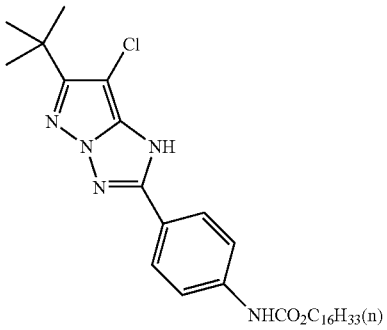
(b-58)
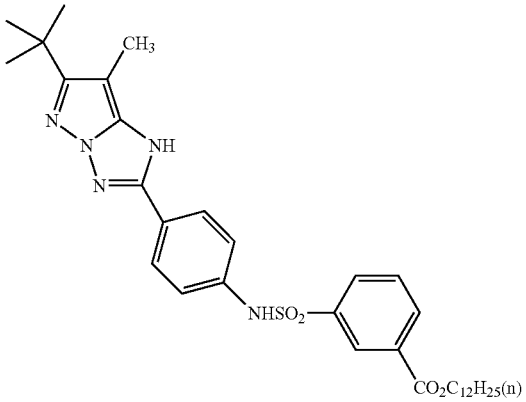
-continued
(b-59)
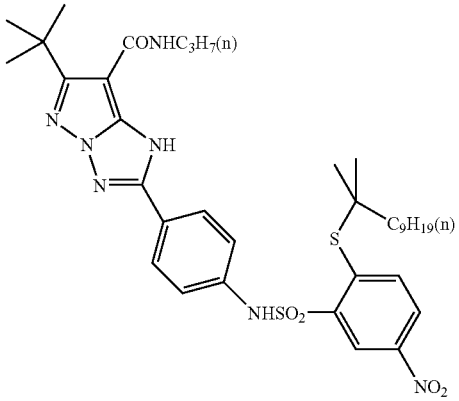
(b-60)
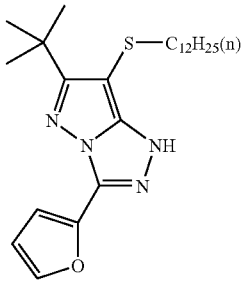
(b-61)
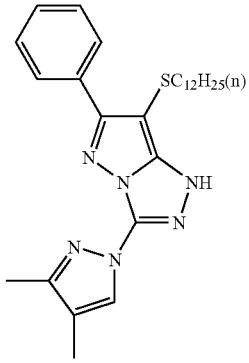
(b-62)
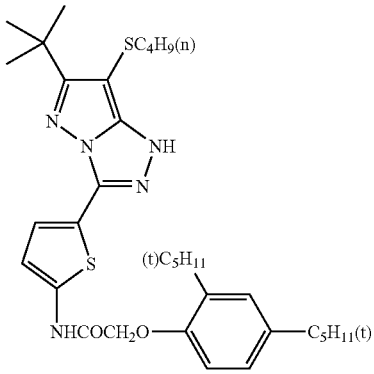

-continued
(b-63)
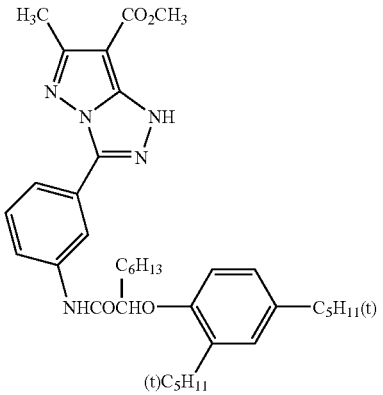
(b-64)
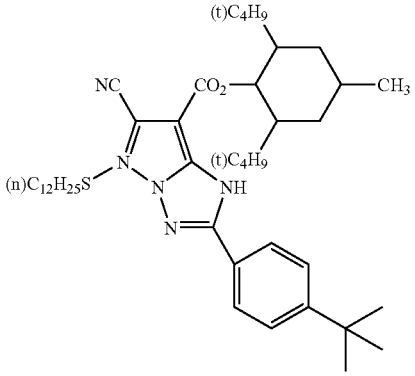
(b-65)
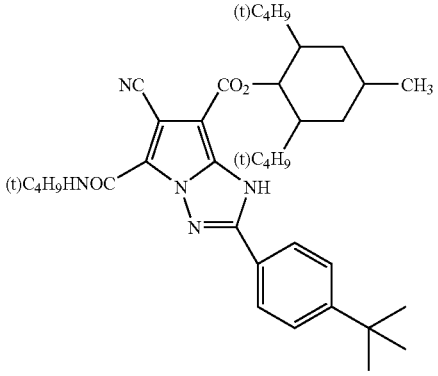
(b-66)
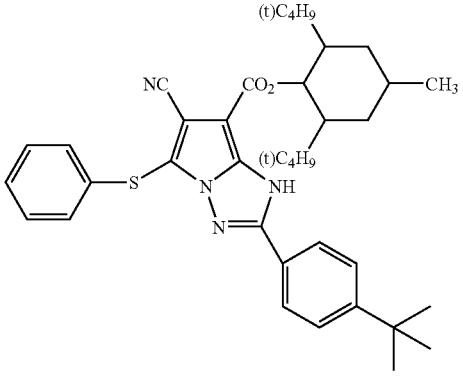
-continued
(b-67)
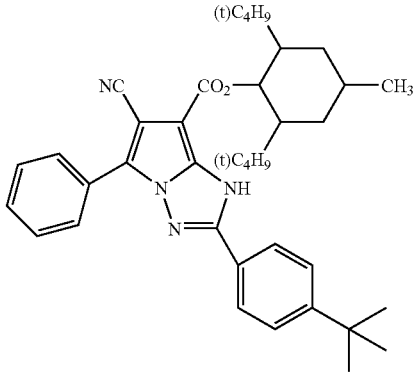
(b-68)
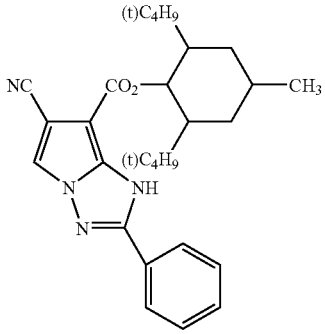
(b-69)
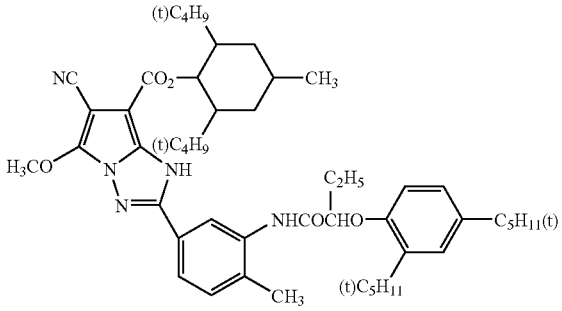
(b-70)
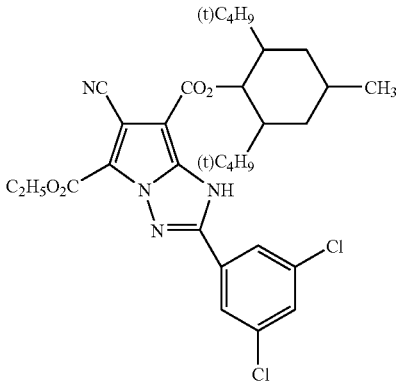

-continued
(b-71)
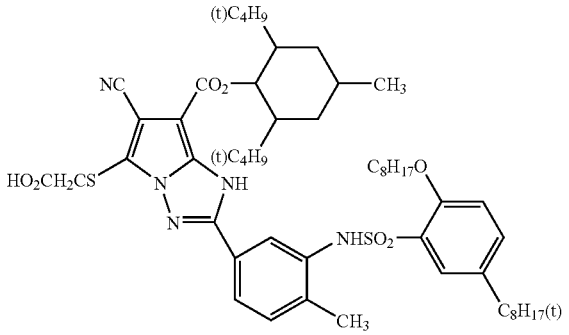
(b-72)
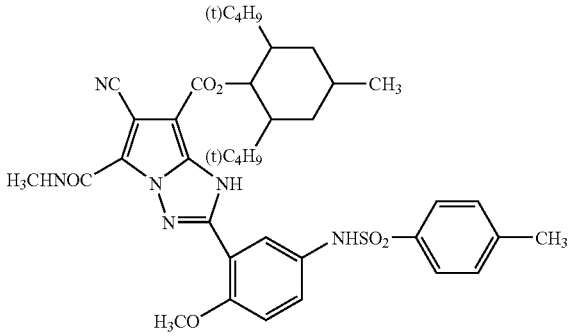
(b-73)
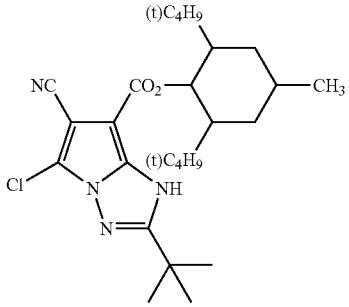
(b-74)
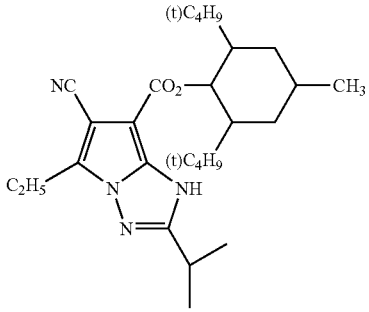
(b-75)
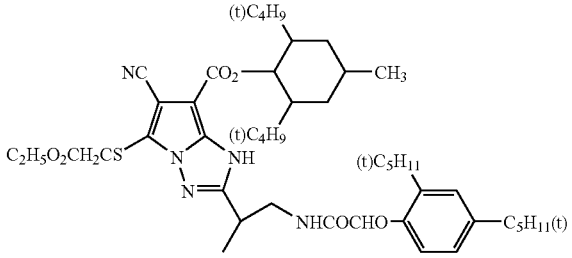
-continued
(b-76)
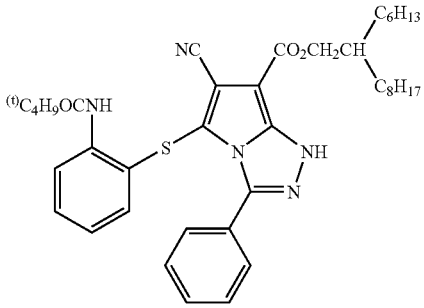
(b-77)
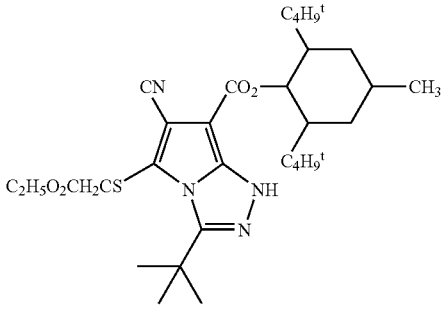
(b-78)
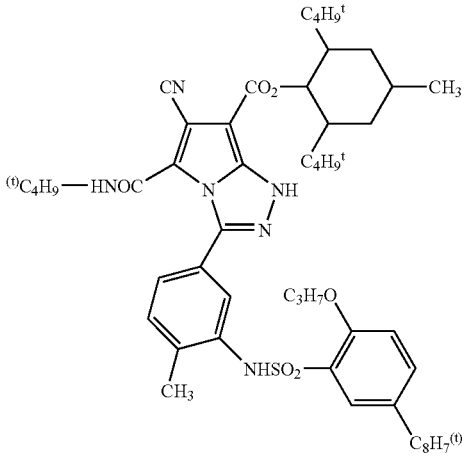
(b-79)
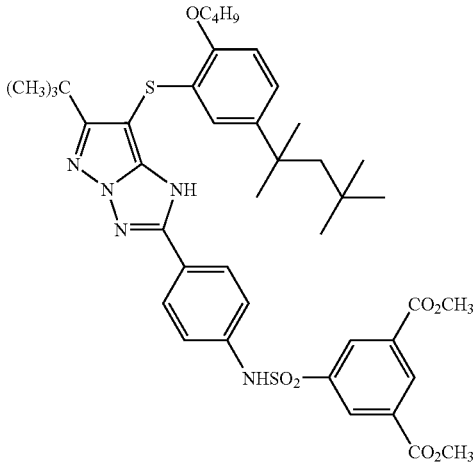

-continued
(b-80)
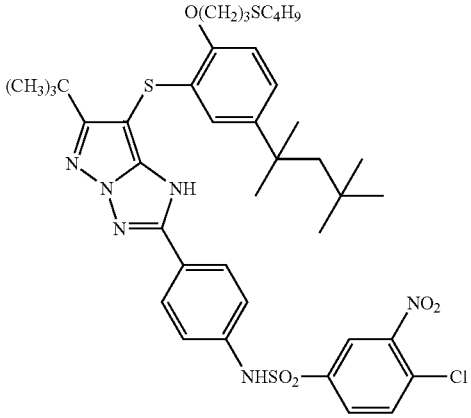
(b-81)
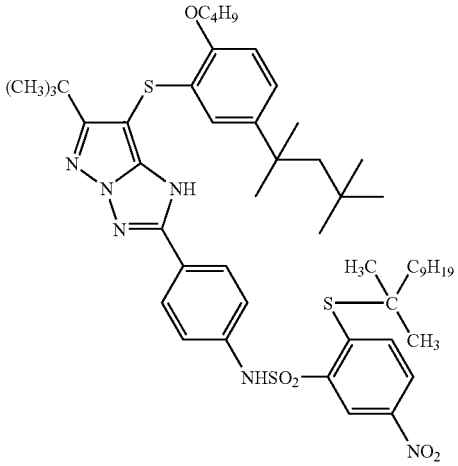
(b-82)
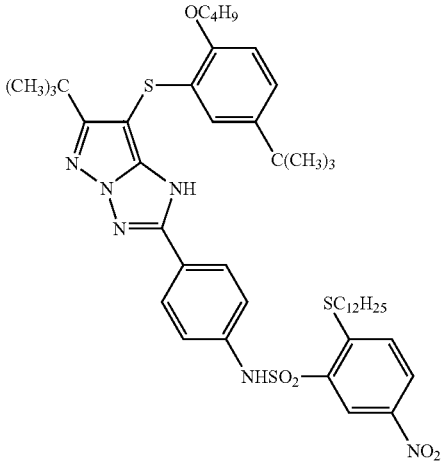
-continued
(b-83)
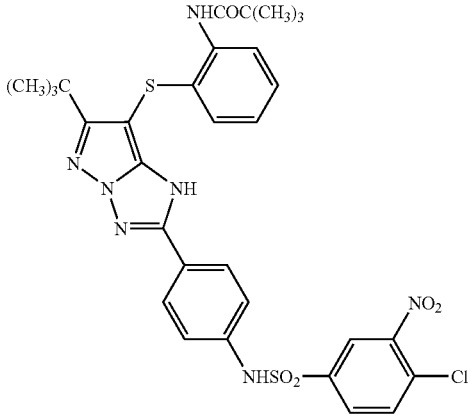
(b-84)
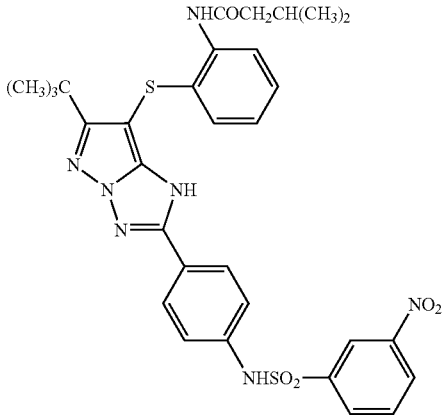
(b-85)
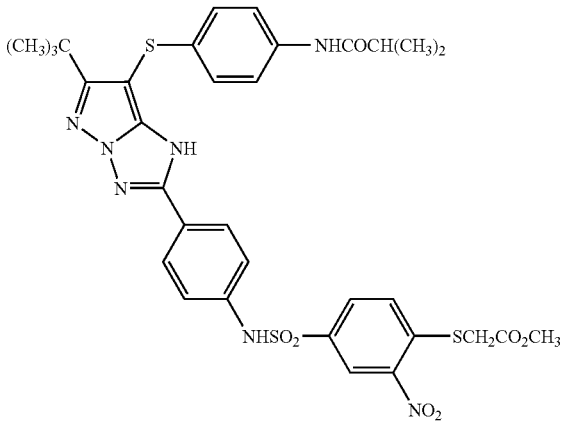

-continued
(b-86)
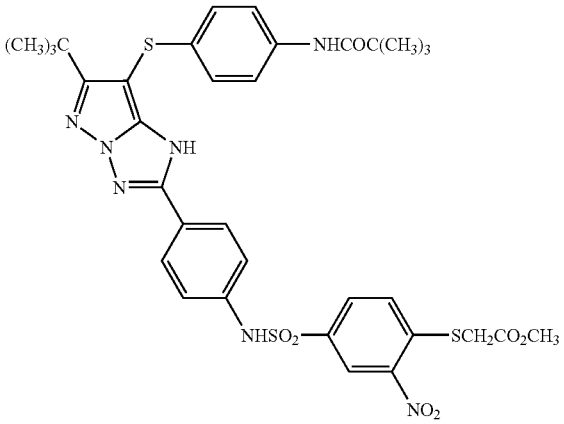
(b-87)
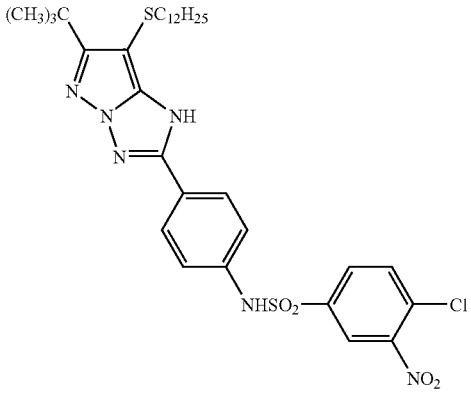
(b-88)
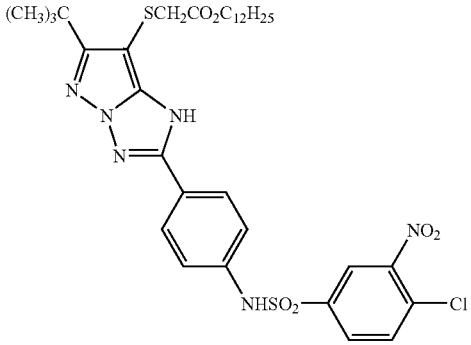
(b-89)
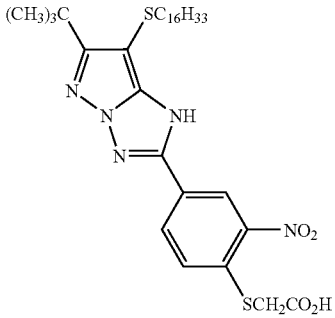
-continued
(b-90)
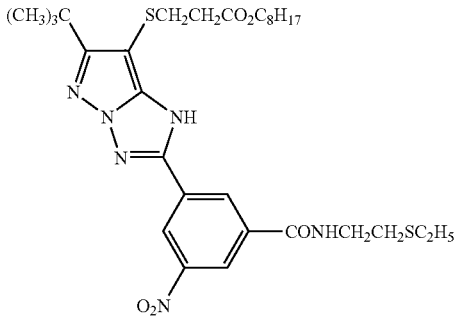
(b-91)
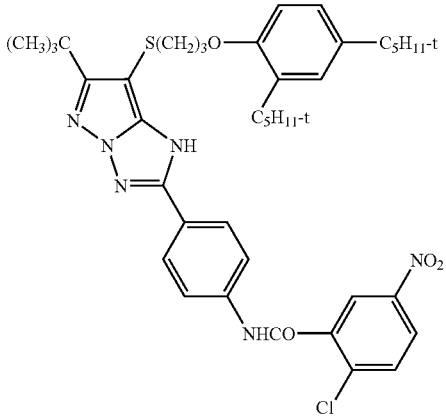
(b-92)
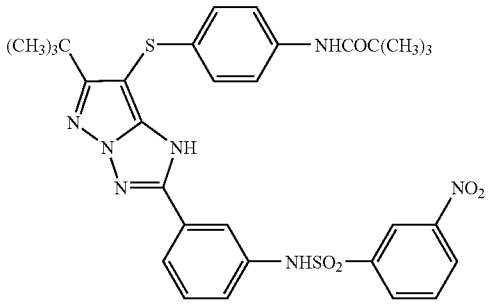
(b-93)
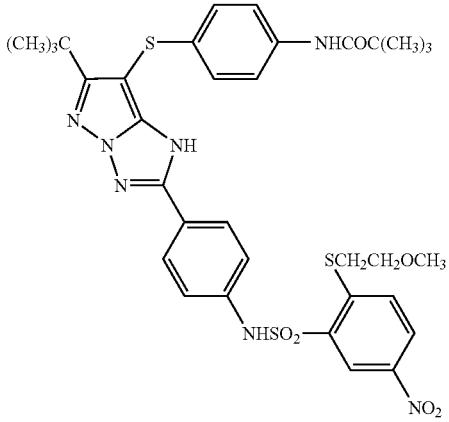

-continued
(b-94)
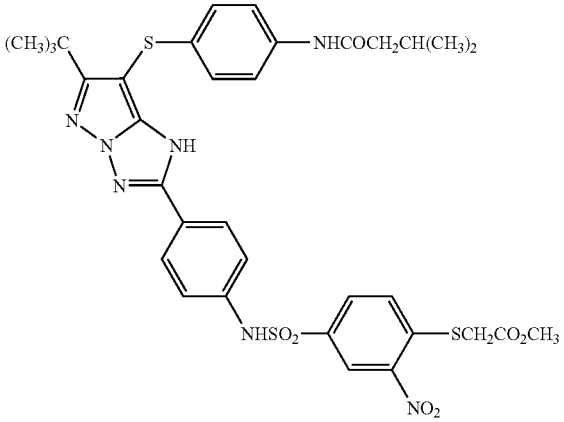
(b-95)
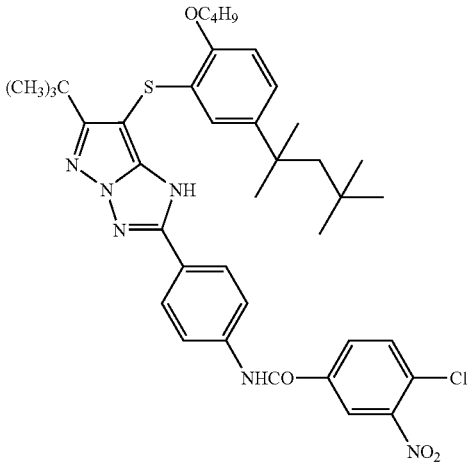
(b-96)
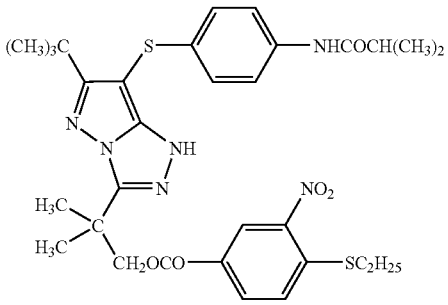
-continued
(b-97)
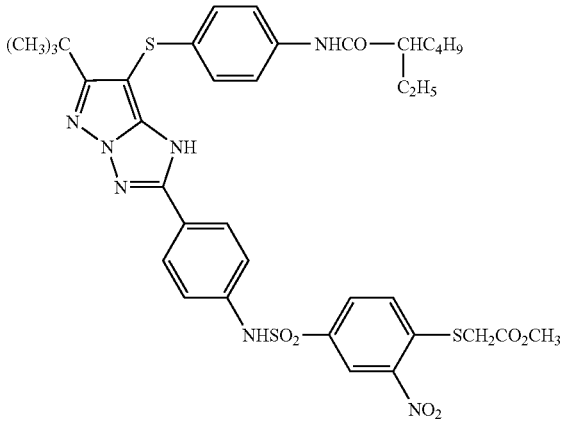
(b-98)
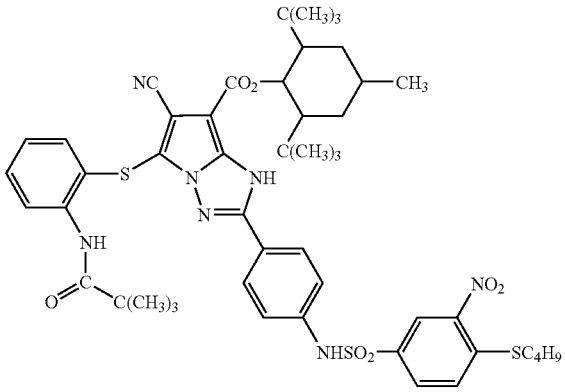
(b-99)
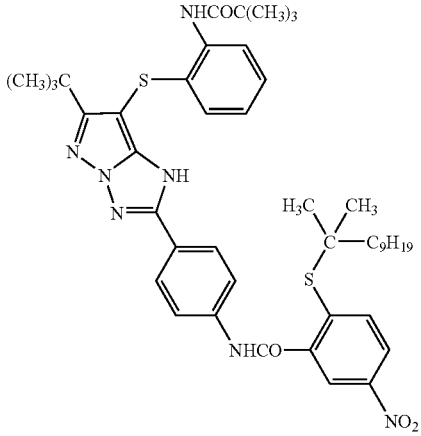
(b-100)
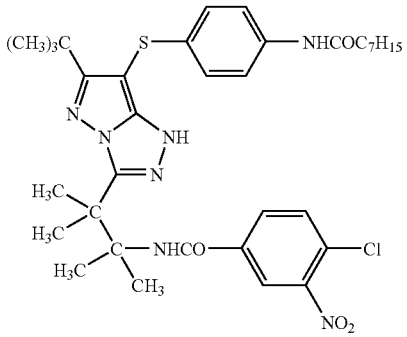

-continued (b-101)

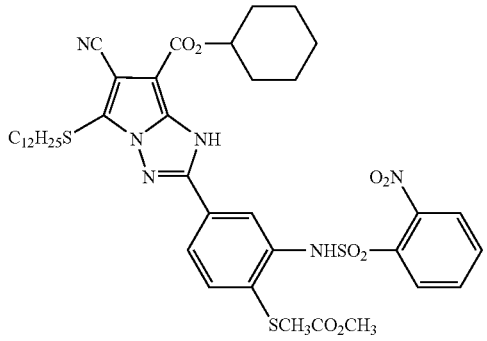

(b-102)

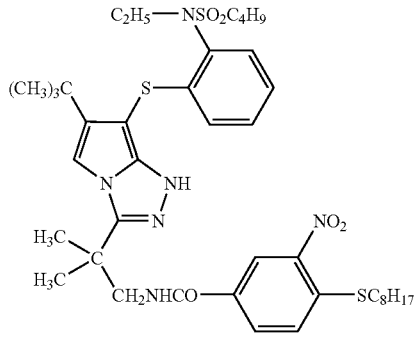

(b-103)

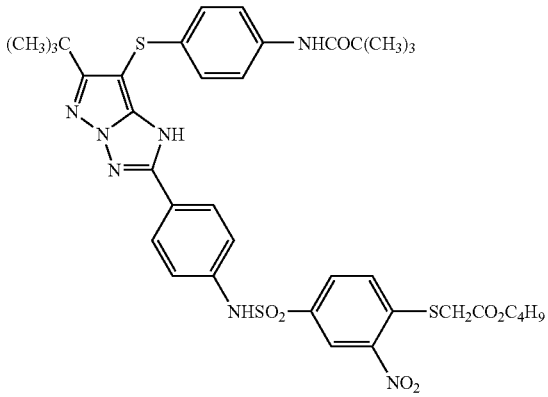

(b-104)

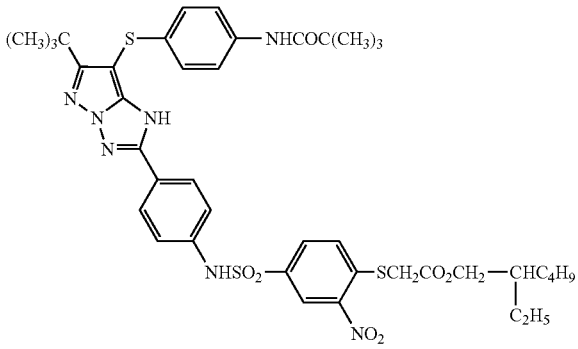

The compounds of the present invention can be easily synthesized by the synthetic methods described in, for example, JP-A's-61-65245, 61-65246, 61-147254 and 8-122984.

As aforementioned, although as the heterocyclic compounds having three or more heteroatoms according to the present invention those which react with oxidizing developing agents are preferred, those which do not react with oxidizing developing agents can be used. These will be described below.

As the heterocycles thereof, there can be mentioned, for example, a triazole ring, an oxadiazole ring, a thiadiazole ring, a benzotriazole ring, a tetrazaindene ring, a pentazaindene ring, a purine ring, a tetrazole ring, a pyrazolotriazole ring and the like.

Representative examples of heterocycles will be listed below.

As examples of the 6/5 bicyclo heterocyclic compounds according to the present invention there can be mentioned a tetrazaindene ring, a pentazaindene ring and a hexazaindene ring.

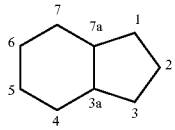

The position of nitrogen atom will be numbered in accordance with the above structures. Then, use can be made of, for example, 1,3,4,6- and 1,3,5,7- (these known as purines), 1,3,5,6-, 1,2,3a,5-, 1,2,3a,6-, 1,2,3a,7-, 1,3,3a,7-, 1,2,4,6-, 1,2,4,7-, 1,2,5,6- and 1,2,5,7-tetrazaindene rings. These compounds can also be expressed as derivatives of imidazo-, pyrazolo- or triazolopyrimidine ring, pyridazine ring and pyrazine ring. Further, use can be made of, for example, 1,2,3a,4,7-, 1,2,3a,5,7- and 1,3,3a,5,7-pentazaindene rings. Still further, use can be made of, for example, a 1,2,3a,4,6,7-hexazaindene ring. Preferably, use is made of 1,3,4,6-, 1,2,5,7-, 1,2,4,6-, 1,2,3a,7- and 1,3,3a,7-tetrazaindene rings.

Preferred examples thereof will be illustrated below.

(ca-1)

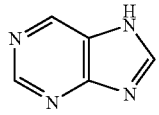

(ca-2)

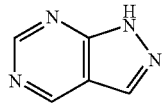

(ca-3)

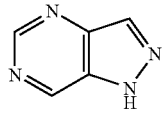

(ca-4)

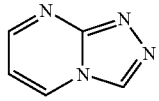

(ca-5)

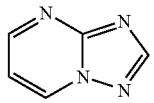

With respect to these tetrazaindene rings, pentazaindene rings and hexazaindene rings, it is preferred to avoid bonding of an ionizable substituent, such as hydroxyl, thiol, primary amino or secondary amino, to a ring atom so as to induce conjugation to ring nitrogen to thereby form a tautomer of heterocycle.

Furthermore, there can be mentioned the following heterocycles.

(ca-6)

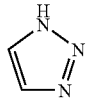

(ca-7)

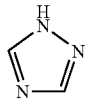

(ca-8)

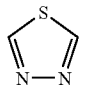

(ca-9)

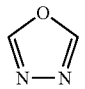

(ca-10)

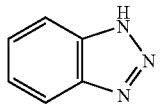

(ca-11)

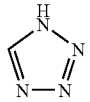

(ca-12)

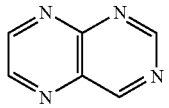

(ca-13)

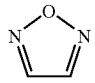

(ca-14)

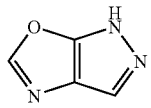

(ca-15)

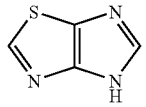

Although heterocycles resulting from partial or entire saturation of the above heterocycles can be used, it is preferred to employ those unsaturated as aforementioned.

These heterocycles, unless contrary to the definition of "heterocycle having three or more heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles of the present invention, it is preferred that free thiol (—SH) and thiocarbonyl (>C═S) be in unsubstituted form.

Among the above heterocycles, heterocycles (ca-1) to (ca-11) are preferred.

The heterocyclic compounds mentioned here are those which do not react with oxidizing developing agents. That is, heterocyclic compounds which induce no marked (less than 5 to 10%) direct chemical reaction or redox reaction with oxidizing developing agents are preferred. Further, those which are not couplers, being incapable of reacting with oxidizing developing agents to form dyes or other products are preferred.

Specific examples of the heterocyclic compounds having three or more heteroatoms which do not react with oxidizing developing agents will be shown below, which however in no way limit the scope of the present invention.

C-1

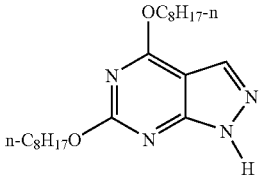

C-2

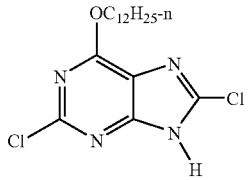

C-3

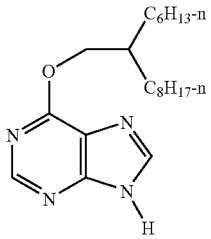

C-4

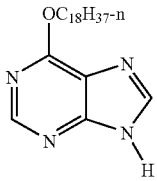

C-5

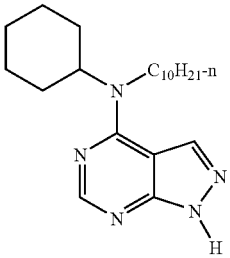

-continued
C-6
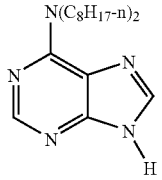
C-7
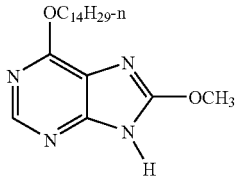
C-8
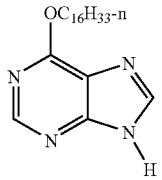
C-9
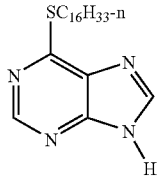
C-10
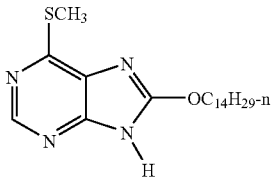
C-11
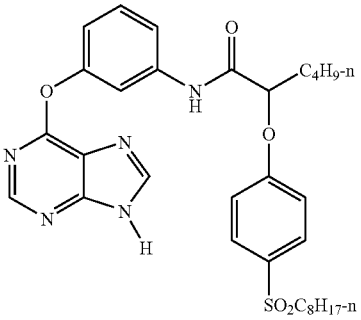
C-12
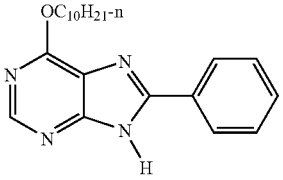
-continued
C-13
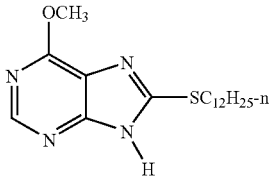
C-14
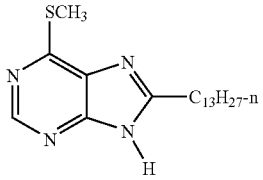
C-15
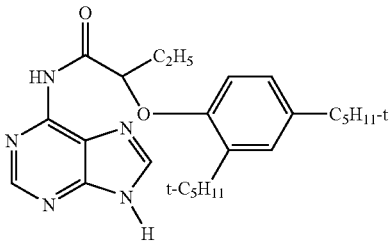
C-16
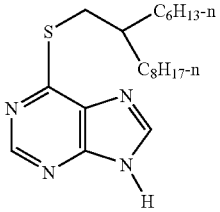
C-17
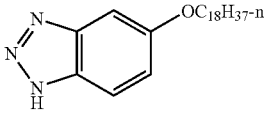
C-18
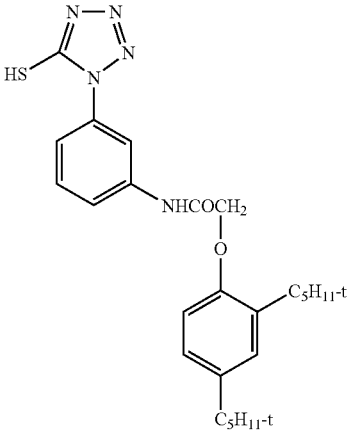

-continued
C-19
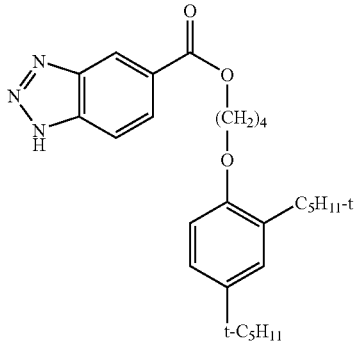
C-20
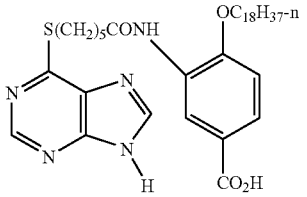
C-21
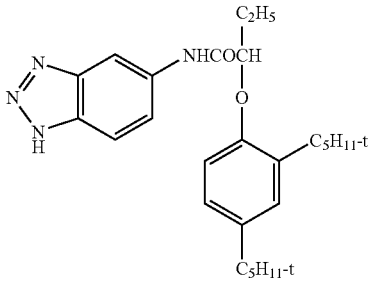
C-22
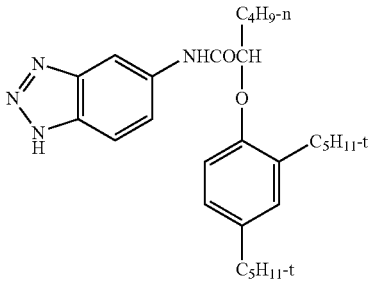
C-23
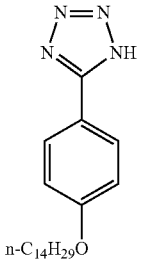
-continued
C-24
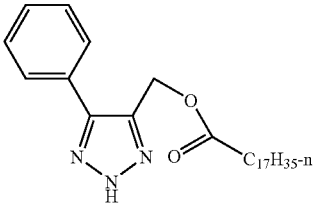
C-25
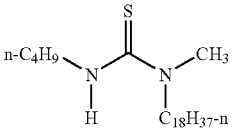
C-26
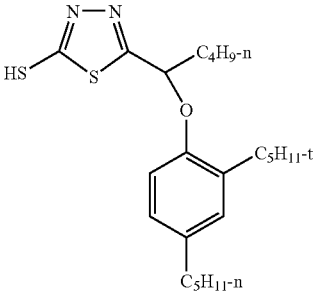
C-27
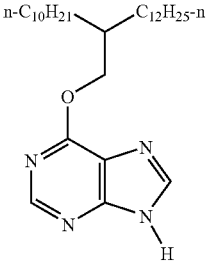
C-28
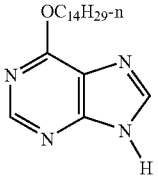
C-29
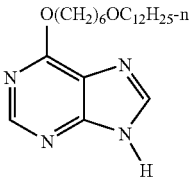
C-30
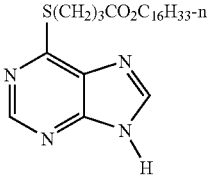

-continued

C-31

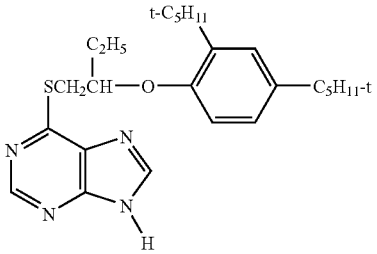

C-32

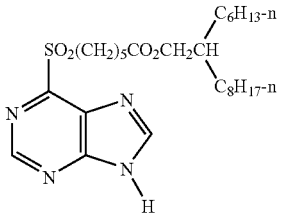

C-33

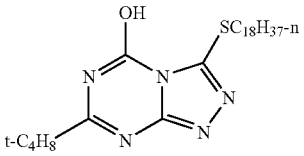

C-34

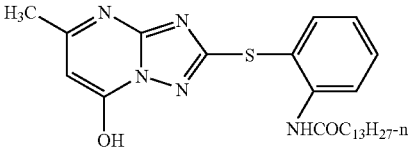

C-35

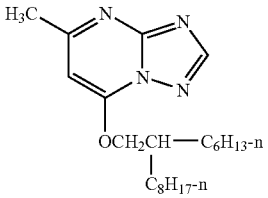

C-36

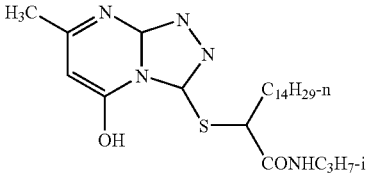

C-37

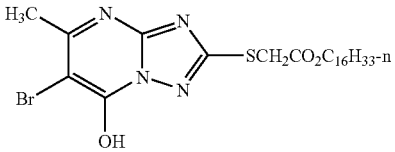

C-38

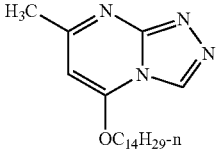

-continued

C-39

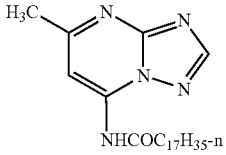

C-40

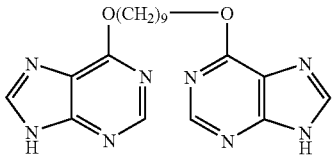

C-41

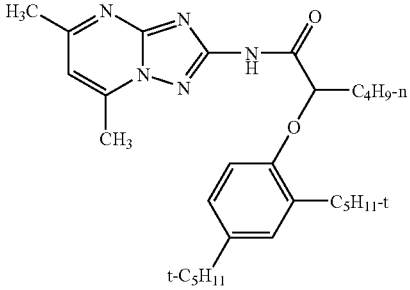

C-42

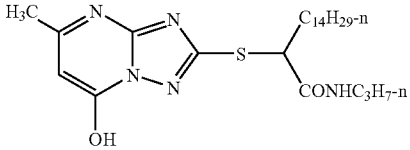

C-43

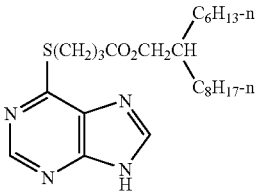

In addition to the above examples of compounds, compounds falling under the present invention described as examples in JP-A-2000-194085 can preferably be used as the compounds of the present invention.

As the compounds of the present invention, use can be made of compounds falling under the present invention among those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The compounds of the present invention can be synthesized by the processes described therein.

As substituents for the above compounds of the present invention, there can be selected any of those used by persons skilled in the art to which the present invention pertains for attaining desired photographic performance in specified usage. Such substituents include, for example, a hydrophobic group (ballasting group), a solubilizing group, a blocking group and a release or releasable group. With respect to these groups, generally, the number of carbon atoms thereof is preferably in the range of 1 to 60, more preferably 1 to 50.

For controlling the migration in photo-sensitive material, the compounds of the present invention in the molecules may contain a hydrophobic group or ballasting group of high molecular weight, or may contain a polymer main chain.

The number of carbon atoms of representative ballasting groups is preferably in the range of 8 to 60, more preferably 10 to 57, still more preferably 12 to 55, and most preferably 16 to 53. As these substituents, there can be mentioned substituted or unsubstituted alkyl, aryl and heterocyclic groups having 8 to 60, preferably 10 to 57, more preferably 13 to 55, still more preferably 16 to 53 and most preferably 20 to 50 carbon atoms. These preferably contain branches. Examples of representative substituents on these groups include alkyl, aryl, alkoxy, aryloxy, alkylthio, hydroxyl, halogen, alkoxycarbonyl, aryloxycarbonyl, carboxyl, acyl, acyloxy, amino, anilino, carbonamido, carbamoyl, alkylsulfonyl, arylsulfonyl, sulfonamido and sulfamoyl. These substituents generally each have 1 to 42 carbon atoms. For example, there can be mentioned the aforementioned W. These substituents may have further substituents.

The ballasting groups will be described in greater detail. Preferred examples thereof include an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylamino or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as groups listed above as being represented by W); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group, a sulfamoyl group and a halogen atom.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The total number of carbon atoms of these substituents, although not particularly limited, is preferably in the range of 8 to 60, more preferably 10 to 57, still more preferably 12 to 55, and most preferably 16 to 53.

In the incorporating of compounds of the present invention in a silver halide photosensitive material, preferred use may be made of a compound which can be immobilized in specified layer during storage but diffuses at appropriate time (preferably development processing) of photograph processing. Although any compounds and methods can be used for preventing the diffusion of the compounds of the present invention and immobilizing the same during the storage, there can preferably be mentioned the following compounds and methods.

(1) Method wherein a compound of specified pKa value together with a high-boiling organic solvent described later, etc. is emulsified and added so that the compound of the present invention is dissociated and dissolved out from oil only during development.

The pKa value of the compounds of the present invention is preferably 5.5 or higher, more preferably from 6.0 to 10.0, still more preferably 6.5 to 8.4, and most preferably 6.9 to 8.3.

The dissociative group, although not particularly limited, can preferably be selected from among carboxyl, —$CONHSO_2$— (sulfonylcarbamoyl or carbonylsulfamoyl), —CONHCO— (carbonylcarbamoyl), —$SO_2NHSO_2$— (sulfonylsulfamoyl), sulfonamido, sulfamoyl and phenolic hydroxyl. Of these, carboxyl, —$CONHSO_2$—, —CONHCO— and —$SO_2NHSO_2$— are more preferred. Carboxyl and —$CONHSO_2$— are most preferred.

(2) Method wherein a ballasting group is introduced in the compounds of the present invention to thereby cause them to be resistant to diffusion.

(3) Method wherein a blocking group is used. Use can be made of compounds whose properties are changed (for example, becoming diffusive) by chemical reactions, such as nucleophilic reaction, electrophilic reaction, oxidation reaction and reduction reaction, during the photographic processing, and, relating to these, chemistry and any techniques publicly known in the photographic field can be utilized.

By way of example, the nucleophilic reaction will be described in detail below. The nucleophilic reaction, although can be induced in arbitrary conditions, is accelerated by bases or heating, especially in the presence of bases. The bases, although not particularly limited, can be selected from among inorganic bases and organic bases. For example, there can be mentioned a tertiary amine such as triethylamine, an aromatic heterocyclic amine such as pyridine and a base having OH anion such as sodium hydroxide or potassium hydroxide. In particular, in the present invention, the nucleophilic reaction is accelerated by high-pH photographic processing, such as developer processing, among the photographic processings, and thus can preferably be employed.

Herein, the nucleophilic agent refers to chemical species having properties to attack atoms of low electron density, such as carbonyl carbon, contained in an atomic group which forms a group split off upon being attacked by the nucleophilic agent, thereby donating or sharing electrons. Although the structure of the nucleophilic agent is not particularly limited, as preferred examples thereof there can be mentioned a hydroxide ion donating reagent (e.g., sodium hydroxide, potassium hydroxide, lithium hydroxide, sodium carbonate or potassium carbonate), a sulfite ion donating reagent (e.g., sodium sulfite or potassium sulfite), a hydroxylamido ion donating reagent (e.g., hydroxyamine), a hydrazido ion donating reagent (e.g., hydrazine hydrate or dialkylhydrazine compound), a hexacyanoiron (II) acid ion donating reagent (e.g., yellow prussiate of potash) and a cyanide ion, tin (II) ion, ammonia ion or alkoxy ion donating reagent (e.g., sodium methoxide). As the group split off as a result of attack by nucleophilic agents, there can be mentioned a group utilizing reverse Michael reaction described in Can. J. Chem. vol. 44, page 2315 (1966) and JP-A's-59-137945 and 60-41034, a group utilizing nucleophilic reaction described in Chem. Lett. page 585 (1988), JP-A-59-218439 and JP-B-5-78025, a group utilizing ester bond or amido bond hydrolyzing reaction, etc.

For imparting the above functions, the compounds of the present invention may be substituted with a block group capable of releasing compounds of the present invention during the photographic processing.

As the block group, there can be employed known block groups, which include block groups such as acyl and sulfonyl groups as described in, for example, JP-B-48-9968, JP-A's-5-2-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's-59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's-57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's-59-121328 and 59-218439 and JP-A-63-318555 (EP 0295729); block groups utilizing a ring cleavage reaction of 5- or 6-membered ring as described in, for example, JP-A-57-76541 (U.S. Pat. No. 4,335,200), JP-A-57-135949 (U.S. Pat. No. 4,350,752), JP-A's-57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's-59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-elimination reaction as described in, for example, JP-A's-59-93442, 61-32839 and 62-163051 and JP-B-5-37299; block groups utilizing a nucleophilic substitution reaction of diarylmethanes as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's-62-80646, 62-144163 and 62-147457; block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816; and block groups of JP-A's-3-236047 and 3-238445. Of these block groups, block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816 are especially preferred. Moreover, these block groups may be those containing timing groups capable of inducing cleavage reaction with the use of electron transfer reaction as described in U.S. Pat. Nos. 4,409,323 and 4,421,845. With respect to such groups, it is preferred that timing group terminals inducing electron transfer reaction be blocked.

(4) Method wherein use is made of a dimer, trimer or higher polymer compound containing partial structure of compounds of the present invention.

(5) Method wherein immobilization is effected by the use of water-insoluble compounds of the present invention (solid dispersions). As mentioned with respect to method (1), compounds of the present invention exhibiting specified pKa values are preferred from the viewpoint that they are dissolved only at the stage of development. Examples of uses of water-insoluble dye solids (solid dispersions) are disclosed in JP-A's-56-12639, 55-155350, 55-155351, 63-27838 and 63-197943, EP 15601, etc.

Particular methods for solid dispersion will be specified later.

(6) Method wherein compounds of the present invention are immobilized by coexistence of a polymer having an electric charge counter to that thereof as a mordant. Examples of dye immobilizations are disclosed in U.S. Pat. Nos. 2,548,564, 4,124,386 and 3,625,694, etc.

(7) Method wherein compounds of the present invention are immobilized by effecting adsorption thereof on metal salts such as silver halides. Examples of dye immobilizations are disclosed in U.S. Pat. Nos. 2,719,088, 2,496,841 and 2,496,843, JP-A-60-45237, etc.

As representative examples of adsorptive groups on silver halides which can be used in compounds of the present invention, there can be mentioned groups described in JP-A-2003-156823, page 16 right column line 1 to page 17 right column line 12.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous-aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, a perchlorate ion, a carbonate ion, a nitrate ion, $BF_4^-$, $PF_6^-$and $Ph_4^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the above methods for immobilizing compounds of the present invention, there can preferably be employed the method of using a compound of specified pKa (1), the method of using a compound having a ballasting group (2), the method of using a compound having a blocking group (3) and the method of using a solid dispersion (5). It is preferred to employ compounds suitable for the methods. Using the method (1), (2) or (3) together with suitable compounds is more preferred. Using the method (1) or (2) together with suitable compounds is still more-preferred. Simultaneously using the methods (1) and (2) is most preferred. That is, compounds simultaneously having specified pKa and ballasting group according to the present invention can most preferably be employed.

The compounds of the present invention, when required for neutralizing the charges thereof, can contain a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$and $SO_3^-$, when having a proton as a counter ion, can be indicated as $CO_2H$ and $SO_3H$, respectively.

It is preferred to use combinations of aforementioned individual preferred compounds (especially combinations of individual most preferred compounds) as the compound of the present invention.

When compounds of the present invention each have two or more asymmetric carbon atoms in the molecule, there are multiple stereoisomers per any particular structure. This description involves all possible stereoisomers. In the present invention, use can be made of any one of multiple stereoisomers, or some thereof in the form of a mixture.

With respect to the compounds of the present invention, any one thereof can be used, or two or more can be used in combination. The number and type of compounds for use can be arbitrarily selected.

Further, the compounds of the present invention may be used in combination with compounds each having at least three heteroatoms as described in JP-A's-2000-194085 and 2003-156823.

The compounds of the present invention can be used in combination with one or more arbitrary methods capable of exerting sensitivity enhancing effects or compounds capable of exerting sensitivity enhancing effects. The number and type of employed methods and contained compounds can be arbitrarily selected.

In the present invention, as long as the compounds of the present invention can be applied to a silver halide photosensitive sensitive material (preferably a silver halide color photosensitive material), the addition site therefor, etc. are not particularly limited, and the compounds may be added to any of silver halide photo-sensitive layer and nonsensitive layer.

In the use in a silver halide photo-sensitive layer consisting of multiple layers of different speeds, although the addition may be effected to any of these layers, it is preferred that the compounds be incorporated in the layer of highest speed.

In the use in nonsensitive layer, the compounds are preferably incorporated in a nonsensitive layer disposed between a red-sensitive layer and a green-sensitive layer or between a green-sensitive layer and a blue-sensitive layer. The nonsensitive layer refers to any of all layers other than the silver halide emulsion layers which include an antihalation layer, an interlayer, a yellow filter layer and a protective layer.

The method of incorporating the compounds of the present invention in a photo-sensitive material, although not particularly limited, can be selected from among, for example, the method of adding through emulsification dispersion of the compounds together with a high boiling organic solvent or the like, the method of adding through solid dispersion, the method of adding the compounds in solution form to a coating liquid (for example, dissolving the compounds in water, an organic solvent such as methanol or a mixed solvent before addition) and the method of adding during the preparation of silver halide emulsion. Among these, the method of incorporating in a photo-sensitive material through emulsification dispersion or solid dispersion is preferred. The method of incorporating in a photo-sensitive material through emulsification dispersion is more preferred.

As the emulsification dispersion method, use can be made of the in-water oil droplet dispersing method wherein the compounds are dissolved in a high-boiling organic solvent (optionally in combination with a low-boiling organic solvent), emulsified and dispersed in an aqueous solution of gelatin and added to a silver halide emulsion.

Examples of the high-boiling organic solvents for use in the in-water oil droplet dispersing method are listed in, for example, U.S. Pat. No. 2,322,027. Particulars of a latex dispersing method as one of polymer dispersing methods are described in, for example, U.S. Pat. No. 4,199,363, DE (OLS) 2,541,274, JP-B-53-41091 and EP's 0,727,703 and 0,727,704. Further, a method of dispersion by an organic solvent soluble polymer is described in WO 88/00723.

Examples of the high-boiling organic solvents which can be employed in the above in-water oil droplet dispersing method include phthalic acid esters (e.g., dibutyl phthalate, dioctyl phthalate and di-2-ethylhexyl phthalate), esters of phosphoric acid or phosphonic acid (e.g., triphenyl phosphate, tricresyl phosphate and tri-2-ethylhexyl phosphate), fatty acid esters (e.g., di-2-ethylhexyl succinate and tributyl citrate), benzoic acid esters (e.g., 2-ethylhexyl benzoate and dodecyl benzoate), amides (e.g., N,N-diethyldodecanamide and N,N-dimethyloleamide, alcohols or phenols (e.g., isostearyl alcohol and 2,4-di-tert-amylphenol), anilines (e.g., N,N-dibutyl-2-butoxy-5-tert-octylaniline), chlorinated paraffins, hydrocarbons (e.g., dodecylbenzene and diisopropylnaphthalene) and carboxylic acids (e.g., 2-(2,4-di-tert-amylphenoxy)butyric acid). Further, as an auxiliary solvent, an organic solvent having a boiling point of 30 to 160° C. (e.g., ethyl acetate, butyl acetate, methyl ethyl ketone, cyclohexanone, methyl cellosolve acetate or dimethylformamide) may be used in combination therewith. The high-boiling organic solvents are preferably used in a mass ratio to compounds of the present invention of 0 to 10 more preferably 0 to 4.

The whole or portion of the auxiliary solvent can be removed from the emulsified dispersion by vacuum distillation, noodle washing, ultrafiltration or other appropriate means according to necessity from the viewpoint of enhancing of aging stability during storage in the state of emulsified dispersion and inhibiting of photographic property change and enhancing of aging stability with respect to a final coating composition after emulsion mixing.

The average particle size of thus obtained lipophilic fine particle dispersion is preferably in the range of 0.04 to 0.50 μm, more preferably 0.05 to 0.30 μm and most preferably 0.08 to 0.20 μm. The average particle size can be measured by the use of, for example, Coulter submicron particle analyzer model N4 (trade name, manufactured by Coulter Electronic).

As means for solid fine particle dispersion, there can be mentioned the method wherein powdery compounds of the present invention are dispersed in an appropriate solvent such as water with the use of a ball mill, a colloid mill, a vibration ball mill, a sand mill, a jet mill, a roller mill or ultrasonic so as to obtain a solid dispersion. During the dispersing, use can be made of a protective colloid (e.g., polyvinyl alcohol) or a surfactant (e.g., anionic surfactant such as sodium triisopropylbutanesulfonate (mixture of those whose three isopropyl substitution sites are different from each other)). In the above mills, beads such as those of zirconia are generally used as dispersing media. Thus, Zr, etc. leached from the beads may be mixed in the dispersion. The amount thereof is generally in the range of 1 to 1000 ppm although depending on dispersing conditions. When the content of Zr in photo-sensitive material is 0.5 mg or less per g of silver, there would occur practically no adverse effect. The water dispersion can be doped with an antiseptic (e.g., benzoisothiazolinone sodium salt).

In the present invention, in order to obtain a coagulation-free solid dispersion of high S/N and small grain size, use can be made of the dispersing method wherein a water dispersion liquid is converted to a high-velocity stream and thereafter a pressure drop is effected. The solid dispersing apparatus and technology employed for carrying out this dispersing method are described in detail in, for example, "Dispersion Rheology and Dispersing Technology" written by Toshio Kajiuchi and Hiroki Usui, pp. 357–403, Shinzansha Shuppan (1991) and "Progress of Chemical Engineering, 24th Series" edited by the corporate juridical person Society of Chemical Engineering, Tokai Chapter, pp.184–185, Maki Shoten (1990).

The addition amount of compounds of the present invention is preferably in the range of 0.1 to 1000 mg/m$^2$, more preferably 1 to 500 mg/m$^2$ and most preferably 5 to 100 mg/m$^2$. In the use in photo-sensitive silver halide emulsion layers, the addition amount is preferably in the range of $1\times10^{-3}$ to 1 mol, more preferably $1\times10^{-4}$ to $1\times10^{-1}$ mol and most preferably $1\times10^{-3}$ to $5\times10^{-2}$ mol per mol of silver contained in the same layer. Two or more compounds of the present invention may be used in combination. These compounds may be incorporated in the same layer or separate layers.

The pKa values of compounds of the present invention are those determined in the following manner. 0.5 milliliter (hereinafter also expressed as "mL") of 1 N sodium chloride is added to 100 mL of a solution dissolving 0.01 mmol of compound of the present invention in a 6:4 (mass ratio) mixture of tetrahydrofuran and water, and titrated with a 0.5 N aqueous potassium hydroxide solution under agitation in a nitrogen gas atmosphere. The pKa refers to the pH at the central position of inflexion point of titration curve having an axis of abscissas indicating the amount of aqueous potassium hydroxide solution dropped and an axis of ordinate indicating pH values. With respect to compounds having multiple dissociation sites, multiple inflexion points exist and multiple pKa values can be determined. Also, the inflexion point can be determined by monitoring ultraviolet/visible light absorption spectra and checking absorption changes.

Generally, the photographic speed depends on the size of silver halide emulsion grains. The larger the emulsion grains, the higher the photographic speed. However, the graininess is deteriorated in accordance with an increase of the size of silver halide grains. Therefore, the speed and the graininess fall in trade-off relationship.

The speed increase can be accomplished by the method of increasing coupler activity or the method of decreasing the amount of development inhibitor release coupler (DIR coupler) as well as the above increasing of the size of silver halide emulsion grains. However, when the speed increase is effected by these methods, graininess deterioration accompanies the same. These methods of changing of the size of emulsion grains, regulation of coupler activity and regulation of the amount of DIR coupler, in speed/graininess trade-off relationship, provide only "regulatory means" for deteriorating graininess while increasing speed, or improving graininess while lowering speed.

In the present invention, it is not intended to provide a method of speed increase accompanied by graininess deterioration matching the speed increase.

According to the present invention, there is provided a method of speed increase not accompanied by grainines deterioration, or a method of speed increase wherein the speed increase is conspicuous as compared with graininess deterioration. In the present invention, when speed increase and graininess deterioration simultaneously occur, speed comparison is effected after graininess matching conducted by the above "regulatory means" to thereby find a substantial speed increase.

The substantial speed increase is defined as a speed difference of 0.02 or greater exhibited when photo-sensitive materials are exposed through continuous wedge and speeds in terms of the logarithm of inverse number of exposure intensity realizing minimum density+0.5 are compared.

It is preferred that the photo-sensitive material of the present invention contain "a compound which undergoes a one-electron oxidation so as to form a one-electron oxidation product capable of releasing one or more electrons".

This compound is preferably selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can-be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in Japanese Patent Application 2003-25886) and the general formula (9) (identical with the general formula (3) described in JP-A-2003-33446) among the compounds of inducing the reaction represented by the chemical reaction formula (1) (identical with the chemical reaction formula (1) described in Japanese Patent Application 2003-33446). Preferred ranges of these compounds are the same as described in the cited patent specifications.

General formula (1)

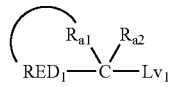

General formula (2)

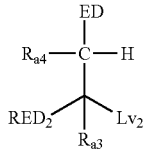

In the general formulae (1) and (2), each of $RED_1$ and $RED_2$ represents a reducing group. $R_{a1}$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_{a2}$, $R_{a3}$ and $R_{a4}$ represents a hydrogen atom or a substituent. Each of $L_{v1}$ and $L_{v2}$ represents a split off group. ED represents an electron donating group.

General formula (3)

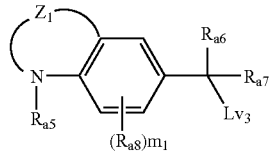

General formula (4)

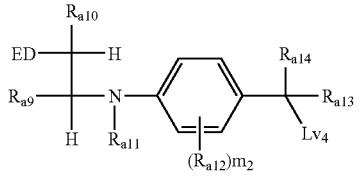

General formula (5)

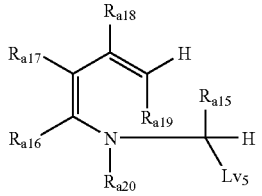

In the general formulae (3), (4) and (5), $Z_1$ represents an atomic group capable of forming a 6-membered ring in cooperation with a nitrogen atom and two carbon atoms of benzene ring. Each of $R_{a1}$, $R_{a6}$, $R_{a7}$, $R_{a9}$, $R_{a10}$, $R_{a11}$, $R_{a13}$, $R_{a14}$, $R_{a15}$, $R_{a6}$, $R_{a17}$, $R_{a18}$ and $R_{a19}$ represents a hydrogen atom or a substituent. $R_{a20}$ represents a hydrogen atom or a substituent, provided that when $R_{a20}$ represents a non-aryl group, $R_{a16}$ and $R_{a17}$ are bonded to each other to thereby form an aromatic ring or aromatic heterocycle. Each of $R_{a8}$ and $R_{a12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

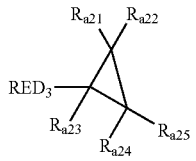

General formula (7)

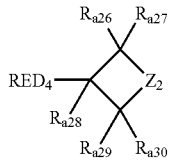

In the general formulae (6) and (7), each of $RED_3$ and $RED_4$ represents a reducing group. Each of $R_{a21}$ to $R_{a30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

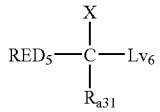

In the general formula (8), $RED_5$ is a reducing group, representing an arylamino group or a heterocyclic amino group. $R_{a31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

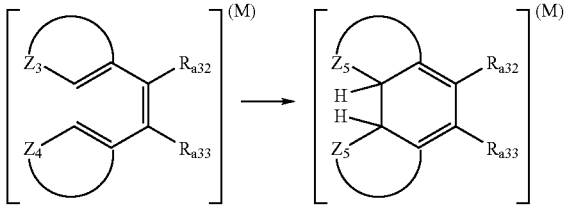

General formula (9)

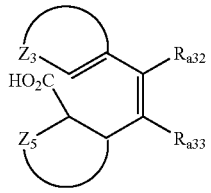

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{a32}$ and $R_{a33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{a32}$, $R_{a33}$ and $Z_3$ have the same meaning as in the chemical reaction formula (1). $Z_5$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in Japanese Patent Application 2003-33446) capable of inducing the reaction represented by the chemical reaction formula (1) (identical with the chemical reaction formula (1) described in Japanese Patent Application 2003-33446). Preferred ranges of these compounds are the same as described in the cited patent specifications.

$RED_6$-*Q*-*Y* General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

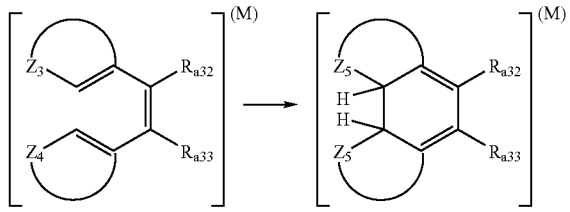

General formula (11)

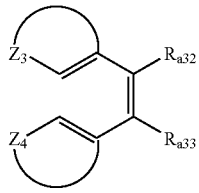

The compound represented by the general formula (11) is one oxidized to thereby effect a bond forming reaction of chemical reaction formula (1). In the chemical reaction formula (1), each of $R_{a32}$ and $R_{a33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. $Z_5$ represents a group capable of forming a 5- or 6-membered cycloaliphatic hydrocarbon group or heterocyclic ring in cooperation with C—C. M represents a radical, a radical cation or a cation. In the general formula (11), $R_{a32}$, $R_{a33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, a perchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, prefer-red structures can be represented by the general formula (X).

$$(P\text{-}Q_1\text{-})_i\text{—R}(\text{-}Q_2\text{-S})_j \qquad \text{General formula } (X)$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of LO to 100, more preferably 10 to 70, still more preferably 11 to 60, and most preferably 12 to 50.

The compounds of type 1 and type 2 according to the present invention may be added at any stage during the emulsion preparation or photo-sensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

The present invention can be applied to not only black-and-white printing paper, black-and-white negative film and X-ray film but also various color lightsensitive materials such as color negative film for general purposes or cinema, color reversal film for slide or TV, color paper, color positive film and color reversal paper. Moreover, the present invention is suitable to lens equipped film units described in JP-B-2-32615 and Jpn. Utility Model Appln. KOKOKU Publication No. 3-39784.

Supports which can be appropriately used in the present invention are described in, e.g., the aforementioned RD. No. 17643, page 28; RD. No. 18716, from the right column of page 647 to the left column of page 648; and RD. No. 307105, page 879.

In the lightsensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

The lightsensitive material according to the present invention can be developed by conventional methods described in the aforementioned RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more-preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges from 80 to 1300 mL per $m^2$ of the lightsensitive material, the employment of smaller amount is desirable from the viewpoint of reduction of environmental pollution load. Specifically, the amount of the replenisher more preferably ranges from 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

Where C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Color reversal film processing solutions used in the present invention will be described below.

Processing for a color reversal film is described in detail in Aztech Ltd., Known Technology No. 6 (Apr. 1, 1991), page 1, line 5 to page 10, line 5 and page 15, line 8 to page 24, line 2, and any of the contents can be preferably applied.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | do | |
| 3. Spectral sensitizers, super sensitizers | pages 23–24 | page 648, right column to page 649, right column | pages 866–868 |
| 4. Brighteners | page 24 | page 647, right column | page 868 |

-continued

| Additives | RD17643 | RD18716 | RD307105 |
|---|---|---|---|
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surface active agents | pages 26–27 | do | pages 875–876 |
| 9. Antistatic agents | page 27 | do | pages 876–877 |
| 10. Matting agents | | | pages 878–879 |

Techniques such as a layer arrangement technique, silver halide emulsions, dye forming couplers, functional couplers such as DIR couplers, various additives, and development usable in silver halide photographic light-sensitive materials of the present invention are described in European Patent No. 0565096A1 (laid open in Oct. 13, 1993) and the patents cited in it, the disclosures of which are incorporated herein by reference. The individual items and the corresponding portions are enumerated below.

1. Layer arrangements: page 61, lines 23–35, page 61, line 41-page 62, line 14
2. Interlayers: page 61, lines 36–40
3. Interlayer effect donor layers: page 62, lines 5–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54-page 63, line 5
12. Physical ripening and chemical sensitization of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2.
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54-page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Light-sensitive layer film thickness and swell speed: page 66, line 40-page 67, line 1
34. Back layers: page 67, lines 3–8
35. General development processing: page 67, lines 9–11
36. Developers and developing agents: page 67, lines 12–30
37. Developer additives: page 67, lines 31–44.
38. Reversal processing: page 67, lines 45–56
39. Processing solution aperture ratio: page 67, line 57-page 68, line 12
40. Development time: page 68, lines 13–15
41. Bleach-fix, bleaching, and fixing: page 68, line 16-page 69, line 31
42. Automatic processor: page 69, lines 32–40
43. Washing, rinsing, and stabilization: page 69, line 41-page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

With respect to the technologies, such as those regarding a bleaching solution, a magnetic recording layer, a polyester support and an antistatic agent, that are applicable to the silver halide photosensitive material of the present invention and with respect to the utilization of the present invention in Advanced Photo System, etc., reference can be made to US 2002/0042030 A1 (published on Apr. 11, 2002) and patents cited therein. Individual items and the locations where they are described will be listed below.

1. Bleaching solution: page 15 [0206];
2. Magnetic recording layer and magnetic particles: page 16 [0207] to [0213];
3. Polyester support: page 16 [0214] to page 17 [0218];
4. Antistatic agent: page 17 [0219] to [0221];
5. Sliding agent: page 17 [0222];
6. Matte agent: page 17 [0224];
7. Film cartridge: page 17 [0225] to page 18 [0227];
8. Use in Advanced Photo System: page 18 [0228], and [0238] to [0240];
9. Use in lens-equipped film: page 18 [0229]; and
10. Processing by minilab system: page 18 [0230] to [0237].

Examples of the present invention will be described below, which, however, in no way limit the scope of the present invention.

EXAMPLE 1

Silver halide emulsions Em-A1 to Em-O1 specified in Table 1, silver halide emulsions Em-A2 to Em-O2 specified in Table 2 and silver halide emulsions Em-A3 to Em-O3 specified in Table 3 were prepared in the same manner as employed in the process for preparing emulsions Em-A to Em-O described in Example 1 of JP-A-2001-281815, except that the amounts of nucleation silver and gelatin were changed. Further, the regular-crystal emulsions Em-P1 to Em-P5 specified in Table 4 were prepared.

TABLE 1

| Emulsion name | Average silver iodide content (mol %) | Average equivalent-sphere diameter (μm) | Average aspect ratio | Average equivalent-circle diameter (μm) | Average grain thickness (μm) | Halide composition | Shape |
|---|---|---|---|---|---|---|---|
| Em-A1 | 4 | 0.85 | 9 | 1.54 | 0.17 | Silver iodobromide | Tabular |
| Em-B1 | 4.7 | 0.74 | 8 | 1.29 | 0.16 | Silver iodobromide | Tabular |
| Em-C1 | 3.5 | 0.51 | 7 | 0.85 | 0.12 | Silver iodobromide | Tabular |
| Em-D1 | 3.7 | 0.35 | 3 | 0.44 | 0.15 | Silver iodobromide | Tabular |
| Em-E1 | 5 | 0.71 | 8 | 1.24 | 0.15 | Silver iodobromide | Tabular |
| Em-F1 | 4.2 | 0.58 | 8 | 1.01 | 0.13 | Silver iodobromide | Tabular |
| Em-G1 | 4.7 | 0.54 | 6 | 0.86 | 0.14 | Silver iodobromide | Tabular |
| Em-H1 | 4.8 | 0.51 | 6.2 | 0.82 | 0.13 | Silver iodobromide | Tabular |
| Em-I1 | 2.9 | 0.45 | 3.6 | 0.60 | 0.17 | Silver iodobromide | Tabular |
| Em-J1 | 4.6 | 0.75 | 8 | 1.31 | 0.16 | Silver iodobromide | Tabular |
| Em-K1 | 3.7 | 0.39 | 3 | 0.49 | 0.16 | Silver iodobromide | Tabular |
| Em-L1 | 6.9 | 0.68 | 8 | 1.19 | 0.15 | Silver iodobromide | Tabular |
| Em-M1 | 7.6 | 0.5 | 4 | 0.69 | 0.17 | Silver iodobromide | Tabular |
| Em-N1 | 1.9 | 0.37 | 4.6 | 0.54 | 0.12 | Silver iodobromide | Tabular |
| Em-O1 | 1.8 | 0.19 | — | — | — | Silver iodobromide | Cubic |

TABLE 2

| Emulsion name | Average silver iodide content (mol %) | Average equivalent-sphere diameter (μm) | Average aspect ratio | Average equivalent-circle diameter (μm) | Average grain thickness (μm) | Halide composition | Shape |
|---|---|---|---|---|---|---|---|
| Em-A2 | 4 | 0.74 | 6 | 1.17 | 0.20 | Silver iodobromide | Tabular |
| Em-B2 | 4.7 | 0.65 | 6 | 1.03 | 0.17 | Silver iodobromide | Tabular |
| Em-C2 | 3.5 | 0.4 | 5 | 0.60 | 0.12 | Silver iodobromide | Tabular |
| Em-D2 | 3.7 | 0.3 | 3 | 0.38 | 0.13 | Silver iodobromide | Tabular |
| Em-E2 | 5 | 0.62 | 5 | 0.93 | 0.19 | Silver iodobromide | Tabular |
| Em-F2 | 4.2 | 0.5 | 5 | 0.75 | 0.15 | Silver iodobromide | Tabular |
| Em-G2 | 4.7 | 0.45 | 4 | 0.62 | 0.16 | Silver iodobromide | Tabular |
| Em-H2 | 4.8 | 0.4 | 4 | 0.55 | 0.14 | Silver iodobromide | Tabular |
| Em-I2 | 2.9 | 0.45 | 3 | 0.57 | 0.19 | Silver iodobromide | Tabular |
| Em-J2 | 4.6 | 0.6 | 5 | 0.90 | 0.18 | Silver iodobromide | Tabular |
| Em-K2 | 3.7 | 0.34 | 3 | 0.43 | 0.14 | Silver iodobromide | Tabular |
| Em-L2 | 6.9 | 0.6 | 5 | 0.90 | 0.18 | Silver iodobromide | Tabular |
| Em-M2 | 7.6 | 0.4 | 3 | 0.50 | 0.17 | Silver iodobromide | Tabular |
| Em-N2 | 1.9 | 0.31 | 2 | 0.34 | 0.17 | Silver iodobromide | Tabular |
| Em-O2 | 1.8 | 0.19 | — | — | — | Silver iodobromide | Cubic |

TABLE 3

| Emulsion name | Average silver iodide content (mol %) | Average equivalent-sphere diameter (μm) | Average aspect ratio | Average equivalent-circle diameter (μm) | Average grain thickness (μm) | Halide composition | Shape |
|---|---|---|---|---|---|---|---|
| Em-A3 | 4 | 0.74 | 12 | 1.48 | 0.12 | Silver iodobromide | Tabular |
| Em-B3 | 4.7 | 0.65 | 10 | 1.22 | 0.12 | Silver iodobromide | Tabular |
| Em-C3 | 3.5 | 0.4 | 7 | 0.67 | 0.10 | Silver iodobromide | Tabular |
| Em-D3 | 3.7 | 0.3 | 5 | 0.45 | 0.09 | Silver iodobromide | Tabular |
| Em-E3 | 5 | 0.62 | 13 | 1.27 | 0.10 | Silver iodobromide | Tabular |
| Em-F3 | 4.2 | 0.5 | 9 | 0.91 | 0.10 | Silver iodobromide | Tabular |
| Em-G3 | 4.7 | 0.45 | 8 | 0.79 | 0.10 | Silver iodobromide | Tabular |
| Em-H3 | 4.8 | 0.4 | 8 | 0.70 | 0.09 | Silver iodobromide | Tabular |
| Em-I3 | 2.9 | 0.45 | 6 | 0.71 | 0.12 | Silver iodobromide | Tabular |
| Em-J3 | 4.6 | 0.6 | 10 | 1.13 | 0.11 | Silver iodobromide | Tabular |
| Em-K3 | 3.7 | 0.34 | 4 | 0.47 | 0.12 | Silver iodobromide | Tabular |
| Em-L3 | 6.9 | 0.6 | 11 | 1.16 | 0.11 | Silver iodobromide | Tabular |
| Em-M3 | 7.6 | 0.4 | 5 | 0.60 | 0.12 | Silver iodobromide | Tabular |
| Em-N3 | 1.9 | 0.31 | 3 | 0.39 | 0.13 | Silver iodobromide | Tabular |
| Em-O3 | 1.8 | 0.19 | — | — | — | Silver iodobromide | Cubic |

TABLE 4

| Emulsion name | Average silver iodide content (mol %) | Average equivalent-sphere diameter (μm) | Halide composition | Shape |
|---|---|---|---|---|
| Em-P1 | 2 | 0.6 | Silver iodobromide | Cubic |
| Em-P2 | 2 | 0.48 | Silver iodobromide | Cubic |
| Em-P3 | 2 | 0.38 | Silver iodobromide | Cubic |
| Em-P4 | 2 | 0.28 | Silver iodobromide | Cubic |
| Em-P5 | 2 | 0.08 | Silver iodobromide | Cubic |

In the tabular grains of Tables 1 to 3, dislocation lines as described in JP-A-3-237450 are observed through a high-voltage electron microscope.

(Preparation of Sample 001)

Multilayer coating of a cellulose triacetate support was effected with the following compositions, thereby obtaining a color negative film (sample 001).

(Compositions of Light-sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.080 |
| Silver iodobromide emulsion grain (average equivalent-sphere diameter 0.07 μm, silver iodide content 1 mol %) | silver | 0.008 |
| Gelatin | | 0.603 |
| ExC-1 | | 0.002 |
| ExC-3 | | 0.001 |
| ExM-1 | | 0.005 |
| Cpd-2 | | 0.002 |
| HBS-1 | | 0.076 |
| HBS-2 | | 0.003 |
| F-8 | | 0.001 |
| H-1 | | 0.004 |
| H-2 | | 0.004 |
| 2nd layer (2nd antihalation layer) | | |
| Black colloidal silver | silver | 0.040 |
| Gelatin | | 0.450 |
| ExC-6 | | 0.004 |
| ExC-9 | | 0.005 |
| ExY-1 | | 0.055 |
| ExF-1 | | 0.003 |
| Solid disperse dye ExF-9 | | 0.090 |
| HBS-1 | | 0.055 |
| F-8 | | 0.002 |
| 3rd layer (Interlayer) | | |
| Cpd-1 | | 0.095 |
| UV-1 | | 0.002 |
| UV-5 | | 0.005 |

-continued

| | | |
|---|---|---|
| HBS-1 | | 0.051 |
| Gelatin | | 0.450 |
| 4th layer (Low-speed red-sensitive emulsion layer) | | |
| Em-D1 | silver | 0.400 |
| Em-C1 | silver | 0.220 |
| ExC-1 | | 0.150 |
| ExC-2 | | 0.060 |
| ExC-3 | | 0.080 |
| ExC-4 | | 0.090 |
| ExC-5 | | 0.035 |
| ExC-6 | | 0.044 |
| ExC-8 | | 0.012 |
| Cpd-2 | | 0.009 |
| Cpd-4 | | 0.025 |
| Cpd-6 | | 0.002 |
| HBS-1 | | 0.248 |
| HBS-5 | | 0.010 |
| Gelatin | | 2.825 |
| 5th layer (Medium-speed red-sensitive emulsion layer) | | |
| Em-B1 | silver | 0.185 |
| Em-C1 | silver | 0.721 |
| ExC-1 | | 0.043 |
| ExC-2 | | 0.065 |
| ExC-3 | | 0.034 |
| ExC-4 | | 0.010 |
| ExC-5 | | 0.020 |
| ExC-6 | | 0.037 |
| ExC-7 | | 0.036 |
| ExC-8 | | 0.021 |
| ExC-9 | | 0.009 |
| Cpd-2 | | 0.004 |
| Cpd-4 | | 0.036 |
| Cpd-6 | | 0.050 |
| HBS-1 | | 0.108 |
| Gelatin | | 0.659 |
| 6th layer (High-speed red-sensitive emulsion layer) | | |
| Em-A1 | silver | 0.651 |
| ExC-1 | | 0.065 |
| ExC-2 | | 0.003 |
| ExC-3 | | 0.005 |
| ExC-6 | | 0.021 |
| ExC-7 | | 0.096 |
| ExC-9 | | 0.009 |
| Cpd-2 | | 0.090 |
| Cpd-4 | | 0.055 |
| Cpd-6 | | 0.066 |
| HBS-1 | | 0.221 |
| HBS-2 | | 0.009 |
| Gelatin | | 1.001 |
| 7th layer (Interlayer) | | |
| Cpd-1 | | 0.063 |
| Cpd-7 | | 0.118 |
| S-1 | | 0.009 |
| Solid disperse dye ExF-4 | | 0.015 |
| HBS-1 | | 0.063 |
| Polyethylacrylate latex | | 0.033 |
| Gelatin | | 0.592 |
| 8th layer (layer for donating interlayer effect to red-sensitive layer) | | |
| Em-J1 | silver | 0.223 |
| Em-K1 | silver | 0.016 |
| ExM-2 | | 0.059 |
| ExM-3 | | 0.038 |
| ExM-4 | | 0.009 |
| ExY-1 | | 0.042 |
| ExY-6 | | 0.032 |
| ExC-9 | | 0.011 |
| Cpd-2 | | 0.009 |
| Cpd-6 | | 0.011 |
| HBS-1 | | 0.196 |
| HBS-3 | | 0.003 |
| HBS-5 | | 0.012 |
| Gelatin | | 0.496 |

-continued

| | | |
|---|---|---|
| 9th layer (Low-speed green-sensitive emulsion layer) | | |
| Em-H1 | silver | 0.563 |
| Em-G1 | silver | 0.011 |
| Em-I1 | silver | 0.421 |
| ExM-1 | | 0.012 |
| ExM-2 | | 0.251 |
| ExM-3 | | 0.047 |
| ExM-4 | | 0.032 |
| ExM-5 | | 0.003 |
| ExY-1 | | 0.003 |
| ExY-5 | | 0.023 |
| ExC-9 | | 0.003 |
| HBS-1 | | 0.201 |
| HBS-2 | | 0.004 |
| HBS-3 | | 0.015 |
| HBS-4 | | 0.177 |
| HBS-5 | | 0.148 |
| Cpd-5 | | 0.004 |
| Gelatin | | 0.992 |
| 10th layer (Medium-speed green-sensitive emulsion layer) | | |
| Em-F1 | silver | 0.421 |
| Em-G1 | silver | 0.496 |
| ExM-1 | | 0.005 |
| ExM-2 | | 0.031 |
| ExM-3 | | 0.030 |
| ExM-4 | | 0.116 |
| ExM-5 | | 0.035 |
| ExY-1 | | 0.012 |
| ExY-5 | | 0.010 |
| ExC-6 | | 0.012 |
| ExC-7 | | 0.005 |
| ExC-8 | | 0.031 |
| ExC-9 | | 0.012 |
| HBS-1 | | 0.062 |
| HBS-3 | | 0.002 |
| HBS-4 | | 0.082 |
| HBS-5 | | 0.004 |
| Cpd-2 | | 0.010 |
| Cpd-5 | | 0.002 |
| Cpd-6 | | 0.003 |
| Gelatin | | 0.962 |
| 11th layer (High-speed green-sensitive emulsion layer) | | |
| Em-E1 | silver | 0.335 |
| ExC-6 | | 0.002 |
| ExC-7 | | 0.015 |
| ExM-1 | | 0.015 |
| ExM-2 | | 0.202 |
| ExM-3 | | 0.008 |
| ExM-4 | | 0.043 |
| ExM-6 | | 0.032 |
| ExY-1 | | 0.009 |
| Cpd-3 | | 0.001 |
| Cpd-4 | | 0.003 |
| Cpd-5 | | 0.012 |
| Cpd-6 | | 0.003 |
| HBS-1 | | 0.054 |
| HBS-3 | | 0.001 |
| HBS-4 | | 0.011 |
| HBS-5 | | 0.017 |
| S-1 | | 0.021 |
| Polyethylacrylate latex | | 0.015 |
| Gelatin | | 0.328 |
| 12th layer (Yellow filter layer) | | |
| Yellow colloidal silver | Silver | 0.030 |
| Cpd-1 | | 0.092 |
| Solid disperse dye ExF-2 | | 0.004 |
| Solid disperse dye ExF-5 | | 0.005 |
| Oil-soluble dye ExF-7 | | 0.002 |
| HBS-1 | | 0.110 |
| Gelatin | | 1.221 |
| 13th layer (Low-speed blue-sensitive emulsion layer) | | |
| Em-O1 | silver | 0.213 |
| Em-M1 | silver | 0.195 |
| Em-N1 | silver | 0.095 |

-continued

| | | |
|---|---|---|
| ExC-1 | | 0.006 |
| ExC-3 | | 0.009 |
| ExY-1 | | 0.032 |
| ExY-2 | | 0.226 |
| ExY-6 | | 0.009 |
| ExY-7 | | 0.492 |
| ExC-9 | | 0.005 |
| Cpd-2 | | 0.032 |
| Cpd-3 | | 0.001 |
| Cpd-4 | | 0.002 |
| HBS-1 | | 0.222 |
| HBS-5 | | 0.009 |
| Gelatin | | 1.558 |
| 14th layer (High-speed blue-sensitive emulsion layer) | | |
| Em-L1 | silver | 0.431 |
| ExY-1 | | 0.008 |
| ExY-2 | | 0.042 |
| ExY-6 | | 0.021 |
| ExY-7 | | 0.100 |
| ExC-1 | | 0.039 |
| ExC-9 | | 0.003 |
| Cpd-2 | | 0.021 |
| Cpd-3 | | 0.001 |
| Cpd-6 | | 0.021 |
| UV-5 | | 0.005 |
| HBS-1 | | 0.051 |
| Gelatin | | 0.481 |
| 15th layer (1st protective layer) | | |
| silver iodobromide emulsion grain (Average equivalent-sphere diameter 0.07 μm, Average silver iodide content 1 mol %) | silver | 0.189 |
| ExF-10 | | 0.002 |
| ExF-11 | | 0.004 |
| ExF-12 | | 0.003 |
| UV-1 | | 0.150 |
| UV-2 | | 0.012 |
| UV-3 | | 0.092 |
| UV-4 | | 0.032 |
| UV-5 | | 0.143 |
| F-11 | | 0.021 |
| S-1 | | 0.048 |
| HBS-1 | | 0.009 |
| HBS-4 | | 0.017 |
| Gelatin | | 1.110 |
| 16th layer (2nd protective layer) | | |
| H-1 | | 0.100 |
| H-2 | | 0.100 |
| B-1 (diameter 1.7 μm) | | 0.050 |
| B-2 (diameter 1.7 μm) | | 0.150 |
| B-3 | | 0.030 |
| W-5 | | 0.025 |
| W-1 | | $3.0 \times 10^{-3}$ |
| W-2 | | $3.0 \times 10^{-3}$ |
| W-3 | | $1.0 \times 10^{-3}$ |
| W-4 | | $0.5 \times 10^{-3}$ |
| Gelatin | | 0.702 |

In addition to the above components, to improve the storage stability, processability, resistance to pressure, antiseptic and mildewproofing properties, antistatic properties, and coating properties, the individual layers contained B-4 to B-6, F-1 to F-18, lead salt, platinum salt, iridium salt, and rhodium salt.

Preparation of Dispersions of Organic Solid Disperse Dyes

Solid disperse dye ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total (pH was adjusted to 7.2 by NaOH) | 7.210 kg |

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid disperse dye. The average grain size of the fine dye grains was 0.29 μm.

Following the same procedure as above, solid disperse dyes ExF-4 and ExF-9 were obtained. The average grain sizes of the fine dye grains were 0.28 and 0.49 μm, respectively. ExF-5 was dispersed by a microprecipitation dispersion method described in Example 1 of EP 549,489A, the disclosure of which is incorporated herein by reference. The average grain size was found to be 0.06 μm.

ExC-1

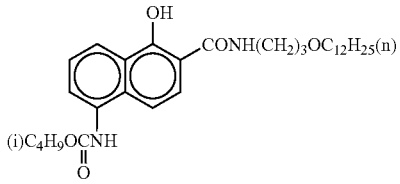

ExC-2

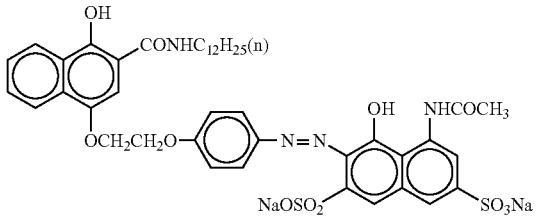

ExC-3

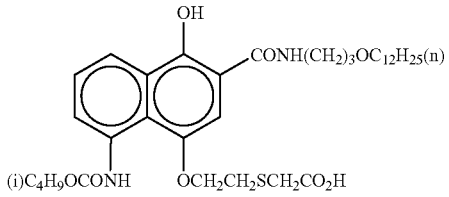

ExC-4

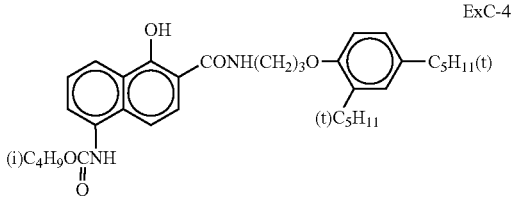

ExC-5

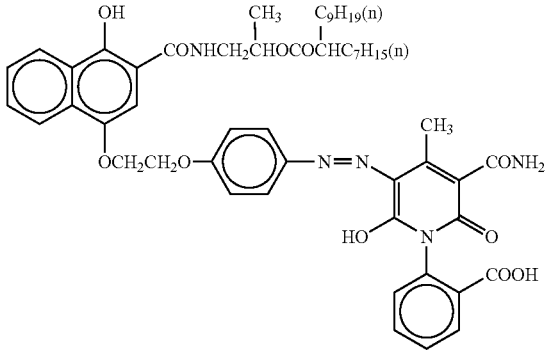

ExC-6

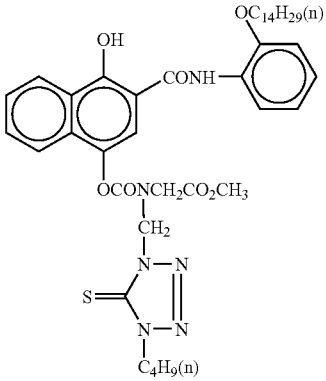

ExC-7

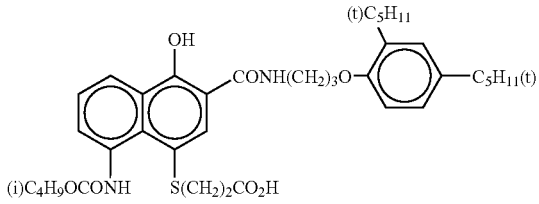

ExC-8

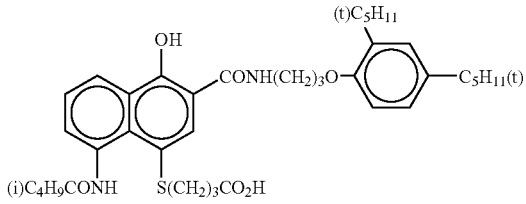

-continued
ExC-9
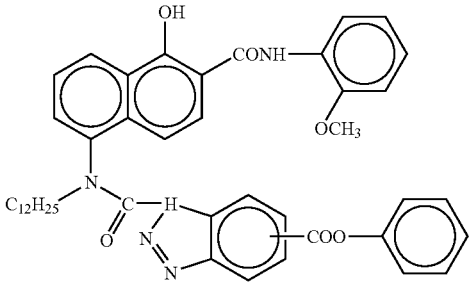
ExM-1
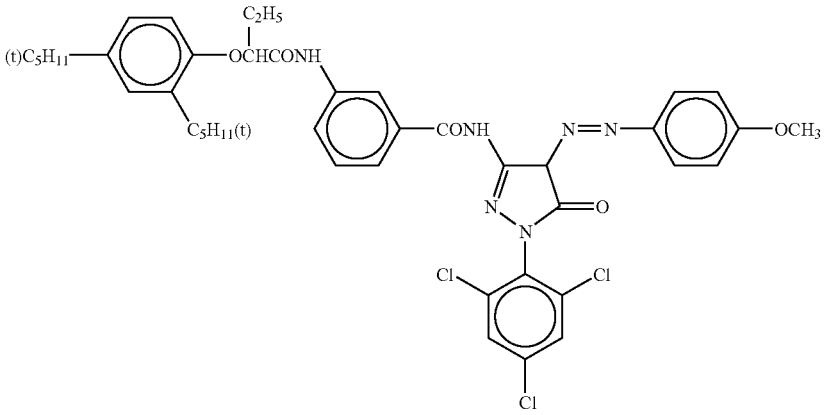
ExM-2
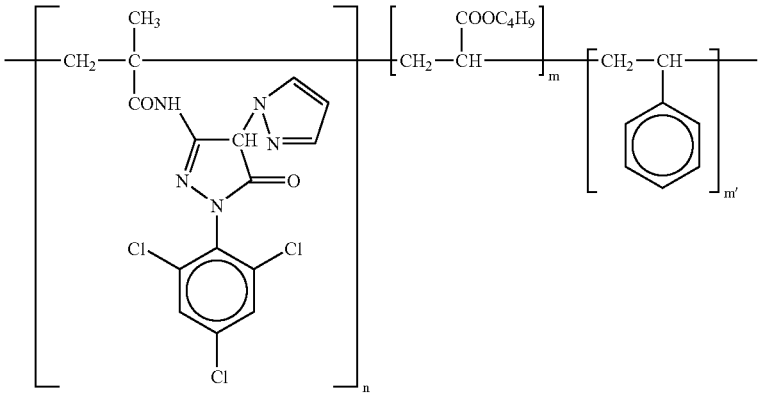
n = 50
m = 25
m′ = 25
Mol. Wt. about 20,000
ExM-3
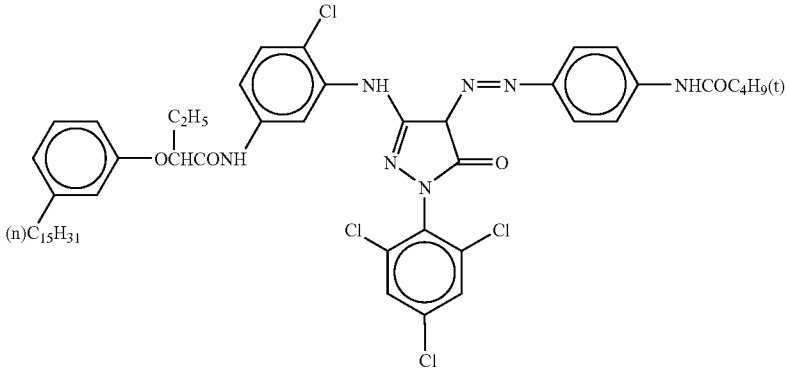

-continued
ExM-4
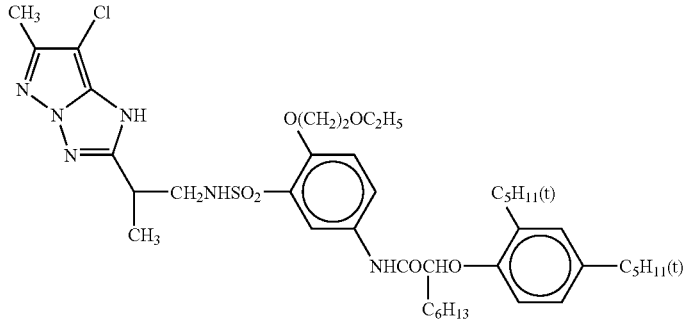
ExM-5
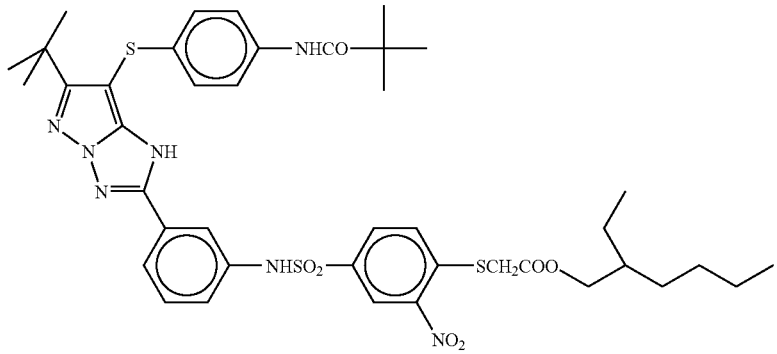
ExM-6
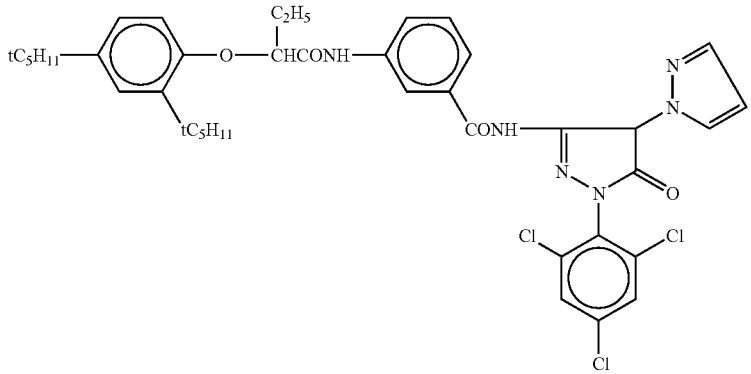
ExY-1
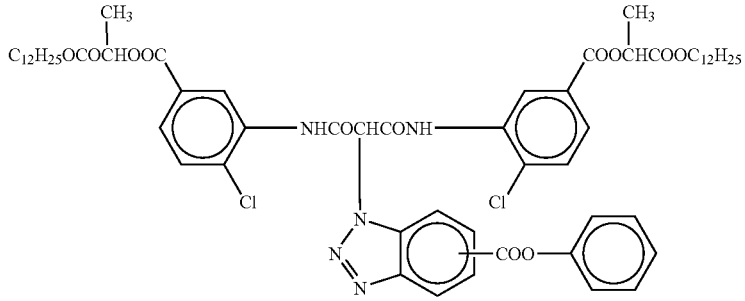

-continued
ExY-2
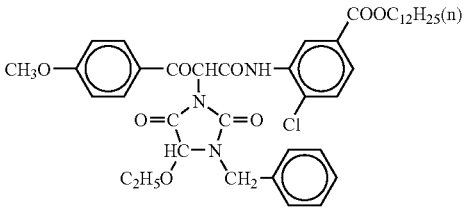
ExY-5
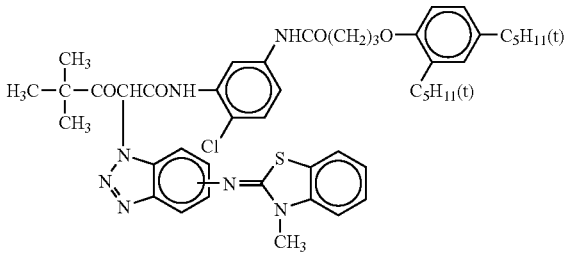
ExY-6
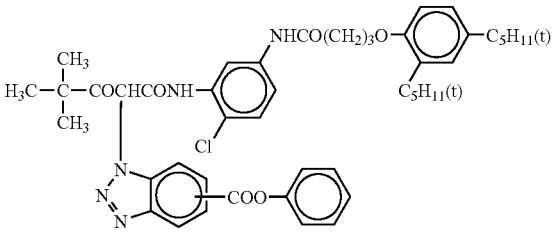
ExY-7
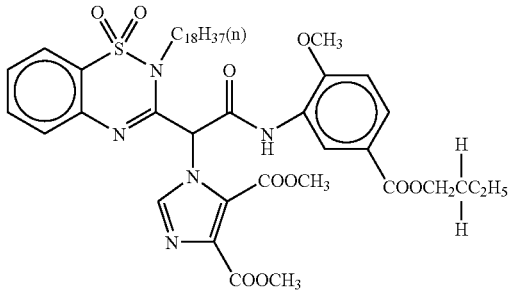
Cpd-1
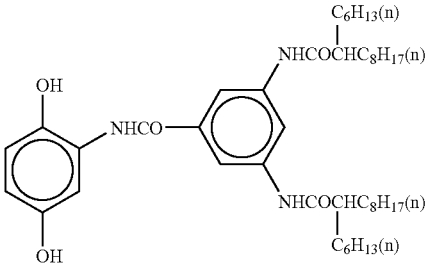
Cpd-2
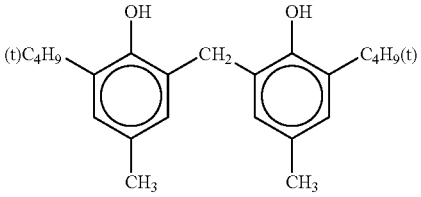
Cpd-3
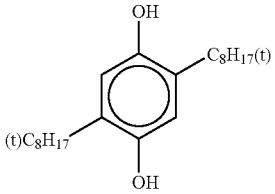
Cpd-4
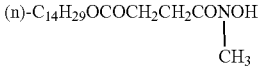
Cpd-5
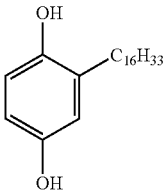
Cpd-6
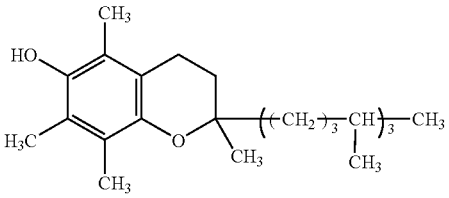
UV-1
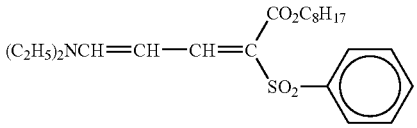
UV-2
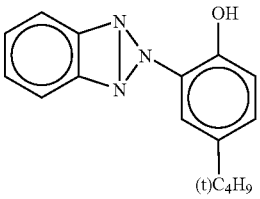

-continued
UV-3
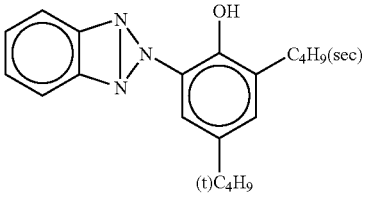
UV-4
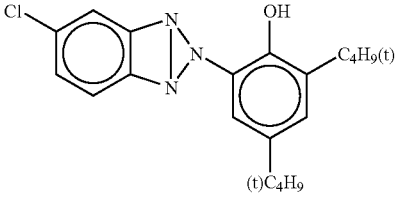
UV-5
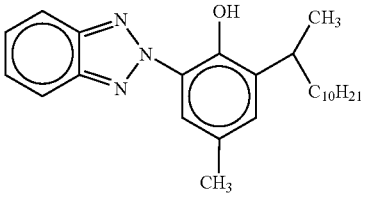
B-1
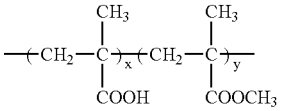
x/y = 10/90 (mass ratio)
Weight-average molecular weight:about 35,000
B-2
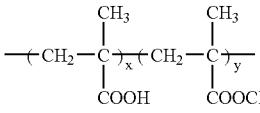
x/y = 40/60 (mass ratio)
Weight-average molecular weight:about 20,000
B-3
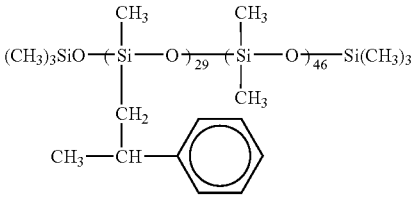
(molar ratio)
Weight-average molecular weight:about 8,000
H-1
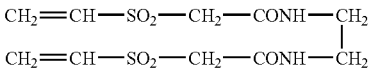
H-2
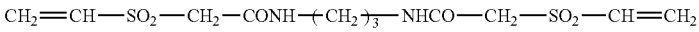
HBS-1
Tricresyl phosphate
HBS-2
Di-n-butyl phthalate
HBS-3
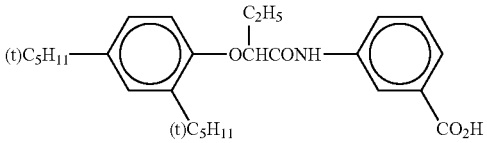
HBS-4
Tri(2-ethylhexyl) phosphate
HBS-5
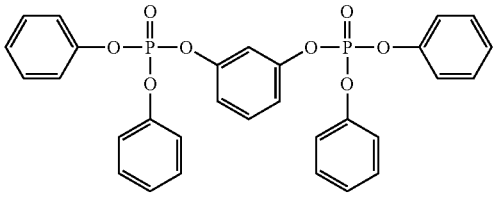
F-1
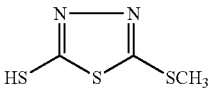
F-2
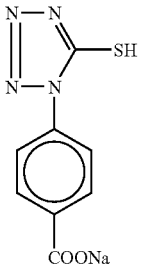
F-3
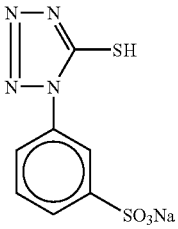

-continued
F-4
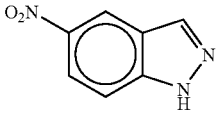
F-5
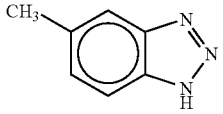
F-6
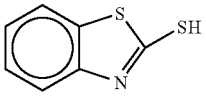
F-7
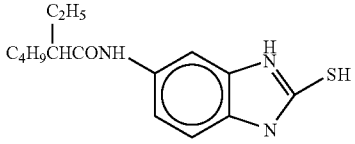
F-8
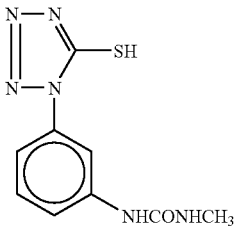
F-9
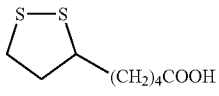
F-10
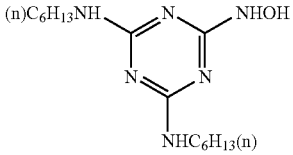
F-11
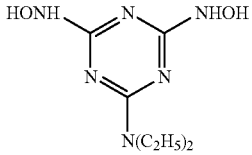
F-12
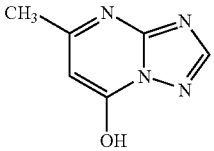
F-13
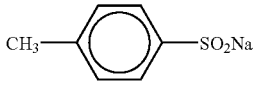
F-14
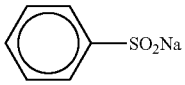
F-15
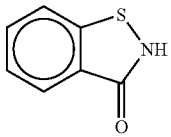
F-16
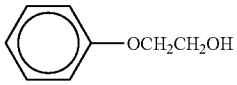
F-17
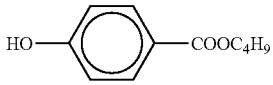
F-18
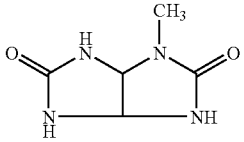
S-1
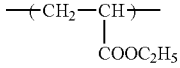
W-1
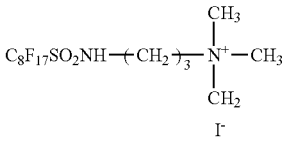
W-2
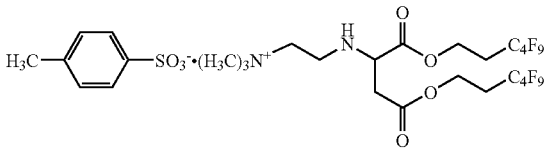
W-3
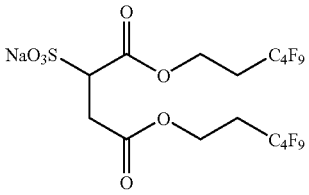
W-4
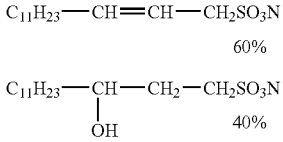

-continued
W-5
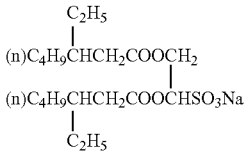
B-4
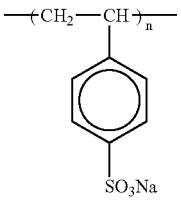
Weight-average molecular weight:about 750,000
B-5
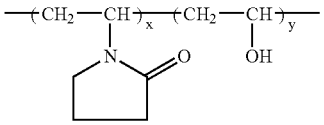
x/y = 70/30 (mass ratio)
Weight-average molecular weight:about 17,000
B-6
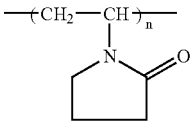
Weight-average molecular weight:about 10,000
Cpd-7
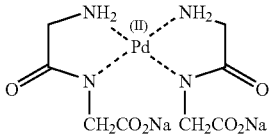
ExF-1
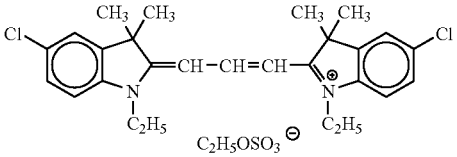
ExF-2
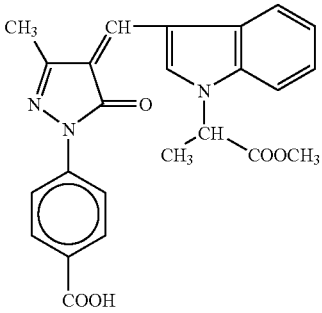
ExF-4
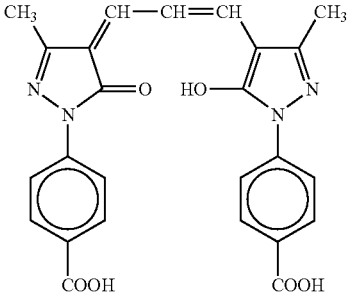
ExF-5
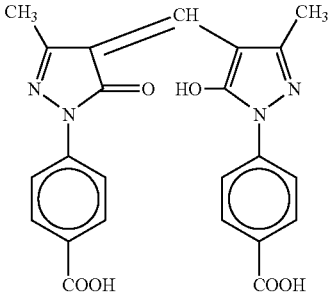
ExF-7
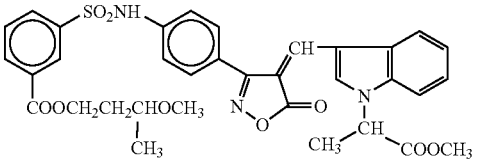
ExF-9
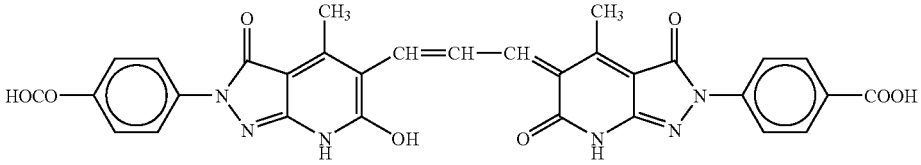

-continued

ExF-10

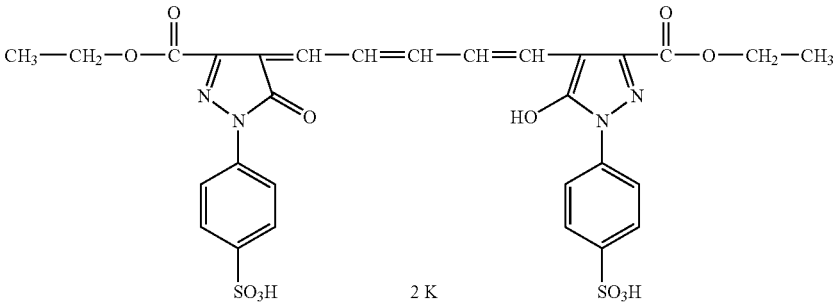

2 K

ExF-11

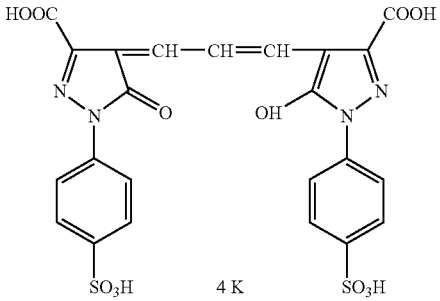

4 K

ExF-12

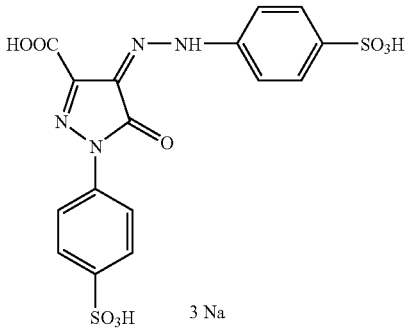

3 Na

The processing steps and the processing solution compositions are presented below.

(Processing Steps)

| Step | Time | Temperature | Replenishment rate* | Tank volume |
|---|---|---|---|---|
| Color development | 3 mi 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35 mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |

-continued

| | [Tank solution] (g) | [Replenisher] (g) |
|---|---|---|
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution | | |
| pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

Color negative photo-sensitive material wherein the emulsions Em-A1 to O1 of sample 101 were respectively replaced by emulsions Em-A2 to $O_2$ is referred to as sample 201. Color negative photo-sensitive material wherein the emulsions Em-A1 to O1 of sample 101 were respectively replaced by emulsions Em-A3 to 03 is referred to as sample 301. In each of the samples 101, 201 and 301, the coating amount of silver was 5.9 g/$m^2$.

With respect to the samples 101 to 301, samples wherein portions of the emulsions of 6th layer (high-speed red-sensitive emulsion layer), 11th layer (high-speed green-sensitive emulsion layer) and 14th layer (high-speed blue-sensitive emulsion layer) were replaced by emulsions Em-P1 to P5 at constant silver coating amount were prepared, and the specified speed and bright acuity of each thereof were measured. The emulsions Em-P1 to P5 were spectrally sensitized by the sensitizing dyes of relevant layers. The bright acuity was measured with respect to each of the samples having undergone 1/100 white exposure writing of an MTF assessment pattern through Gelatin Filter SC-39 manufactured by Fuji Photo Film Co., Ltd. and the aforementioned color development processing, and expressed as a relative value to sample 101. The larger the value, the favorably higher the bright acuity. The results are listed in Table 5.

TABLE 5

| | | | 6th layer (high-speed red-sensitive emulsion layer) | | | | 11th layer (high-speed green-sensitive emulsion layer) | | | |
|---|---|---|---|---|---|---|---|---|---|---|
| Sample | | Base sample | Regular crystal emulsion | Amt. used (ratio to amt. of 6th layer Ag) (%) | Projected area ratio of grains of ≧AR8 (%) | Projected area ratio of 0.1–0.5 μm regular crystal grains (%) | Regular-crystal emulsion | Amt. used (ratio to amt. of 11th layer Ag) (%) | Projected area ratio of grains of ≧AR8 (%) | Projected area ratio of 0.1–0.5 μm regular crystal grains (%) |
| 101 | Comp. | 101 | — | 0.0 | 85 | 0 | — | 0.0 | 76 | 0 |
| 102 | Comp. | 101 | P1(0.60 μm) | 7.8 | 82 | 0.3 | P1(0.60 μm) | 8.6 | 74 | 3 |
| 103 | Comp. | 101 | P1(0.60 μm) | 12.3 | 81 | 0.4 | P1(0.60 μm) | 13.6 | 72 | 5 |
| 104 | Inv. | 101 | P2(0.48 μm) | 1.1 | 85 | 0.5 | P2(0.48 μm) | 1.2 | 76 | 0.5 |
| 105 | Inv. | 101 | P2(0.48 μm) | 6.3 | 82 | 3 | P2(0.48 μm) | 7.0 | 74 | 3 |
| 106 | Inv. | 101 | P2(0.48 μm) | 10.1 | 81 | 5 | P2(0.48 μm) | 11.1 | 72 | 5 |
| 107 | Comp. | 101 | P2(0.48 μm) | 13.6 | 79 | 7 | P2(0.48 μm) | 14.9 | 71 | 7 |
| 108 | Inv. | 101 | P3(0.38 μm) | 0.9 | 85 | 0.5 | P3(0.38 μm) | 1.0 | 76 | 0.5 |
| 109 | Inv. | 101 | P3(0.38 μm) | 5.1 | 82 | 3 | P3(0.38 μm) | 5.6 | 74 | 3 |
| 110 | Inv. | 101 | P3(0.38 μm) | 8.2 | 81 | 5 | P3(0.38 μm) | 9.0 | 72 | 5 |
| 111 | Comp. | 101 | P3(0.38 μm) | 11.1 | 79 | 7 | P3(0.38 μm) | 12.2 | 71 | 7 |
| 112 | Inv. | 101 | P4(0.28 μm) | 0.7 | 85 | 0.5 | P4(0.28 μm) | 0.7 | 76 | 0.5 |
| 113 | Inv. | 101 | P4(0.28 μm) | 3.8 | 82 | 3 | P4(0.28 μm) | 4.2 | 74 | 3 |
| 114 | Inv. | 101 | P4(0.28 μm) | 6.2 | 81 | 5 | P4(0.28 μm) | 6.8 | 72 | 5 |
| 115 | Comp. | 101 | P5(0.08 μm) | 1.1 | 82 | 0.2 | P5(0.08 μm) | 1.2 | 74 | 3 |
| 116 | Comp. | 101 | P5(0.08 μm) | 2.6 | 79 | 0.4 | P5(0.08 μm) | 2.8 | 71 | 7 |
| 201 | Comp. | 201 | — | 0.0 | 43 | 0 | — | 0.0 | 42 | 0 |
| 202 | Comp. | 201 | P4(0.28 μm) | 3.3 | 42 | 3 | P4(0.28 μm) | 3.5 | 41 | 3 |

TABLE 5-continued

| | | | | | | | | | | |
|---|---|---|---|---|---|---|---|---|---|---|
| 203 | Comp. | 201 | P4(0.28 μm) | 5.3 | 41 | 5 | P4(0.28 μm) | 5.7 | 40 | 5 |
| 301 | Comp. | 301 | — | 0.0 | 88 | 0 | — | 0.0 | 90 | 0 |
| 302 | Inv. | 301 | P4(0.28 μm) | 5.3 | 85 | 3 | P4(0.28 μm) | 6.3 | 87 | 3 |
| 303 | Inv. | 301 | P4(0.28 μm) | 8.6 | 84 | 5 | P4(0.28 μm) | 10.1 | 86 | 5 |

| | | | 14th layer (high-speed blue-sensitive emulsion layer) | | | | | |
|---|---|---|---|---|---|---|---|---|
| Sample | | Base Sample | Regular-crystal emulsion | Amt. used (ratio to amt. of 14th layer Ag) (%) | Projected area ratio of grains of ≧AR8 (%) | Projected area ratio of 0.1–0.5 μm regular crystal grains (%) | Specified speed | Bright acuity |
| 101 | Comp. | 101 | — | 0.0 | 75 | 0 | 400 | 100 |
| 102 | Comp. | 101 | P1(0.60 μm) | 8.8 | 73 | 3 | 420 | 80 |
| 103 | Comp. | 101 | P1(0.60 μm) | 13.9 | 71 | 5 | 430 | 63 |
| 104 | Inv. | 101 | P2(0.48 μm) | 1.3 | 75 | 0.5 | 425 | 98 |
| 105 | Inv. | 101 | P2(0.48 μm) | 7.2 | 73 | 3 | 430 | 96 |
| 106 | Inv. | 101 | P2(0.48 μm) | 11.4 | 71 | 5 | 440 | 90 |
| 107 | Comp. | 101 | P2(0.48 μm) | 15.3 | 70 | 7 | 440 | 80 |
| 108 | Inv. | 101 | P3(0.38 μm) | 1.0 | 75 | 0.5 | 430 | 99 |
| 109 | Inv. | 101 | P3(0.38 μm) | 5.8 | 73 | 3 | 440 | 97 |
| 110 | Inv. | 101 | P3(0.38 μm) | 9.3 | 71 | 5 | 450 | 95 |
| 111 | Comp. | 101 | P3(0.38 μm) | 12.5 | 70 | 7 | 450 | 85 |
| 112 | Inv. | 101 | P4(0.28 μm) | 0.7 | 75 | 0.5 | 450 | 100 |
| 113 | Inv. | 101 | P4(0.28 μm) | 4.3 | 73 | 3 | 460 | 99 |
| 114 | Inv. | 101 | P4(0.28 μm) | 7.0 | 71 | 5 | 470 | 96 |
| 115 | Comp. | 101 | P5(0.08 μm) | 1.3 | 73 | 3 | 403 | 100 |
| 116 | Comp. | 101 | P5(0.08 μm) | 2.9 | 70 | 7 | 405 | 99 |
| 201 | Comp. | 201 | — | 0.0 | 41 | 0 | 270 | 100 |
| 202 | Comp. | 201 | P4(0.28 μm) | 3.6 | 40 | 3 | 282 | 98 |
| 203 | Comp. | 201 | P4(0.28 μm) | 5.9 | 39 | 5 | 290 | 96 |
| 301 | Comp. | 301 | — | 0.0 | 86 | 0 | 390 | 100 |
| 302 | Inv. | 301 | P4(0.28 μm) | 5.8 | 83 | 3 | 470 | 98 |
| 303 | Inv. | 301 | P4(0.28 μm) | 9.3 | 82 | 5 | 480 | 96 |

From Table 5, it is apparent that when the size of regular-crystal silver halide grains is extremely large (samples 102 and 103), the decrease of bright acuity is unfavorably conspicuous although an increase of the specified speed can be recognized. It is also apparent that when the size of regular-crystal silver halide grains is extremely small (samples 115 and 116), an increase of the specified speed is slight. Further, it is apparent that when the ratio of regular-crystal silver halide grains is extremely large (samples 107 and 111), unfavorably the speed increase reaches the ceiling and the bright acuity is decreased. Still further, it is apparent that when the aspect ratio of tabular grains is low (samples 201 to 203), the effect of mixing of regular-crystal silver halide grains is slight. As a result, it is apparent that a silver halide color photosensitive material having the advantages of high speed and less deterioration of bright acuity can be provided by the present invention.

EXAMPLE 2

The same samples as in Example except that the emulsions Em-P1 to P5 were not spectrally sensitized were prepared. Further, there was performed an experiment in which at the preparation of coating sample, the tabular grain emulsion and regular-crystal silver halide grain emulsion were dissolved at 40° C. and mixed and, after a while under agitation, a coating sample was prepared. With respect to the samples of Example 1 having undergone spectral sensitization, similar experiment was performed. The results of specified speed measurement with respect to the sample 114 are listed in Table 6.

TABLE 6

| Time from emulsion mixing to coating | Specified speed of sample 114 wherein Em-P4 was not spectrally sensitized | Specified speed of sample 114 |
|---|---|---|
| 30 min | 470 | 470 |
| 4 hr | 470 | 470 |
| 6 hr | 450 | 470 |
| 8 hr | 440 | 470 |

It is apparent from the results of Table 6 that a silver halide color photosensitive material of reduced performance fluctuation despite prolonged aging during production can be obtained from regular-crystal silver halide grains of the present invention having undergone spectral sensitization.

EXAMPLE 3

With respect to the samples 101 to 301, samples wherein portions of the emulsions of 6th layer (high-speed red-sensitive emulsion layer), 11th layer (high-speed green-sensitive emulsion layer) and 14th layer. (high-speed blue-sensitive emulsion layer) were replaced by emulsions Em-P1 to P5 at constant silver coating amount and wherein compound ExM-5 of the present invention was added to the above emulsion layers were prepared in the same manner as in Example 1. The addition amount of ExM used in this Example was 0.063 g/m$^2$ in the 6th layer, 0.010 g/m$^2$ in the 11th layer and 0.016 g/m$^2$ in the 14th layer. The specified speed and bright acuity of each thereof were measured, and the results are listed in Table 7.

TABLE 7

| Sample | | Base sample | 6th layer (high-speed red-sensitive emulsion layer) Regular-crystal emulsion | Projected area ratio of grains of ≧AR 8 (%) | Projected area ratio of 0.1–0.5 μm regular crystal grains (%) | ExM-5 | 11th layer (high-speed green-sensitive emulsion layer) Regular-crystal emulsion | Projected area ratio of grains of ≥AR8 (%) | Projected area ratio of 0.1–0.5 μm regular crystal grains (%) | ExM-5 |
|---|---|---|---|---|---|---|---|---|---|---|
| 101 | Comp. | 101 | — | 85 | 0 | Abs. | — | 76 | 0 | Abs. |
| 152 | Comp. | 101 | — | 85 | 0 | Prs. | — | 76 | 0 | Prs. |
| 153 | Inv. | 101 | P4(0.28 μm) | 82 | 3 | Abs. | P4(0.28 μm) | 74 | 3 | Abs. |
| 154 | Inv. | 101 | P4(0.28 μm) | 82 | 3 | Prs. | P4(0.28 μm) | 74 | 3 | Prs. |
| 201 | Comp. | 201 | — | 43 | 0 | Abs. | — | 42 | 0 | Abs. |
| 252 | Comp. | 201 | — | 43 | 0 | Prs. | — | 42 | 0 | Prs. |
| 253 | Comp. | 201 | P4(0.28 μm) | 42 | 3 | Abs. | P4(0.28 μm) | 41 | 3 | Abs. |
| 254 | Comp. | 201 | P4(0.28 μm) | 42 | 3 | Prs. | P4(0.28 μm) | 41 | 3 | Prs. |
| 301 | Comp. | 301 | — | 88 | 0 | Abs. | — | 90 | 0 | Abs. |
| 352 | Comp. | 301 | — | 88 | 0 | Prs. | — | 90 | 0 | Prs. |
| 353 | Inv. | 301 | P4(0.28 μm) | 85 | 3 | Abs. | P4(0.28 μm) | 87 | 3 | Abs. |
| 354 | Inv. | 301 | P4(0.28 μm) | 85 | 3 | Prs. | P4(0.28 μm) | 87 | 3 | Prs. |

| Sample | | Base sample | 14th layer (high-speed blue-sensitive emulsion layer) Regular-crystal emulsion | Projected area ratio of grains of ≧AR8 (%) | Projected area ratio of 0.1–0.5 μm regular crystal grains (%) | ExM-5 | Specified speed | Bright acuity |
|---|---|---|---|---|---|---|---|---|
| 101 | Comp. | 101 | — | 75 | 0 | Abs. | 400 | 100 |
| 152 | Comp. | 101 | — | 75 | 0 | Prs. | 440 | 100 |
| 153 | Inv. | 101 | P4(0.28 μm) | 73 | 3 | Abs. | 460 | 99 |
| 154 | Inv. | 101 | P4(0.28 μm) | 73 | 3 | Prs. | 530 | 99 |
| 201 | Comp. | 201 | — | 40 | 0 | Abs. | 270 | 100 |
| 252 | Comp. | 201 | — | 40 | 0 | Prs. | 300 | 100 |
| 253 | Comp. | 201 | P4(0.28 μm) | 40 | 3 | Abs. | 282 | 98 |
| 254 | Comp. | 201 | P4(0.28 μm) | 40 | 3 | Prs. | 310 | 98 |
| 301 | Comp. | 301 | — | 86 | 0 | Abs. | 390 | 100 |
| 352 | Comp. | 301 | — | 86 | 0 | Prs. | 430 | 100 |
| 353 | Inv. | 301 | P4(0.28 μm) | 83 | 3 | Abs. | 470 | 98 |
| 354 | Inv. | 301 | P4(0.28 μm) | 83 | 3 | Prs. | 550 | 98 |

It is apparent from Table 7 that the compound ExM-5 of the present invention is effective in increasing of specified speed and that the speed increasing effect is strikingly manifest in conditions of the present invention wherein grains of 8 or higher aspect ratio occupy 70% or more of the projected area and wherein regular-crystal silver halide grains are present.

The present invention provides a silver halide color photosensitive material of high speed and reduced deterioration of bright acuity.

What is claimed is:

1. A silver halide color photosensitive material comprising a support and, superimposed thereon, at least one blue-sensitive silver halide emulsion layer, at least one green-sensitive silver halide emulsion layer and at least one red-sensitive silver halide emulsion layer, wherein (i) the specified speed of the photosensitive material is 350 or higher, (ii) the coating amount of silver in the photosensitive material is 7 g/m$^2$ or less, and (iii) any of the color-sensitive silver halide emulsion layers is composed of two or more silver halide emulsion layers of different photographic speeds, of which the silver halide emulsion layer with the highest photographic speed contains tabular silver halide grains of 8 or greater aspect ratio in a ratio of 70% or more based on the total projected area and regular-crystal silver halide grains of 0.1 to 0.5 μm equivalent-sphere diameter in a ratio of 0.5 to 5% based on the total projected area.

2. The silver halide color photosensitive material according to claim 1, wherein the regular-crystal silver halide grains are those spectrally sensitized.

3. The silver halide color photosensitive material according to claim 1, wherein the photosensitive material contains compound (A) which is a heterocyclic compound having one or more heteroatoms, the compound capable of substantially increasing the sensitivity of the silver halide color photosensitive material by addition thereof as compared with that exhibited when the compound is not added.

4. The silver halide color photosensitive material according to claim 1, wherein the coating amount of silver is 5 g/m$^2$ or less.

5. The silver halide color photosensitive material according to claim 3, wherein the compound (A) is represented by the following general formula (I):

General formula (I)

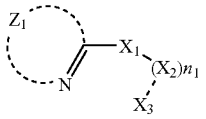

Where $Z_1$ represents a group for forming a heterocycle having one or two heteroatoms including the nitrogen atom of the formula; each of $X_1$ and $X_2$ independently represents a sulfur atom, an oxygen atom, a nitrogen atom (N(Va)) or a carbon atom (C(Vb)(Vc)), each of Va, Vb and Vc independently represents a hydrogen atom or a substituent; $n_1$ is 0, 1, 2 or 3, a plurality of $X_2$ may be the same or different when $n_1$ is 2 or greater; $X_3$ represents a sulfur atom, an oxygen atom or a nitrogen atom; and the bond between $X_2$ and $X_3$ is single or double, wherein $X_3$ may further have a substituent or a charge.

* * * * *